US012332017B2

(12) United States Patent
Reavis, III

(10) Patent No.: US 12,332,017 B2
(45) **Date of Patent: *Jun. 17, 2025**

(54) HANDGUN BRACE

(71) Applicant: GEAR HEAD WORKS, LLC, Hillsboro, TN (US)

(72) Inventor: Johnson Paul Reavis, III, Christiana, TN (US)

(73) Assignee: Gear Head Works, LLC, Hillsboro, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/228,295

(22) Filed: Jul. 31, 2023

(65) Prior Publication Data

US 2024/0068769 A1 Feb. 29, 2024

Related U.S. Application Data

(63) Continuation of application No. 17/035,210, filed on Sep. 28, 2020, now Pat. No. 11,754,367, which is a continuation of application No. 16/701,519, filed on Dec. 3, 2019, now Pat. No. 10,823,528, which is a continuation-in-part of application No. 16/211,522, filed on Dec. 6, 2018, now Pat. No. 10,690,442, which is a continuation of application No. 15/485,345, filed on Apr. 12, 2017, now Pat. No. 10,180,302, which is a continuation of application No. 15/407,362, filed on Jan. 17, 2017, now Pat. No. 9,664,477.

(60) Provisional application No. 62/327,219, filed on Apr. 25, 2016, provisional application No. 62/279,201, filed on Jan. 15, 2016.

(51) Int. Cl.

| | |
|---|---|
| ***F41C 27/22*** | (2006.01) |
| ***F41A 23/02*** | (2006.01) |
| ***F41C 23/04*** | (2006.01) |
| ***F41C 23/12*** | (2006.01) |

(52) U.S. Cl.

CPC ..... *F41C 27/22* (2013.01); *F41A 23/02* (2013.01); *F41C 23/04* (2013.01); *F41C 23/12* (2013.01)

(58) Field of Classification Search

CPC ..... F41C 23/10; F41C 23/14; F41C 23/12; F41C 23/04; F41C 27/22

See application file for complete search history.

(56) References Cited

U.S. PATENT DOCUMENTS 3,184,877 A * 5/1965 Andrews ..... F41C 23/12 42/72
3,209,481 A * 10/1965 Gilbert ..... F41C 23/00 42/71.01
3,256,632 A * 6/1966 Pier ..... F41C 23/06 42/72

(Continued)

*Primary Examiner* — Benjamin P Lee

(74) *Attorney, Agent, or Firm* — Eric B. Fugett; Mark A. Pitchford; Pitchford Fugett, PLLC

(57) ABSTRACT

A brace for stabilizing a handheld device such as a handgun against a user's forearm includes a vertically elongated body adapted to detachably engage a portion of the handheld device, and an arm pivotably connected to a portion of the body. The pivotable arm is selectably moveable between a stowed position wherein the arm is vertically aligned with the body, and a deployed position wherein the arm provides (Continued)

a surface against which a user's forearm is removably receivable to stabilize the handheld device when the body is engaged with the handheld device.

20 Claims, 58 Drawing Sheets

(56) References Cited

U.S. PATENT DOCUMENTS 3,324,588 A * 6/1967 Gilbert ..... F41C 23/00 42/71.01
3,442,042 A * 5/1969 Gilbert ..... F41C 23/00 42/71.01
4,291,482 A * 9/1981 Bresan ..... F41C 23/12 42/72
4,296,566 A * 10/1981 Campos ..... F41C 23/14 42/71.01
4,790,095 A * 12/1988 Campos ..... F41C 23/00 42/71.01
5,778,588 A * 7/1998 Allen, III ..... F41C 23/12 42/72
6,016,620 A * 1/2000 Morgan ..... F41C 33/001 42/94
6,250,009 B1 * 6/2001 Leontuk ..... F41C 23/12 42/72
7,028,427 B2 * 4/2006 Crawford ..... F41C 33/001 42/72
7,698,848 B1 * 4/2010 Bentley ..... F41C 23/04 42/73
8,051,596 B1 * 11/2011 Thomas, Jr. ..... F41C 33/001 24/2.5
8,109,026 B1 * 2/2012 Bentley ..... F41C 23/04 42/73
D745,941 S * 12/2015 Bosco ..... D22/108
D764,622 S * 8/2016 Bosco ..... D22/108
9,453,699 B1 * 9/2016 Barnett ..... F41B 5/1403
9,459,073 B1 * 10/2016 Kloeppel ..... F41C 23/20
D774,618 S * 12/2016 Bosco ..... D22/108
D780,279 S * 2/2017 Bosco ..... D22/108
2009/0049731 A1 * 2/2009 Seuk ..... F41A 23/16 42/94
2014/0053447 A1 * 2/2014 Singh ..... F41C 23/06 42/71.02
2014/0144061 A1 * 5/2014 Bosco ..... F41C 23/10 42/94
2015/0052795 A1 * 2/2015 Burke ..... F41C 23/04 42/71.01
2016/0265872 A1 * 9/2016 Tarazi ..... F41A 9/65
2016/0282084 A1 * 9/2016 Hollis ..... F41C 33/001

* cited by examiner

HANDGUN BRACE

CROSS-REFERENCES TO RELATED APPLICATIONS

This application is a continuation-in-part application of co-pending U.S. patent application Ser. No. 16/211,522, filed on Dec. 6, 2018 and entitled "HANDGUN BRACE," which is a continuation application of U.S. patent application Ser. No. 15/485,345, filed on Apr. 12, 2017 and entitled "HANDGUN BRACE," which issued as U.S. Pat. No. 10,180,302 on Jan. 15, 2019 and which is a continuation application of U.S. patent application Ser. No. 15/407,362, filed on Jan. 17, 2017 entitled "HANDGUN BRACE," which issued as U.S. Pat. No. 9,664,477 on May 30, 2017 and which claims priority to U.S. Provisional Patent Application Ser. No. 62/279,201 entitled "ARM BRACE DEVICE FOR A FIREARM," filed on Jan. 15, 2016, and U.S. Provisional Patent Application Ser. No. 62/327,219 entitled "ARM BRACE AND LATCH ASSEMBLY FOR A FIREARM," filed on Apr. 25, 2016, all of which are hereby incorporated by reference in their entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to a stabilizing device for a handgun or other handheld device and, more particularly, to an arm brace that receives and engages the user's forearm to stabilize the handgun or other handheld device during use.

The accuracy, speed, and precision with which a handgun can be reliably fired depend greatly upon the user's ability to hold the handgun steady while aiming and discharging it. This can be particularly challenging for physically disabled persons who cannot firmly grip or steady a handgun for a period of time sufficient to accurately fire the handgun. The difficulty of holding a handgun in a steady position is heightened during one-handed operation because a user must bear much of the weight and recoil of the handgun with the wrist of one hand, which can cause the user's hand and wrist to tire prematurely and negatively impact the user's ability to safely and reliably handle and fire the handgun. This problem is further increased with large frame handguns in which the weight of the handgun is centered at a location forward of the grip because such handguns require the user to continuously exert a counterbalancing force on the grip to maintain the handgun in a steady firing position and prevent the muzzle of the handgun from tilting downward.

A number of devices designed to attach to a handgun to aid a user in holding or stabilizing the handgun are known. For example, U.S. Pat. No. 8,869,444 discloses an flexible cuff that attaches to a handgun and employs a pair of elongated spaced flaps between which a user's forearm is secured with an adjustable securement strap to help stabilize the handgun during firing. However, the flaps apply oppositely directed inward forces to grip a user's forearm, which can chafe the user's forearm during prolonged use, while the strap requires the use of a second hand to operate, which introduces an undesirable degree of complexity that may be difficult for physically disabled users to overcome.

By contrast, the device marketed at the time of filing as the SHOCKWAVE® Blade Pistol Stabilizer employs a vertical stabilizing fin that rests against the inside of a user's forearm to stabilize an attached handgun during firing. Although designed with apertures through which a standard rifle sling may optionally be threaded to secure the fin to the user's forearm, in the absence of an accompanying sling or securement strap, the device relies solely on friction between the user's forearm and the fin to stabilize the handgun vertically during firing, which may be insufficient to adequately stabilize large frame handguns.

Additional handheld devices and apparatuses which tend to be similarly difficult and cumbersome to operate include metal detectors, vacuums, drills and various tools, among others. Such devices are often so bulky and heavy that normal operation can prematurely strain and tire the hand and wrist of even able-bodied persons. This is particularly disadvantageous for persons employed in positions where prolonged operation of the handheld device is necessary or unavoidable because premature strain can negatively impact the user's ability to continually and precisely operate the device.

Accordingly, what is need are improvements in stabilizing devices for handguns and other handheld devices.

SUMMARY OF THE INVENTION

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The presently disclosed subject matter overcomes some or all of the above-identified deficiencies of the prior art, as will become evident to those of ordinary skill in the art after a study of the information provided in this document.

Accordingly, in one aspect, the present disclosure provides a handgun brace for stabilizing a handgun on a user's forearm, the handgun brace including a body adapted to detachably engage a support structure of a handgun, such as an integral receiver extension. The handgun brace further includes a first arm extending from the body, and a second arm pivotally connected to the first arm such that the second arm is moveable between an open position and a closed position. When the second arm is in the closed position, a portion of the second arm is received against a portion of the body opposite the first arm. When the second arm is in the open position, the first arm and the second arm form a support surface shaped to receive and engage a user's forearm such that the user's forearm is removably receivable against the support surface to stabilize the handgun when the body is engaged with the support structure of the handgun.

In another aspect, the disclosure provides a telescopic handgun brace for stabilizing a handgun having a support structure extending rearwardly from a rear end thereof on a user's forearm. The handgun brace includes a mounting body having a front end, a rear end, a main passage extending axially within said body through at least the front end thereof, and at least one secondary passage extending axially through said body from said front end to said rear end, the support structure of said handgun being receivable by said main passage, and a main body having a front end, a rear end, and at least one rod extending forwardly from the front end of the main body, said at least one rod being telescopically receivable by said at least one secondary passage of the mounting body. The handgun brace can further have a first arm extending downwardly from said main body, and a second arm pivotally connected to the first arm. The second arm is selectively moveable between a stowed position wherein a portion of the second arm is received against the main body, and a deployed position wherein said first arm and said second arm form a support surface upon which a user's forearm is received during discharge of the handgun while said handgun brace is attached thereto.

In yet another aspect, the disclosure provides a telescopic handgun brace for stabilizing a handgun on a user's forearm, the handgun brace including a support structure having a forward end adapted to be detachably engaged with a rear end of a handgun, a rearward end opposite the forward end, a length, and a downwardly protruding rib extending longitudinally along a portion of the length, the rib having a plurality of cross notches formed in a side thereof. The handgun brace also includes a body having a front end, a rear end, a passage extending axially within the body through at least the front end thereof, said support structure being telescopically receivable by said passage; a forearm support member in which a user's forearm is removably receivable to stabilize the handgun when the rearward end of the support structure is received in said passage and the forward end is engaged with the rear end of said handgun, said forearm support member extending from said body; and a push-button locking latch extending laterally through a portion of the body, said latch adapted to releasably engage at least one of said cross notches to selectively lock said body in one of a plurality of positions relative to the support structure.

In another aspect, the disclosure provides a brace for stabilizing a handheld device against a user's forearm, the brace including a vertically elongated body adapted to detachably engage a portion of the handheld device, and an arm pivotably connected to the elongated body, the arm selectably moveable between a stowed position wherein the arm is substantially aligned with the elongated body, and a deployed position wherein the arm provides a surface against which a user's forearm is removably receivable to stabilize the handheld device when the elongated body is engaged with the handheld device.

Numerous other objects, advantages and features of the present disclosure will be readily apparent to those of skill in the art upon a review of the following drawings and description of a preferred embodiment.

BRIEF DESCRIPTION OF THE DRAWINGS

Non-limiting and non-exhaustive embodiments are described with reference to the following figures.

DETAILED DESCRIPTION OF THE INVENTION

Figure 1:
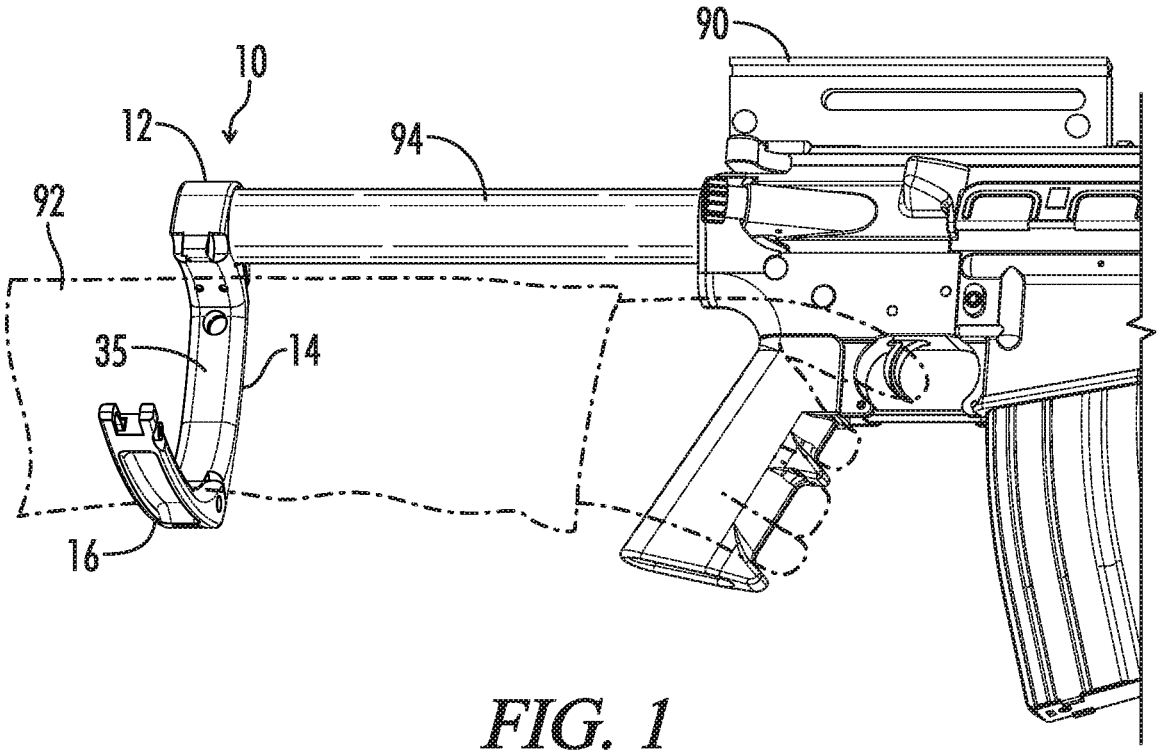
FIG. 1 is a side elevational view of an embodiment of a brace for stabilizing a handgun or other handheld device constructed in accordance with the present disclosure showing the brace in use and attached to a handgun.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The term "when" is used to specify orientation for relative positions of components, not as a temporal limitation of the claims or apparatus described and claimed herein unless otherwise specified. The term "lateral" denotes a side to side direction when facing the "front" of an object.

In the drawings, not all reference numbers are included in each drawing, for the sake of clarity. In addition, positional terms such as "vertical," "horizontal," "above," "below," "upper," "lower," "side," "top," "bottom," and other orientation terms refer to the apparatus when in the orientation shown in the drawing. A person of skill in the art will recognize that the apparatus can assume different orientations when in use.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Turning now to the drawings, wherein like reference numbers refer to like elements, there is illustrated in FIGS. 1 through 10 an embodiment of a brace 10 mountable to a handgun 90 or other handheld device to assist a user in stabilizing the handgun or other handheld device on a user's forearm 92 without straining the user's arm, hand, or wrist. The brace 10 aids a user in stabilizing a handgun or other handheld device in both vertical and horizontal planes with only one hand by releasably engaging two adjacent sides of the user's forearm with a selectively deployable, directionally rigid forearm support member 34 to simultaneously counterbalance the weight of the handgun and reduce lateral rotation of the handgun around the grip. In this way, the brace 10 can counteract the forward tilt exhibited by large and front heavy handguns 90 due to the weight of such weapons being centered at a location forward of their grip, as well as recoil forces generated by a handgun during firing and other commonly encountered environmental forces, such as crosswinds. The brace 10 provides greater and more consistent steadying support than friction alone, without the use of complicated securement straps or uncomfortably tight cuffs that can restrict a user's range of motion. Quickly and easily operable with only one hand, the brace 10 is particularly advantageous for persons who require assistance or otherwise have difficulty with firmly gripping or steadying a handgun for a sufficient period of time to accurately fire the handgun.

In one embodiment, the brace 10 comprises a body 12, a first arcuate arm 14 extending from the body 12, and a second arcuate arm 16 pivotally connected to an end of the first arm 14 opposite the body 12. The body 12 includes a front end 18, a rear end 20 opposite the front end 18, opposing left and right sides 11, 13 extending between the front end 18 and the rear end 20, and a passage 19 extending axially completely through the body 12 between the front end 18 and the rear end 20. Passage 19 provides for telescopic insertion therein of a portion of a handgun 90 or other handheld device to secure or mount the brace 10 to the handgun or other handheld device. As shown in FIG. 1, a handgun 90 can include a receiver extension 94 or similar support structure that extends rearwardly from a rear end of the handgun 90. The brace 10 is mounted or secured to the receiver extension 94 of the handgun 90 by inserting the receiver extension 94 through the passage 19 from the front end 18 of the body 12. The body 12 is sized to permit the receiver extension 94 to extend completely though the passage 19 and outwardly from the rear end 20 of the body 12. This is desirable in order to enable a user to selectively mount the brace 10 at any location along the length of the receiver extension 94 suited to the length of the user's forearm or personal preference. The body 12 is formed as an upwardly extending lobe including a selectively releasable clamping member 22 and one or more clamp screws 24 operable to retain the receiver extension 94 in the passage 19. Other suitable means of retaining the receiver extension 94 in the passage 19, including but not limited to a set screw, will be apparent to those of ordinary skill in the art and are encompassed within the scope of the invention.

It is to be understood that the brace 10 is mountable to handguns that do not include a receiver extension 94 such as that depicted in FIG. 1. The brace 10 is mountable to any handgun or other handheld device having a generally cylindrical support structure extending rearwardly from a rear end thereof by telescopically receiving the support structure in the passage 19. It is also contemplated that a suitable support structure comprising a cylindrical or tubular member receivable in the passage 19 can be provided for attachment to a handgun or other handheld device that otherwise lacks a generally cylindrical support structure upon which the brace 10 may be mounted. For example, a support structure receivable in the passage 19 to mount or secure the brace 10 to a handgun that does not natively include a receiver extension 94 or similar support structure can comprise a spud secured to the rear end of the handgun. In other implementations, a support structure receivable in the passage 19 to mount or secure the brace 10 to a handgun that does not natively include a receiver extension 94 or similar support structure can comprise a spud secured to a mounting bracket that is secured to the rear end of the handgun. Once secured directly or indirectly to the rear end of the handgun, the spud can provide a suitable support structure to which the brace 10 may be attached by receiving the spud within the passage as previously disclosed with respect to receiver extension 94.

Figure 2:
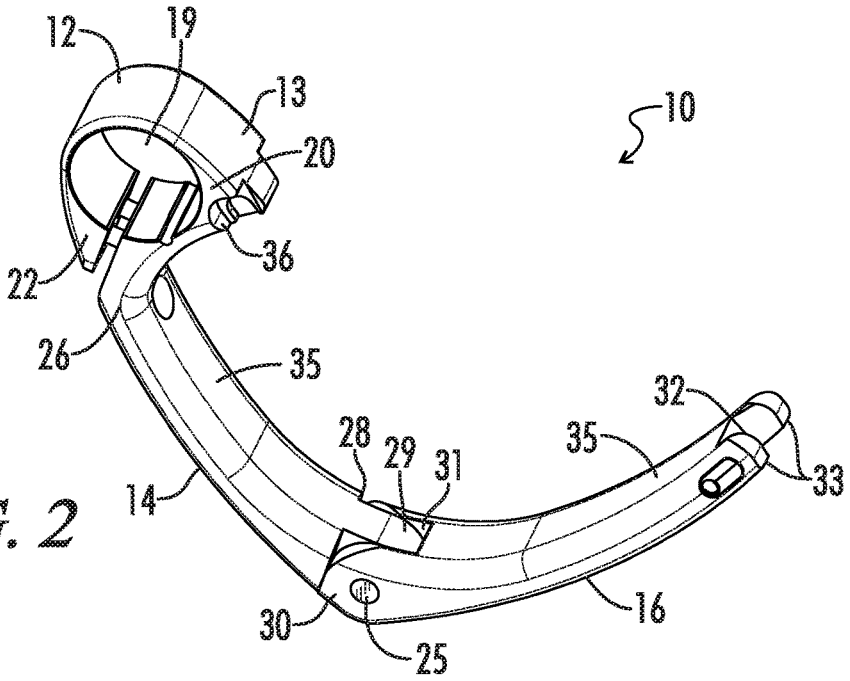
FIG. 2 is perspective view of the brace of FIG. 1.
Figure 10:
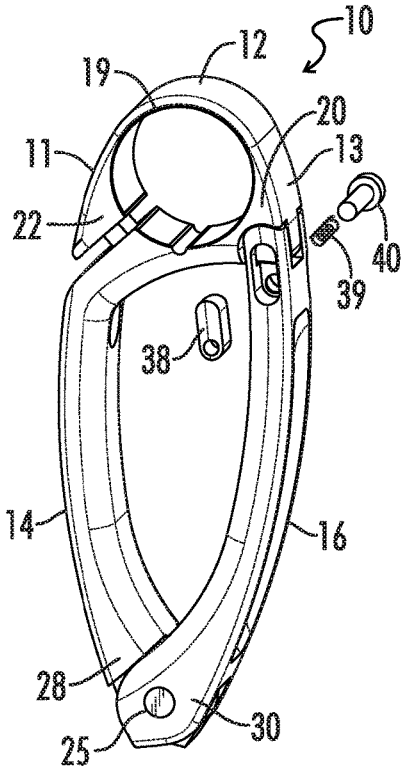
FIG. 10 is a partially exploded perspective view of the brace of FIG. 1 in a non-use configuration.

The first and second arms 14, 16 of brace 10 each have a proximal end 26, 30 opposite a distal end 28, 32. The first arm 14 is coupled at its proximal end 26 to a side 11 of the body 12, and extends generally downward from the body 12 such that the distal end 28 of the first arm 14 is positioned below the body 12. The distal end 28 of the first arm 14 includes a projection 29, and the proximal end 30 of the second arm 30 includes a recess 31 in which the projection 29 is received. The second arm 16 is pivotally connected at its proximal end 30 to the distal end 28 of the first arm 14 opposite the body 12 by pivot pin 25 to form a knuckle joint such that the second arm 16 is selectively moveable between an open (i.e., deployed) position as best shown in FIG. 2, and a closed (i.e., non-use or stowed) position as best shown in FIG. 10. In a particularly embodiment, pivot pin 25 is a roll pin.

Figure 3:
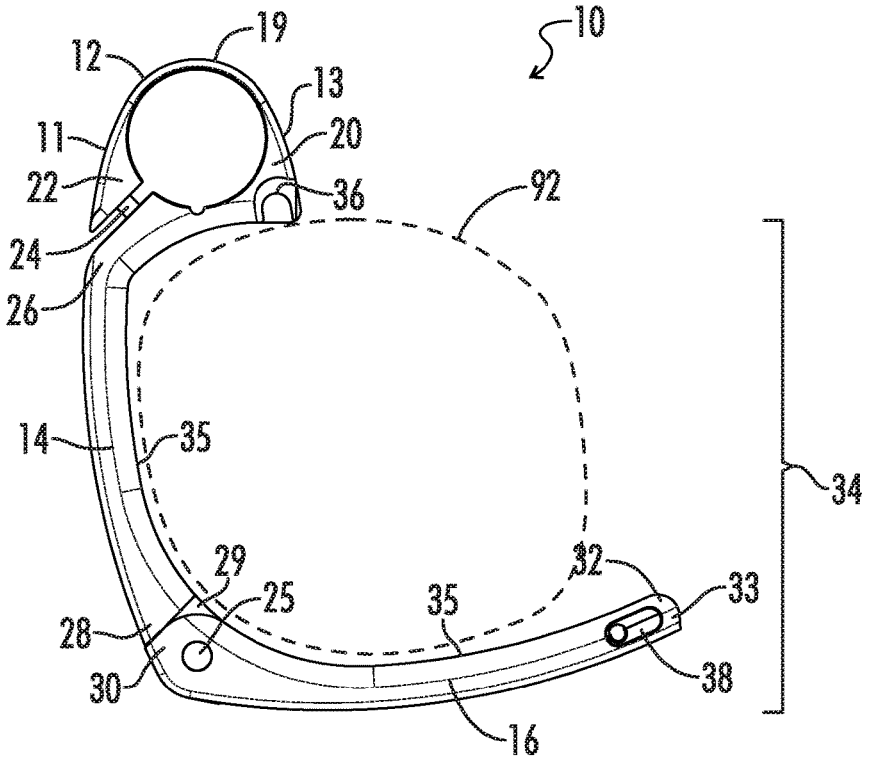
FIG. 3 is a rear elevational view of the brace of FIG. 1 illustrating the brace's engagement with a user's forearm.
Figure 4:
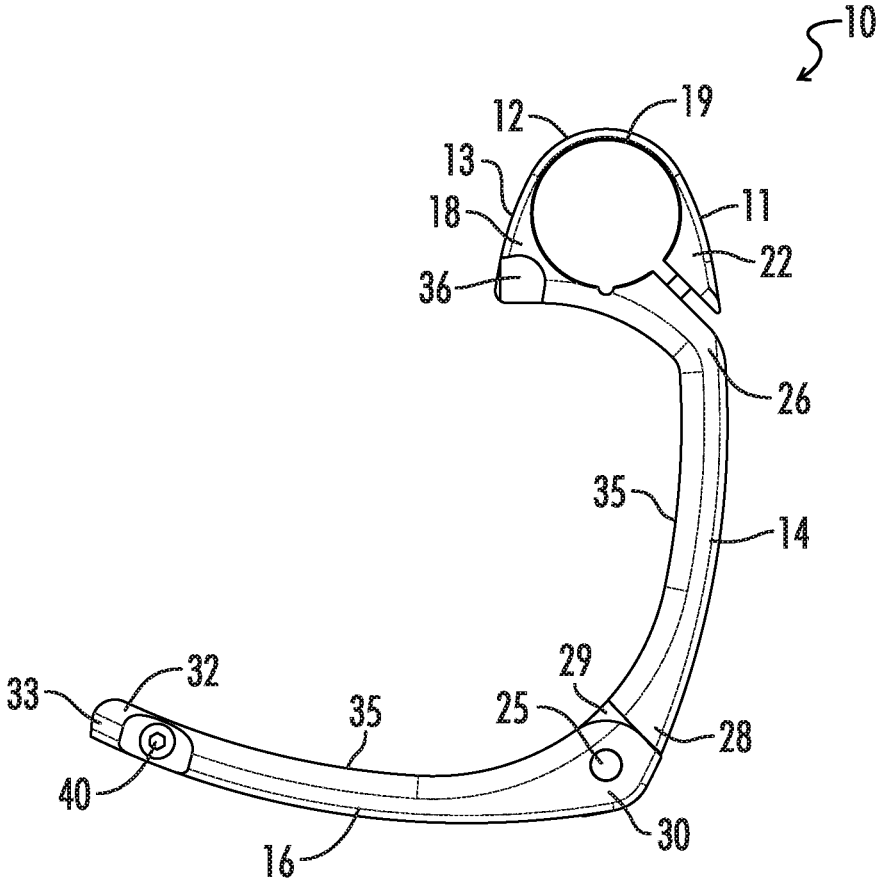
FIG. 4 is a front elevational view of the brace of FIG. 1.
Figure 5A:
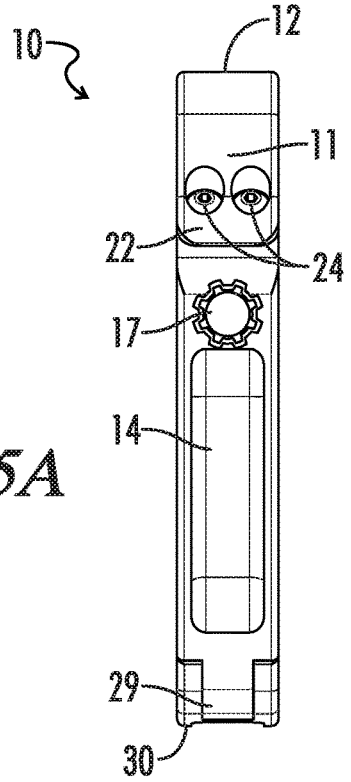
FIG. 5A is a left side elevational view of the brace of FIG. 1.
Figure 5B:
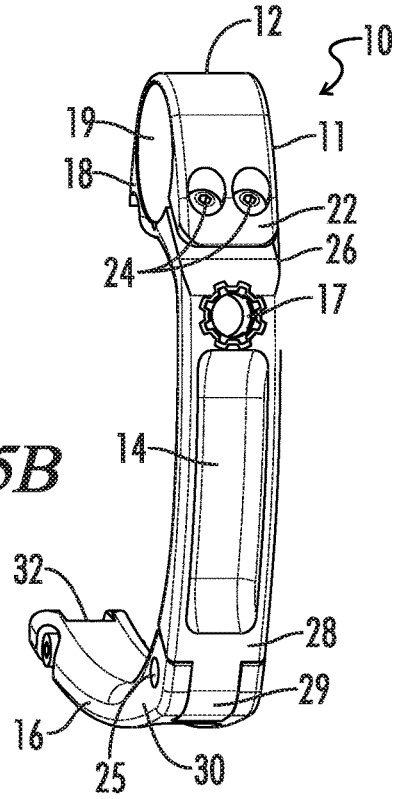
FIG. 5B is a perspective view of the brace of FIG. 5A.
Figure 6A:
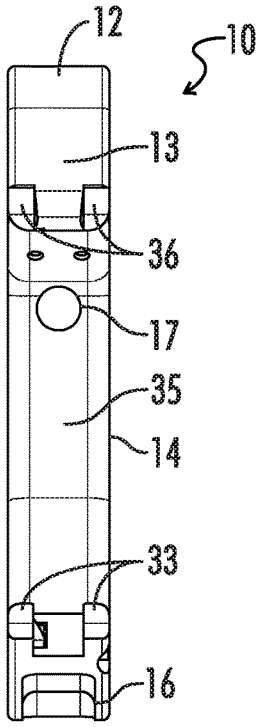
FIG. 6A is a right side elevational view of the brace of FIG. 1.
Figure 6B:
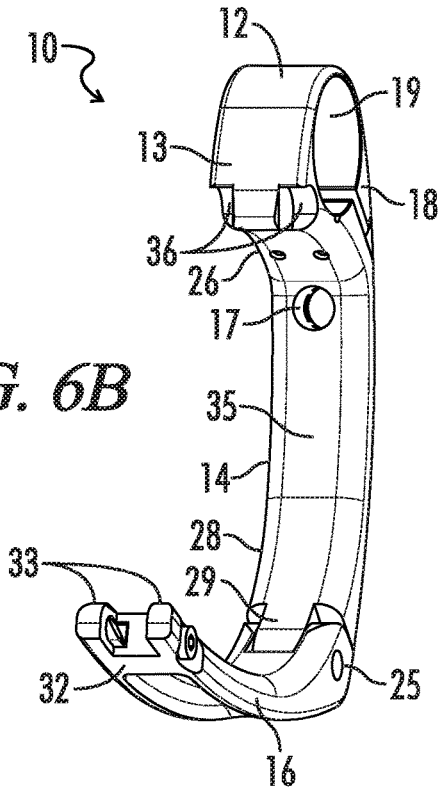
FIG. 6B is a perspective view of the brace of FIG. 6A.
Figure 7A:
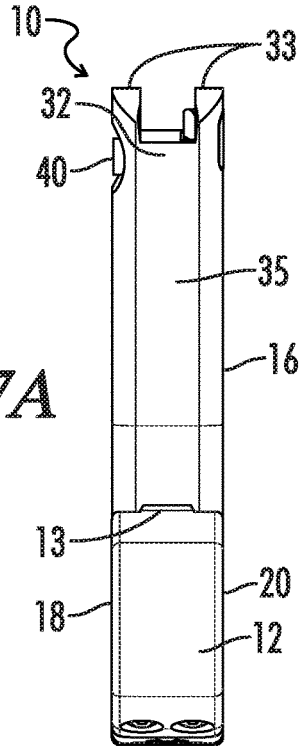
FIG. 7A is a top plan view of the brace of FIG. 1.
Figure 7B:
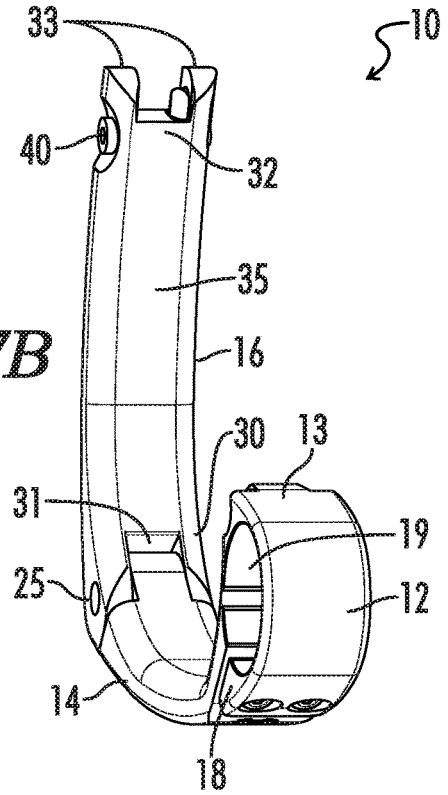
FIG. 7B is a perspective view of the brace of FIG. 7A.
Figure 8A:
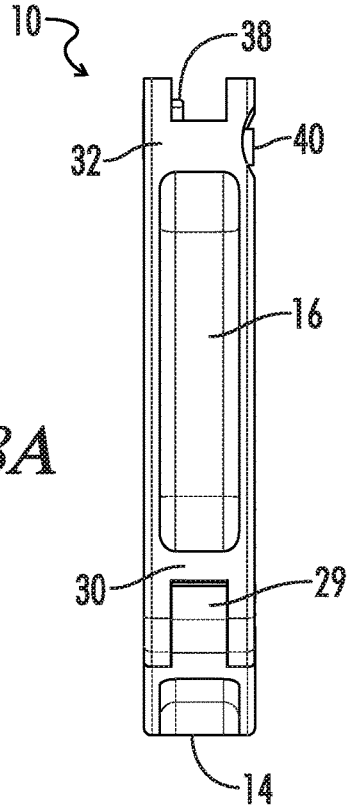
FIG. 8A is a bottom plan view of the brace of FIG. 1.
Figure 8B:
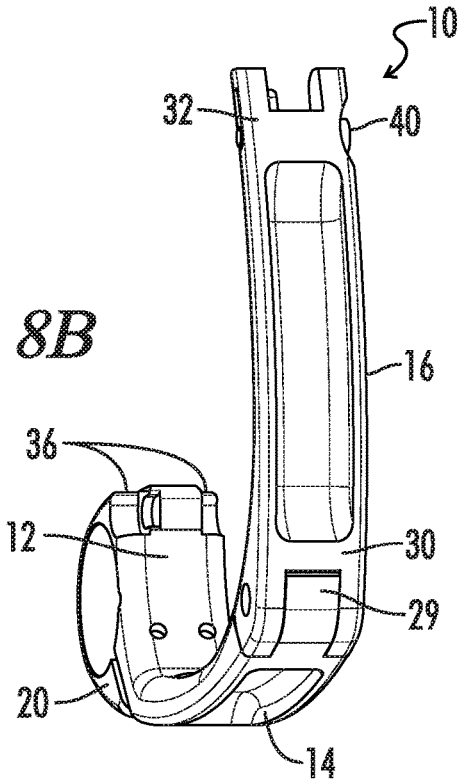
FIG. 8B is a perspective view of the brace of FIG. 8A.
Figure 9:
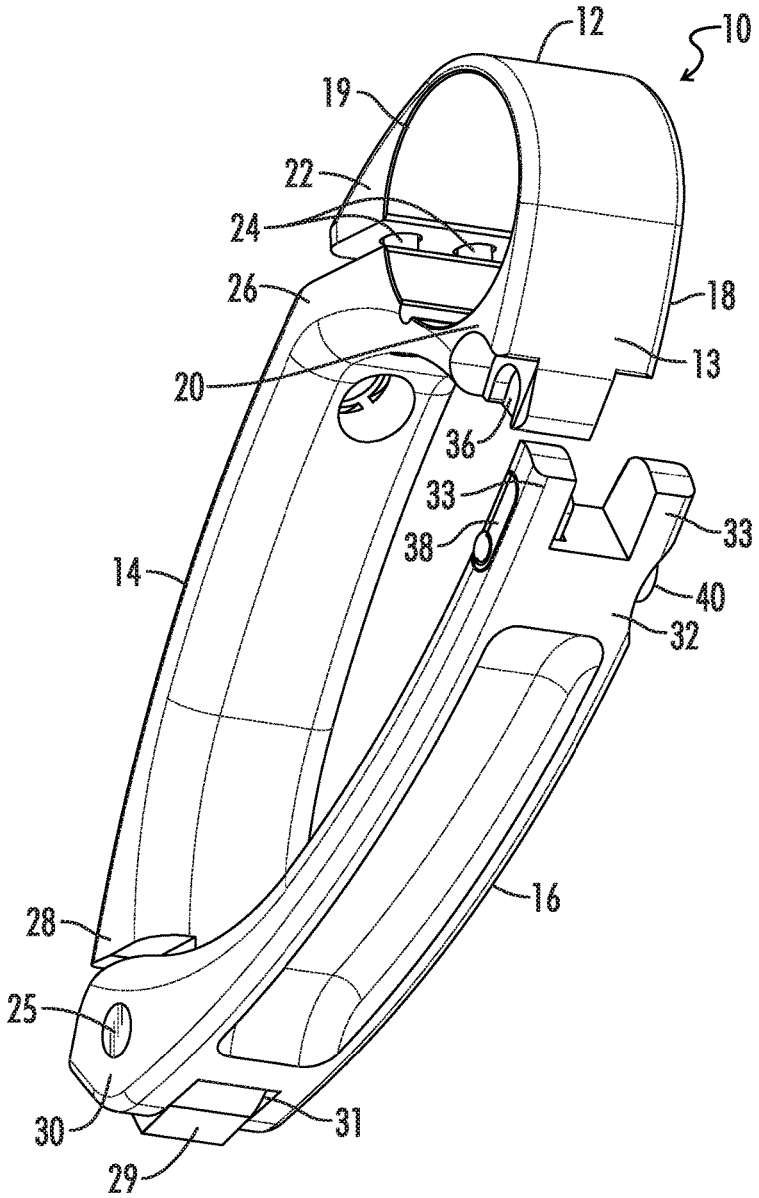
FIG. 9 is a perspective view of the brace of FIG. 1 in a partially closed configuration showing the second arm positioned to be releasably engaged with the body of the brace.

When the second arm 16 is in the open or deployed position, the first and second arms 14, 16 form a forearm support member 34 having a continuous support surface 35 shaped to receive and engage a user's forearm 92. The pivotally connected ends of the first and second arms 28, 30 are shaped such that a portion of the proximal end 30 of the second arm 16 engages a portion of the distal end 28 of the first arm 14 to prevent the second arm 16 from rotating more than about ninety degrees around the pivot pin 25 from the first arm 14, as shown in FIG. 3. This helps the forearm support member 34 to remain downwardly rigid and brace the handgun against the directional forces encountered during use of the handgun.

Specifically, when the user's forearm 92 is received in the forearm support member 34 against the support surface 35, the portion of the forearm support member 34 formed by the second arm 16 is positioned below the user's forearm 92 so that when the downward moment produced by the forward end of an attached front-heavy handgun 90 biases the rear of the handgun 90 and the forearm support member 34 upward against the user's forearm 92, the forearm support member 34 remains rigid to counterbalance the weight of the handgun 90 with the user's forearm 92 and limit upward movement of the rear of the handgun. At the same time, the portion of the forearm support member 34 formed by the first arm 14 is positioned laterally to a side of the user's forearm so that the user's forearm can also assist in preventing lateral rotation of the handgun around the grip in at least one direction. Body 12, which extends laterally over a portion of the user's forearm 92 when the user's forearm is received on the support surface 35, provides an additional counterbalancing force to reduce muzzle flip when the handgun is fired. Thus, in this way, the brace 10 can assist a user in stabilizing a handgun in multiple directions when the user's forearm 92 is received against the support surface 35 of the forearm support member 34.

When the handgun is not in use, the second arm 16 can be moved to the stowed or non-use position to reduce the profile of the brace 10 so that the handgun 90 can be stored more compactly. When the second arm 16 is in the stowed position, the free or distal end 32 of the second arm 16 is received against the side 13 of the body 12 opposite the side 11 from which the first arm 14 extends. The side 13 of the body 12 against which the free or distal end 32 of the second arm 16 is receivable includes two recesses 36, and the distal end 32 of the second arm 16 includes two prongs 33 shaped to engage recesses 36 to retain second arm 16 in the non-use position. The free or distal end 32 of the second arm 16 also includes a selectively releasable fastening mechanism operable to lock prongs 33 in recesses 36 and thus retain second arm 16 in the stowed position when the handgun brace 10 is not in use. As more clearly shown in FIGS. 9 and 10, the fastening mechanism is a push button release including a latch bar 38, a spring 39, and a bolt 40. Each arm 14, 16 can also include a sling loop 27 defined through a portion of the arm in which a sling is receivable to assist a user with carrying the handgun brace and an attached handgun.

The body 12 of the brace 10 can also include a limited rotation quick detach sling swivel socket 17 which can receive and engage a quick detach sling swivel, such as a standard push button release sling swivel. As such, the brace 10 can provide a sling swivel attachment point on a handgun 90 enabling a user to attach a sling to the handgun 90 and thus more easily carry the handgun 90 when the sling is attached to the handgun and positioned about the user's person.

Alternative embodiments are possible and within the scope of the invention. For example, first arm 14 and body 12 can be formed as a single unitary piece, or as separate pieces that are subsequently coupled together. Additionally, the body can be a vertically elongated body formed in part by the first arm, which is fixed in a given position. Furthermore, although the brace 10 is shown in an orientation suitable for a right-handed user, the brace 10 can alternatively be placed in a mirrored configuration such that the brace 10 is suitable for a left-handed user. Alternatively, the brace 10 can be made completely ambidextrous by providing additional recesses 36 in side 11 of the body 12 opposite recesses 36, prongs 33 or other geometry at the proximal end 26 of first arm 14 that can mate with recesses 36 in side 11, and a selectively releasable fastening mechanism operable to releasably lock the proximal end 26 of first arm 14 to the side 11 of the body 12 when the brace is not in use or when the second arm 16 of the brace is in a deployed position.

In other embodiments, the second arm 16 can be pivotally connected to the first arm 14 so that when the second arm 16 is in the stowed position, a rear surface of second arm 16 is received against a front surface of the first arm 14 and the distal end 32 of the second arm 16 is positioned directly below body 12 such that the and first and second arms 14, 16 are vertically parallel.

In additional embodiments, passage 19 can be a blind passage that does not fully extend though body 12 between the front and rear ends 18, 20. Rather, passage 19 can extend though the front end 18 of body 12 and terminate at a position within body 12 proximate to rear end 20. In such case, receiver extension 94 does not extend beyond the rear end 20 of body 12.

In some embodiments, pivot 25 can include a biasing member such as a torsion spring (not shown) which can bias the second arm 16 in either the open or closed position. In some embodiments, the second arm 16 can be biased in the open position, with the torsion spring being placed in either tension or compression as the second arm 16 is moved to the closed position. The engagement of the two prongs 33 and the recesses 36 can resist the biasing force of the torsion spring and retain second arm 16 in the closed position until the user disengages the second arm 16 from body 12. In other embodiments, pivot 25 can be configured so that friction is produced between the first arm 14 and the second arm 16 such that the second arm 16 only rotates with respect to the first arm 14 when the user applies a force to the second arm 16 to overcome the friction. For example, protrusion 29 of first arm 14 can include a circular recess formed around the aperture in protrusion 29 through which pivot pin 25 extends. A rubber o-ring or the like can be disposed in the circular recess such that compression of the o-ring creates smooth friction between first arm 14, second arm 16, and pivot pin 25. As such, second arm 16 can be retained in any position relative to the first arm 14, including both the open and closed positions.

In still other embodiments, brace 10 can include a sear and detent assembly coupled to the first arm 14 and the second arm 16. The sear and detent assembly can be alternated between a first position where motion of the second arm 16 is prevented, and a second position where motion of the second arm 16 is allowed. In some embodiments, the first arm 14 and the second arm 16 can be configured such that the sear and detent assembly can only be placed in the first position when the second arm 16 is in the open position, such that the sear and detent assembly can selectively retain the second arm 16 in the open position.

In another alternative embodiment, handgun brace 10 can be mounted to a light weight handgun such as a CLOCK® brand pistol to dramatically reduce muzzle flip during firing of the handgun. A support structure such as an extension tube can be mounted to a portion of the rear of the handgun, such as the bottom of the grip, so that the extension tube extends rearwardly from the handgun and is receivable in passage 19. The brace 10 can be mounted to the extension tube in an upside down orientation from the orientation depicted in FIG. 1 such that pivot 25 is located above the body 12. As such, when second arm 16 is in the deployed position and a user's forearm 92 is received against support surface 35, the forearm support member 34 is positioned above the user's forearm to provide a counterbalancing force which can prevent the front of the handgun from tilting upward in response to recoil generated by firing the handgun. This can provide increased muzzle control for better target reacquisition and improved successive shot placement as well as reduce the risk of injury and discomfort to physically disabled and novice users resulting from recoil. In such a configuration, body 16 extends laterally under a portion of the user's forearm when the user's forearm is received against the support surface 35. Thus, when the weight of the handgun biases the body 12 upward, the body 16 engages the user's forearm to help support the weight of the handgun. Therefore, brace 10 can be used with light weight handguns to help support the weight of the handgun on the shooter's arm as well as prevent relative motion of the handgun in multiple directions.

Figure 11:
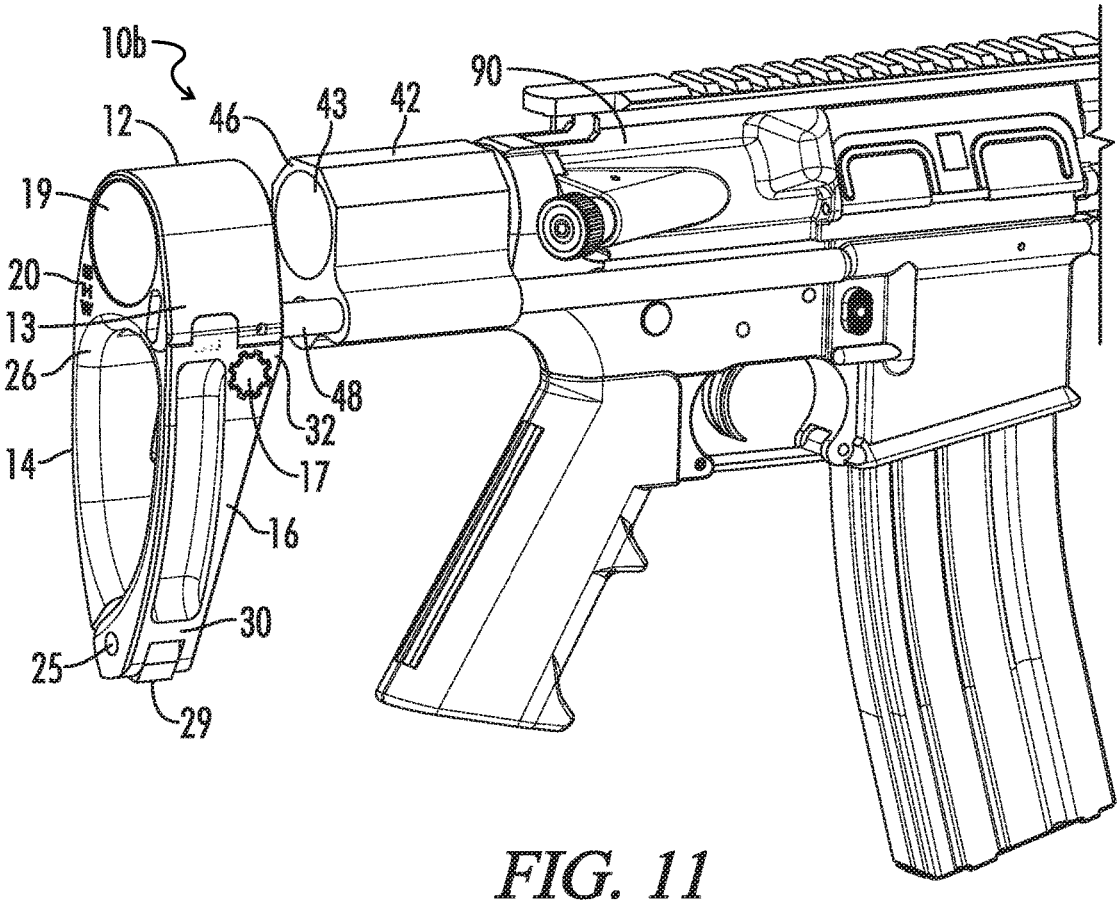
FIG. 11 is a perspective view of a brace constructed in accordance with an alternate embodiment of the present invention showing the brace attached to a handgun and in a compact, non-use configuration.
Figure 12:
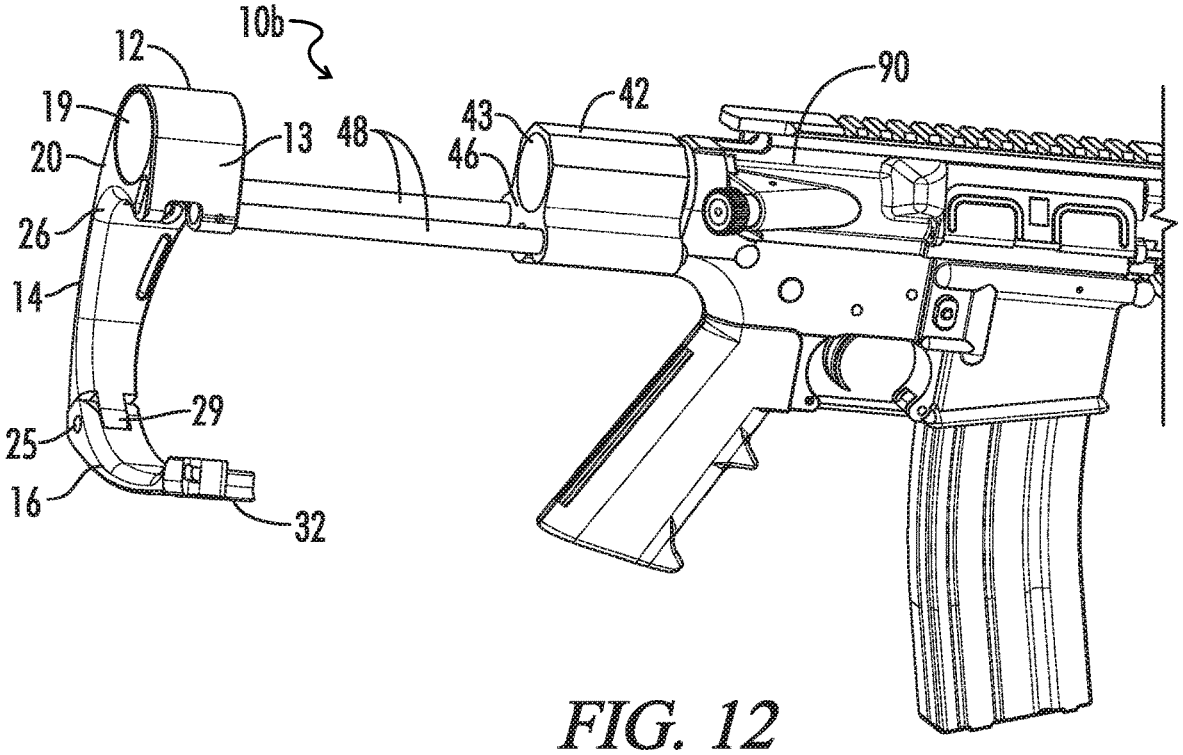
FIG. 12 is a perspective view of the brace of FIG. 11 showing the brace in an extended, deployed configuration.
Figure 13:
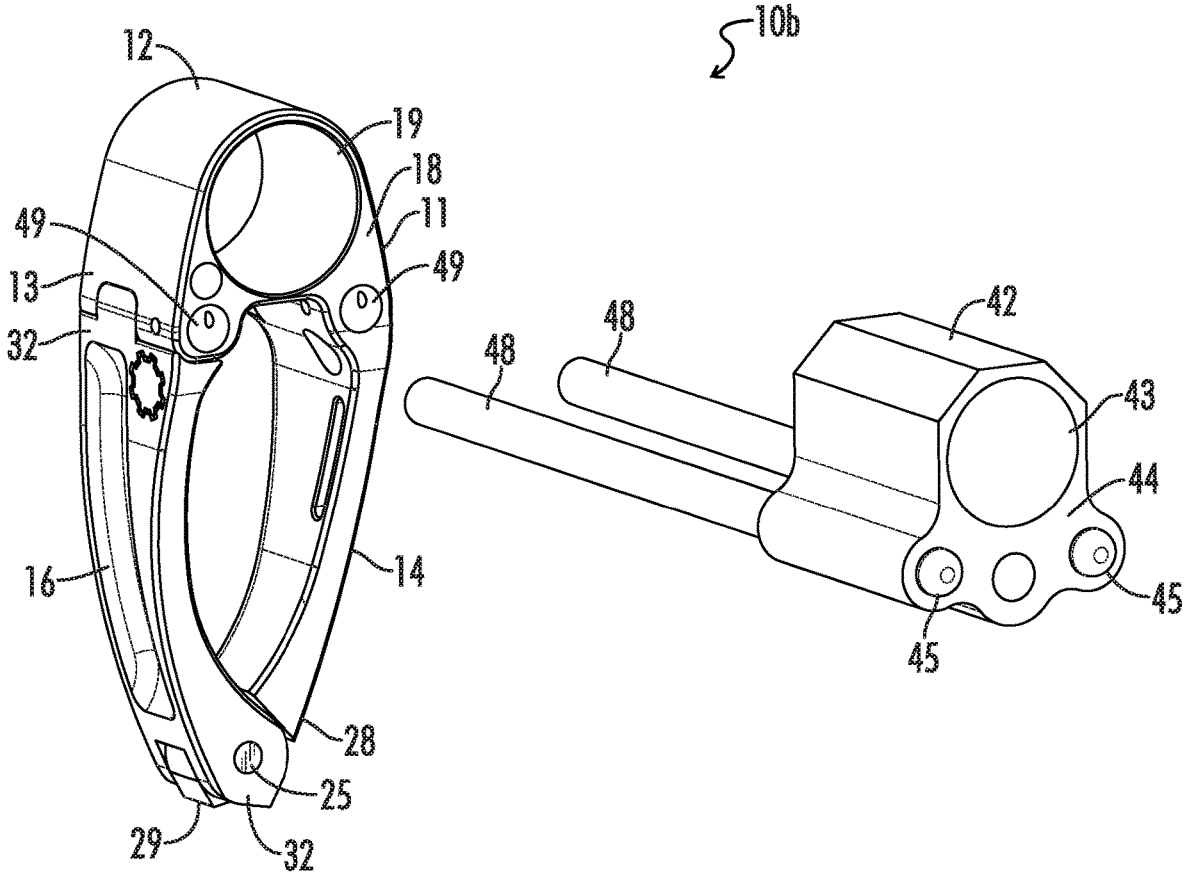
FIG. 13 is a partially exploded front perspective view of the brace of FIG. 11.
Figure 14:
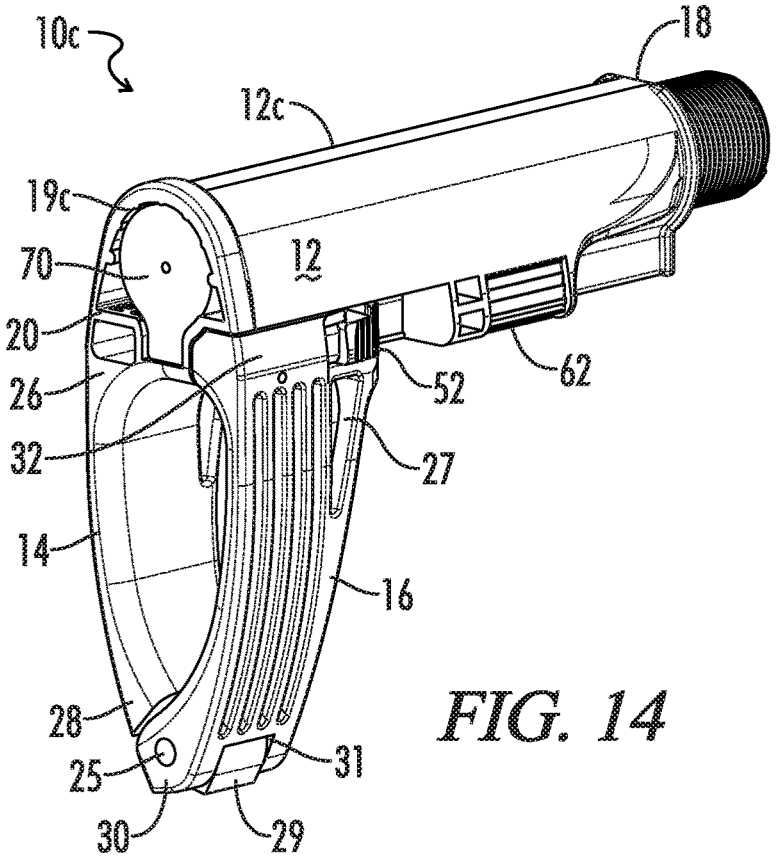
FIG. 14 is a right side perspective view of a brace constructed in accordance with another alternate embodiment of the present invention showing the brace in a non-use configuration.
Figure 15:
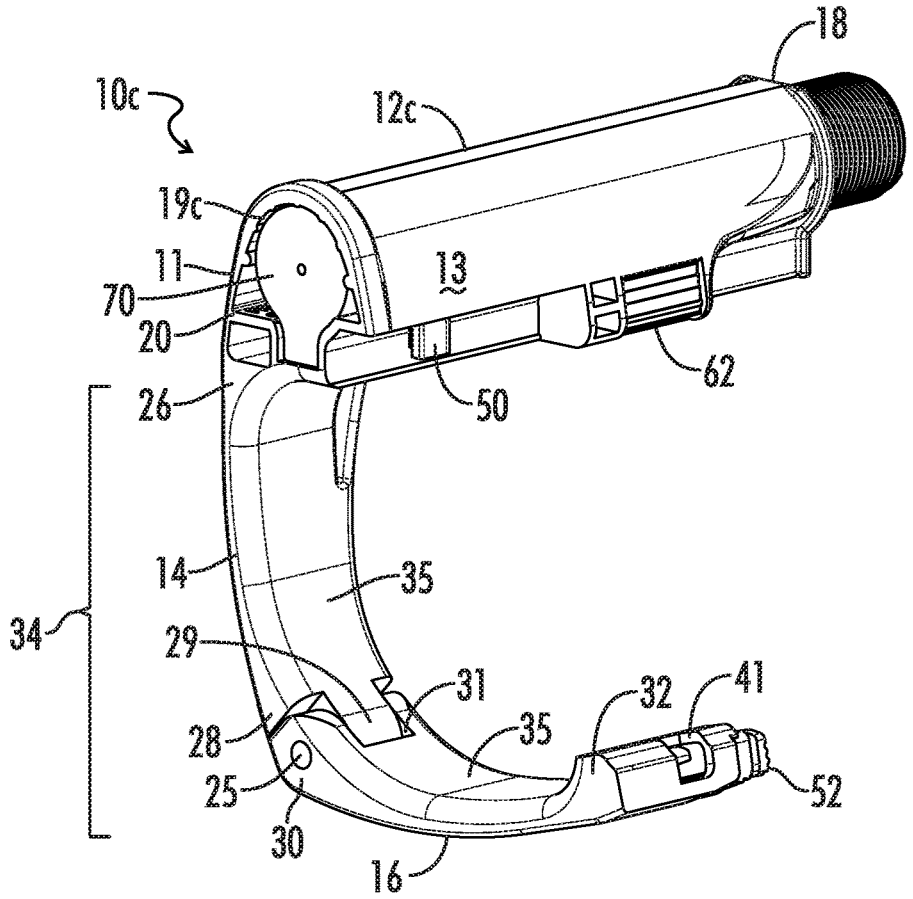
FIG. 15 is a right side perspective view of the brace of FIG. 14 showing the brace in a deployed configuration.
Figure 16:
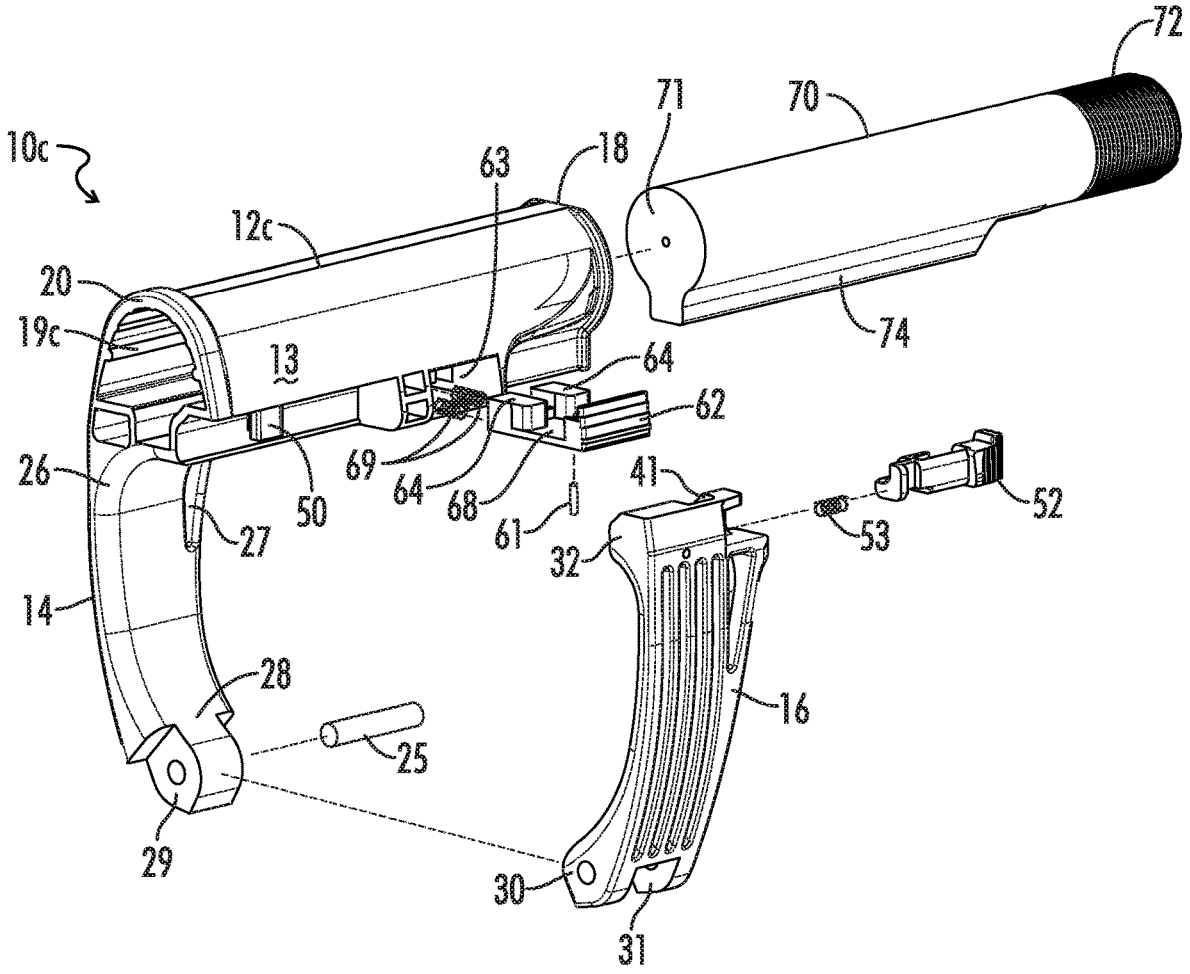
FIG. 16 is an exploded view of the brace of FIG. 14.
Figure 17A:
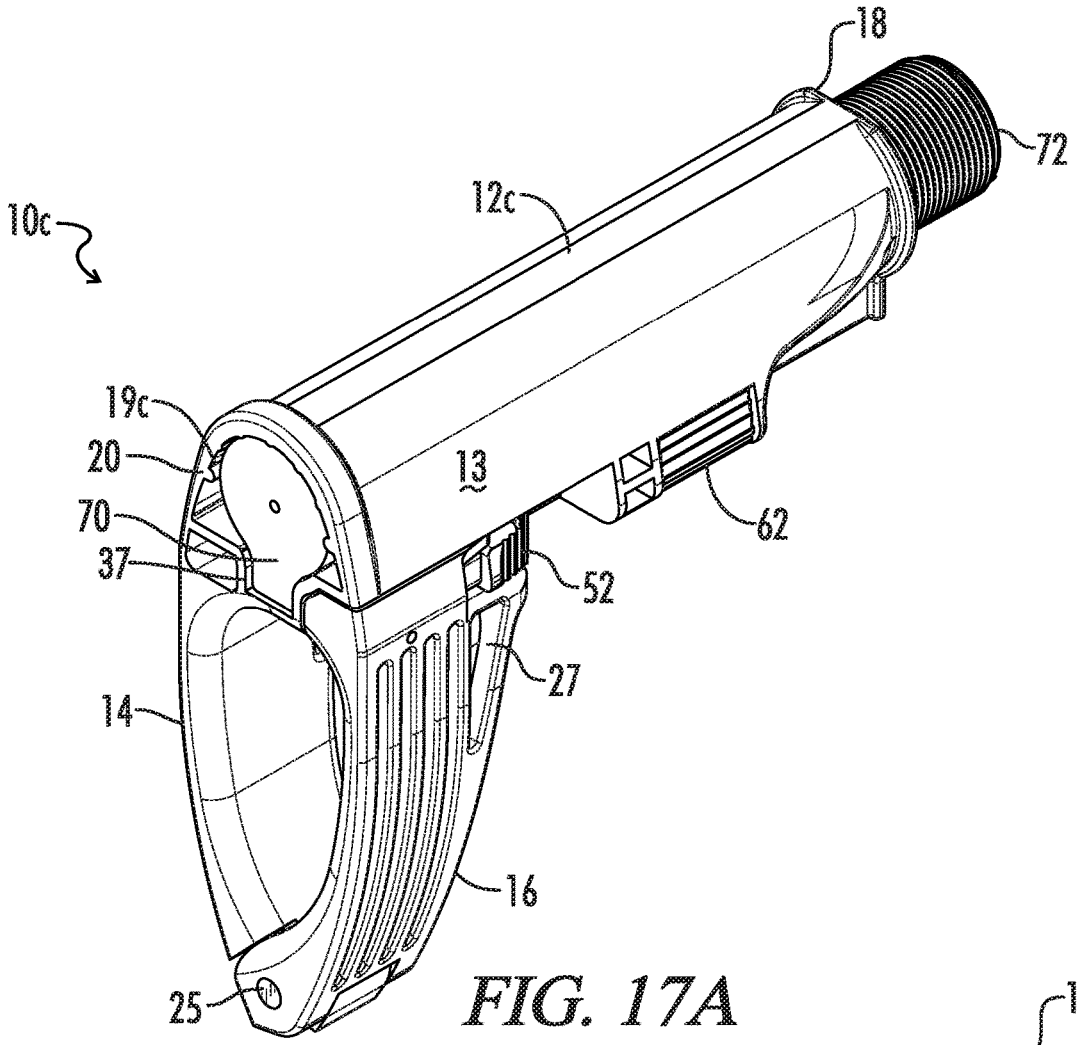
FIG. 17A is a right side perspective view of the brace of FIG. 14.
Figure 17B:
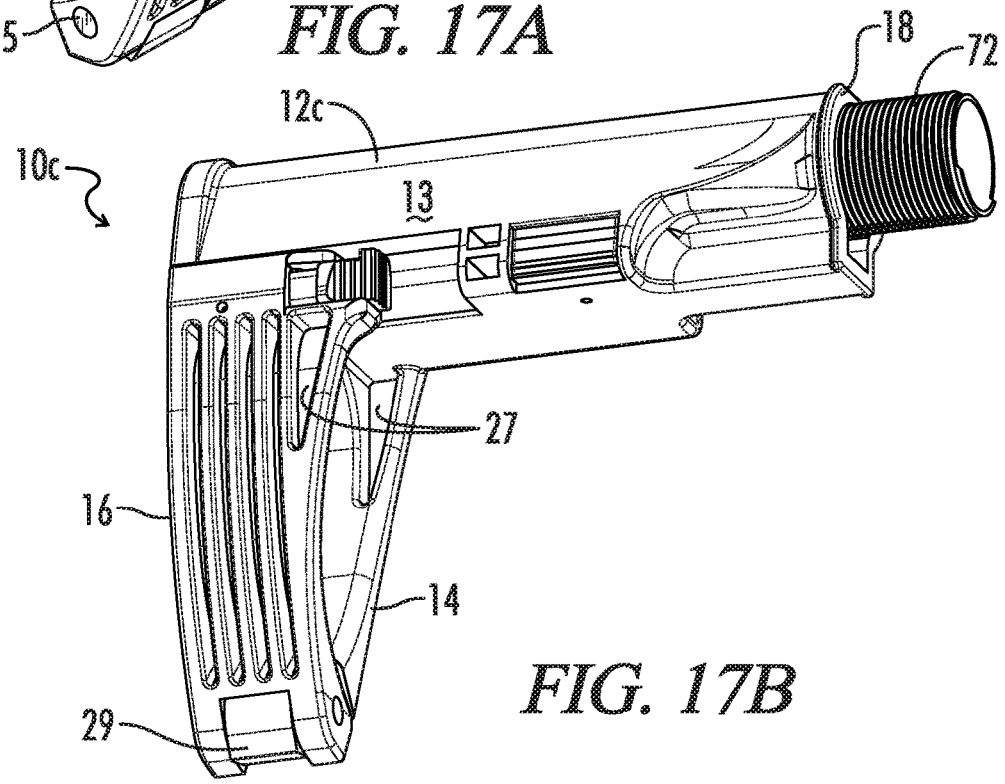
FIG. 17B is another right side perspective view of the brace of FIG. 14.
Figure 18:
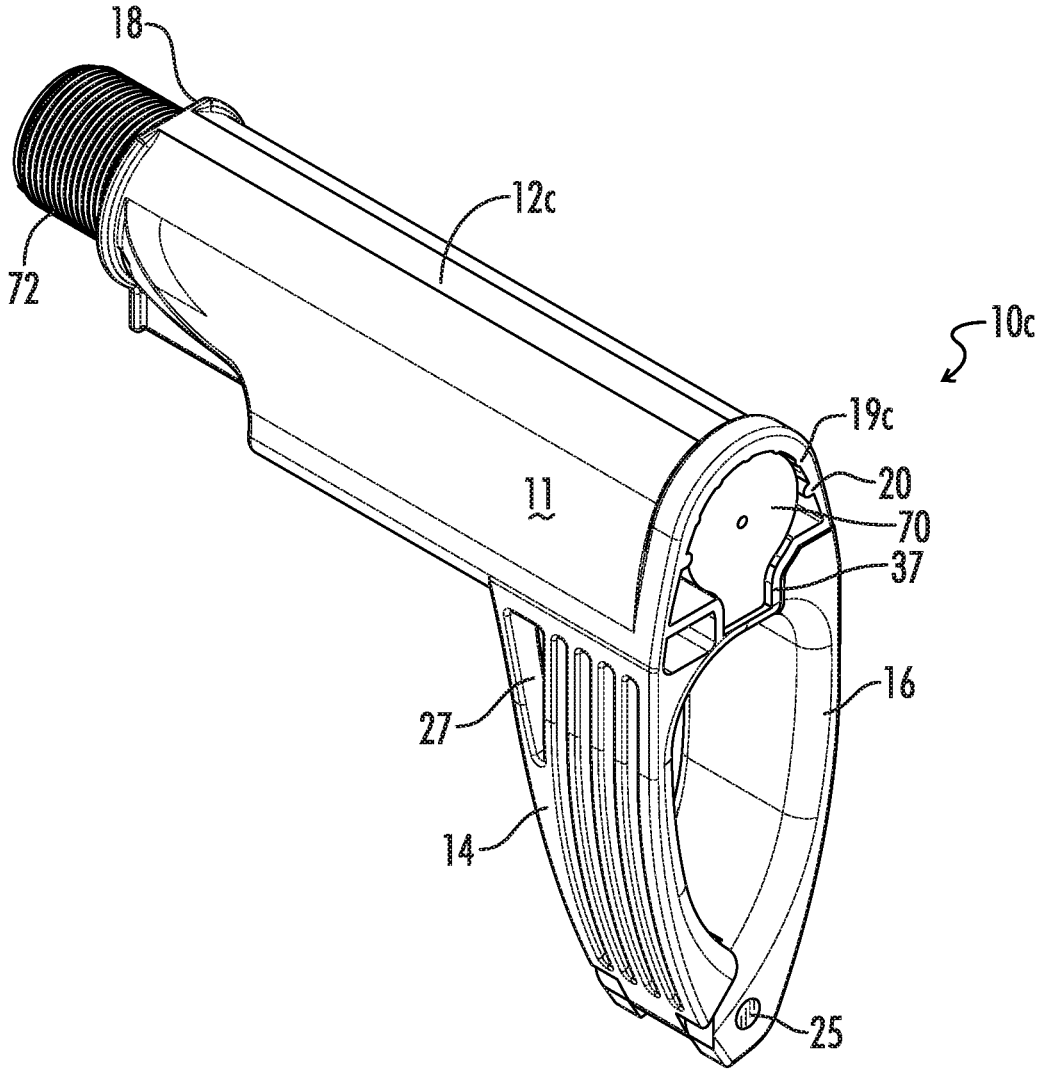
FIG. 18 is a left side perspective view of the brace of FIG. 14.
Figure 19:
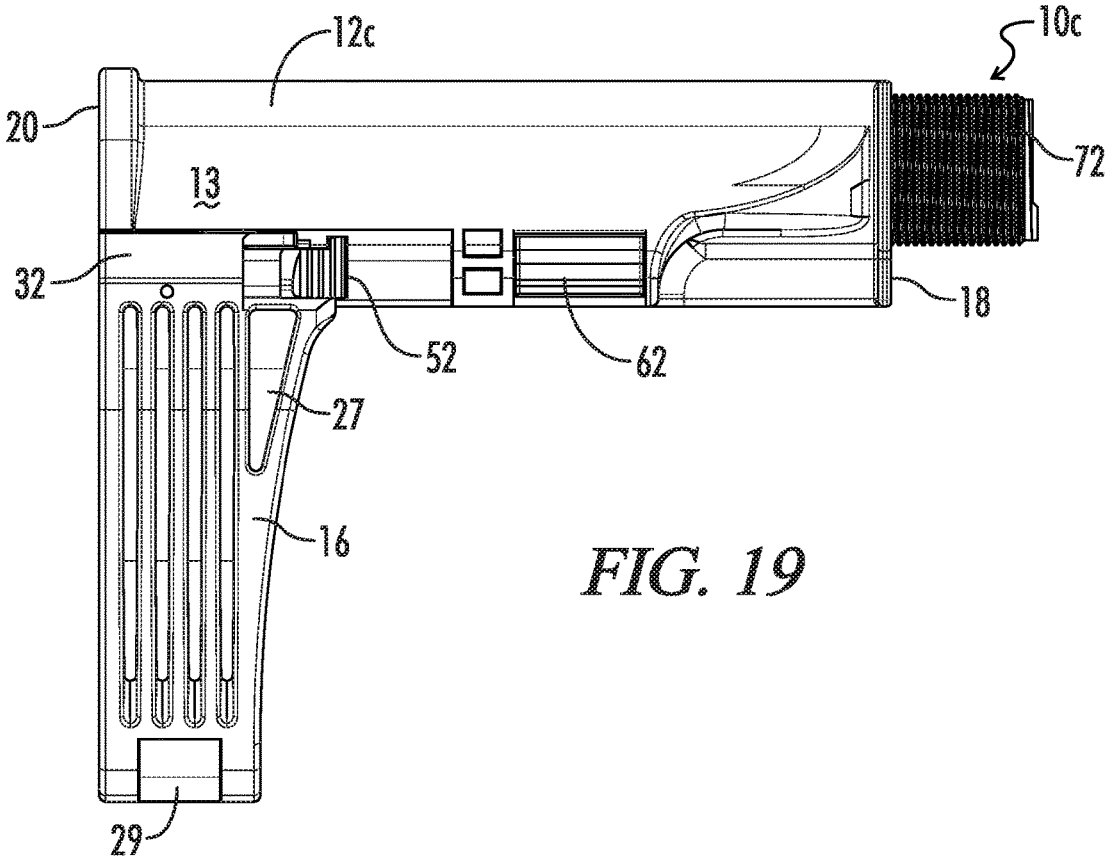
FIG. 19 is a right side elevational view of the brace of FIG. 14.
Figure 20:
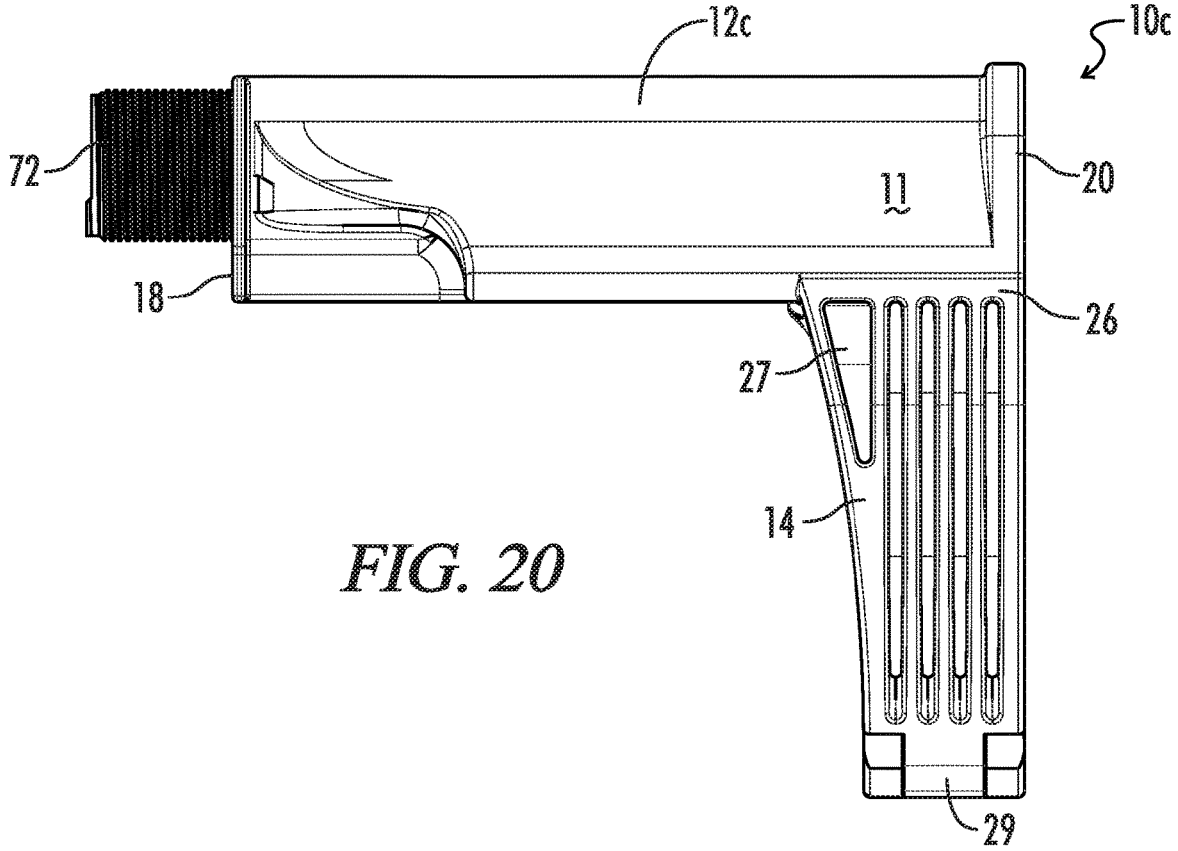
FIG. 20 is a left side elevational view of the brace of FIG. 14.
Figure 21:
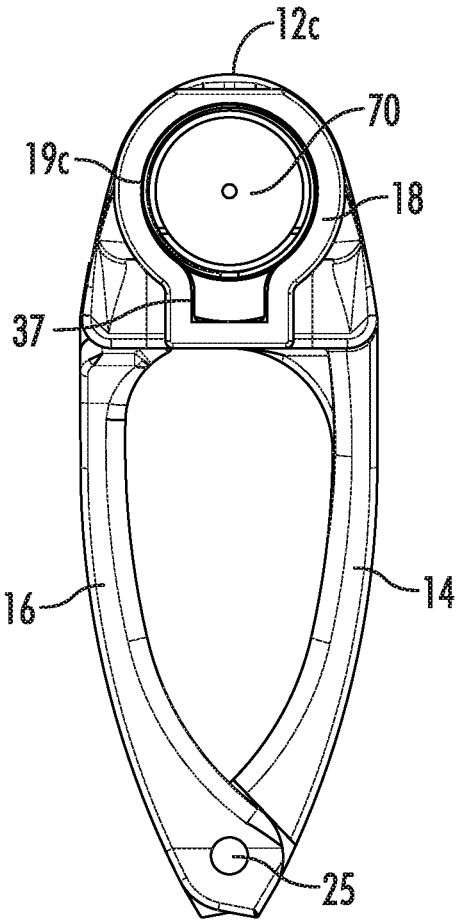
FIG. 21 is a front elevational view of the brace of FIG. 14.
Figure 22:
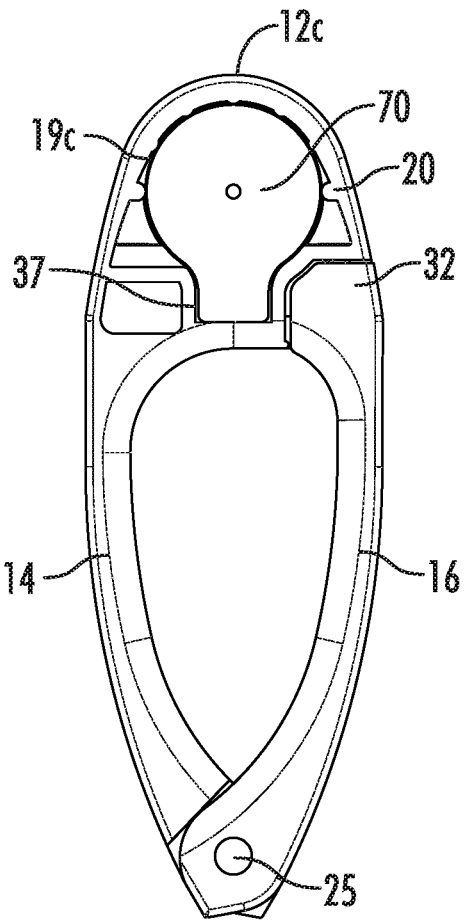
FIG. 22 is a rear elevational view of the brace of FIG. 14.
Figure 23:
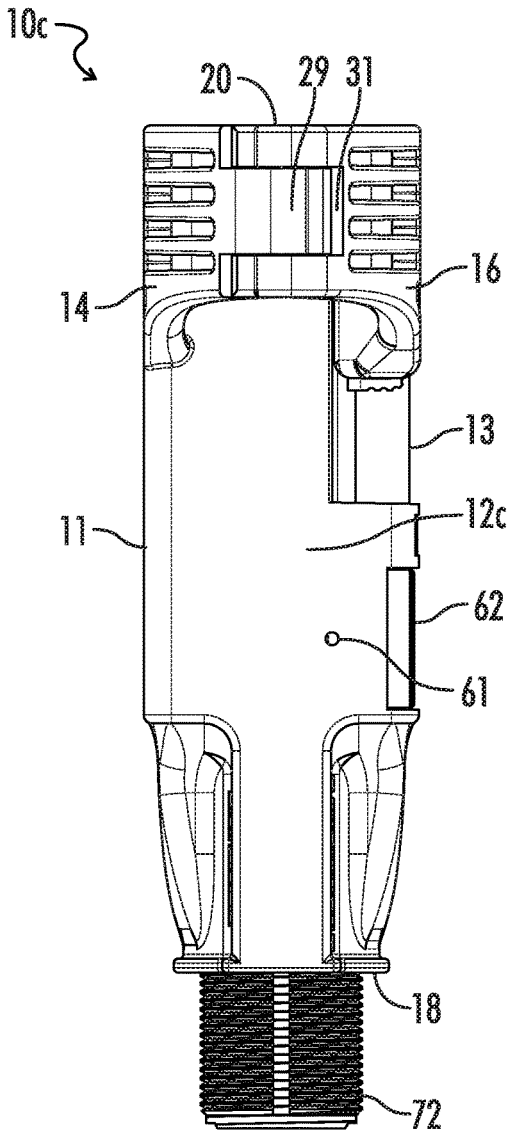
FIG. 23 is a bottom plan view of the brace of FIG. 14.
Figure 24:
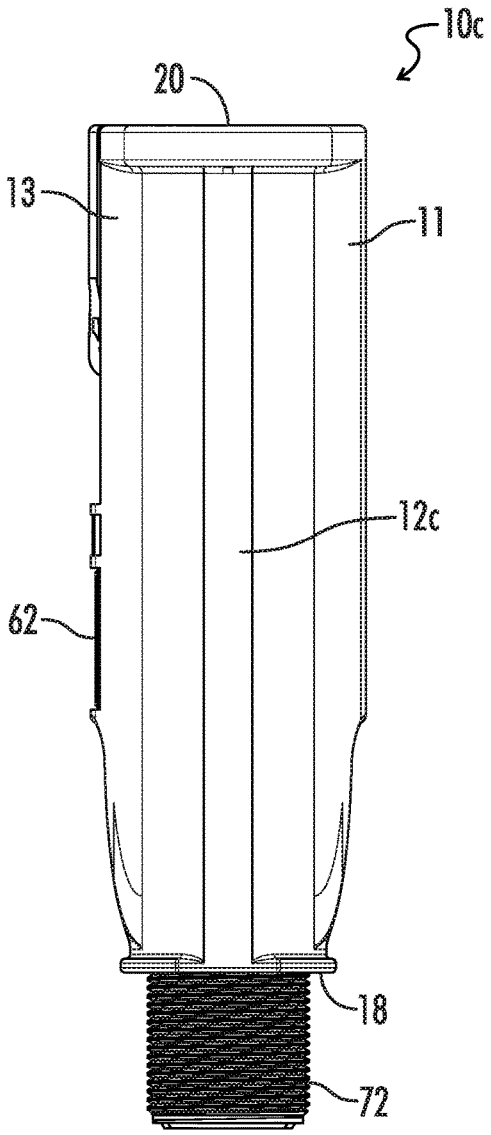
FIG. 24 is a top plan view of the brace of FIG. 14.

Turning now to FIGS. 11 through 13, wherein like reference numerals refer to like elements of previously disclosed embodiments, there is depicted an alternate embodiment of a brace 10*b* constructed in accordance with the present invention. Unlike brace 10, the front end 18 of the body 12 of brace 10*b* includes two laterally opposed recesses 49, each spaced to an opposite side of passage 19. Brace 10*b* further comprises an elongated mounting body 42 having a front end 44, a rear end 46, a main passage 43 extending axially completely through the mounting body between the front end 44 and the rear end 46, two secondary passages 45 that extend axially completely through the mounting body between the front end 44 and the rear end 46, and two support rods 48. The secondary passages 45 are each formed on opposite sides of the main passage 43. Main passage 43 provides for telescopic insertion therein of a handgun support structure such as a receiver extension to secure or mount the mounting body 42 to the handgun as previously disclosed.

Recesses 49 are shaped to receive and engage support rods 48 to secure or mount the body 12 to the support rods 48. Secondary passages 45 in mounting body 42 provide for telescopic insertion therein of support rods 48 to attach body 12 to mounting body 42. Thus, when support rods 48 are received in recesses 49, body 12 can be attached to mounting body 42 by inserting the support rods 94 through secondary passages 45 from the rear end 46 of the mounting body 42. Support rods 18 are frictionally retained in secondary passages 45 and are sized to extend completely though the secondary passages 45 beyond the front end 44 of the mounting body 42. Support rods 48 are axially slidable through secondary passages 45 to permit body 12 to be moved toward or away from the mounting body 42 so a user can adjust the overall length of the brace 10*b*.

Turning now to FIGS. 14 through 41, wherein like reference numerals refer to like elements of previously disclosed embodiments, there is depicted another alternate embodiment of a brace 10*c* constructed in accordance with the present invention. Like brace 10, brace 10*c* comprises a body 12*c*, a first arcuate arm 14 extending from the body 12*c*, and a second arcuate arm 16 pivotally connected to the first arm 14. However, body 12*c* omits clamping member 22 and clamp screws 24 of brace 10. Brace 10*c* also substitutes elongated body 12*c* for body 12 of brace 10. Brace 10*c* additionally substitutes protrusion 50 for recesses 36 on side 13 of brace 10, as well as passage 19*c* for passage 19 of brace 10. Passage 19*c*, unlike passage 19 of brace 10, includes a channel 37 extending longitudinally along the bottom of the passage within body 12*c*. In some embodiments, passage 19*c* can extend longitudinally completely through the body 12*c* between the front end 18 and the rear end 20. In other embodiments, passage 19*c* can be a blind passage extending within the body 12*c* through front end 18 and terminating at a position within the body 12*c* proximate to but forward of rear end 20.

Figure 27:
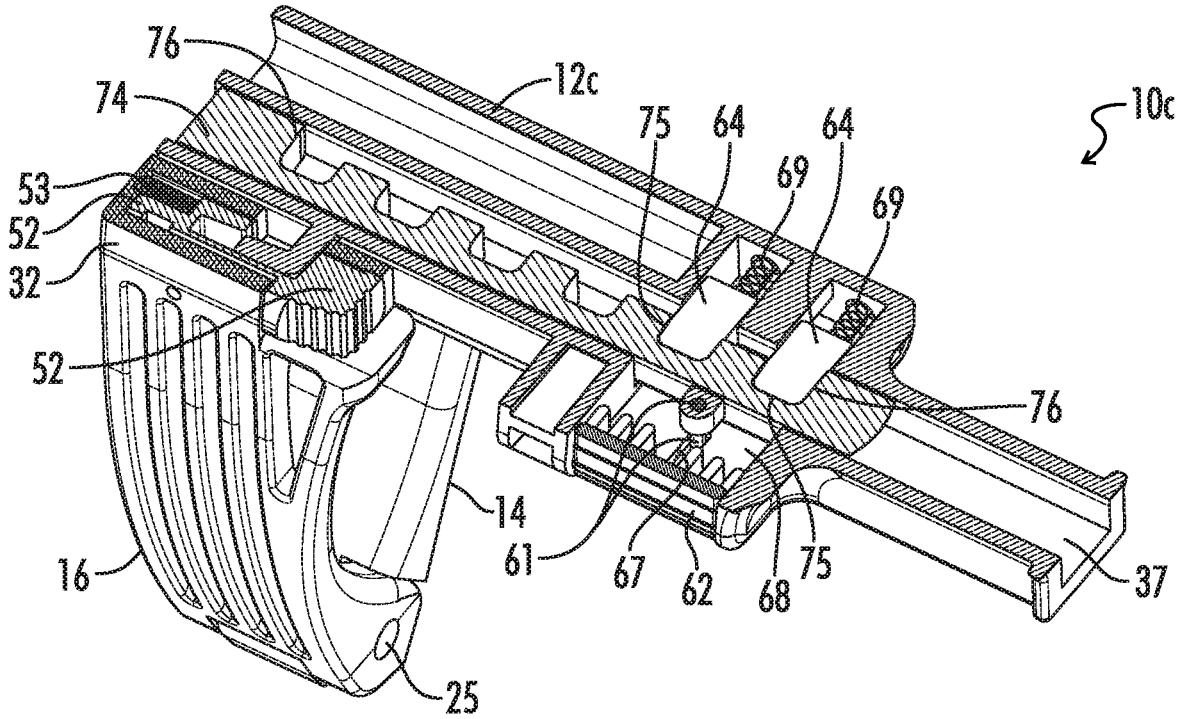
FIG. 27 is a sectional view of the brace of FIG. 14 showing the push button arm release in an unlocked position and the latch in a locked position.
Figure 28:
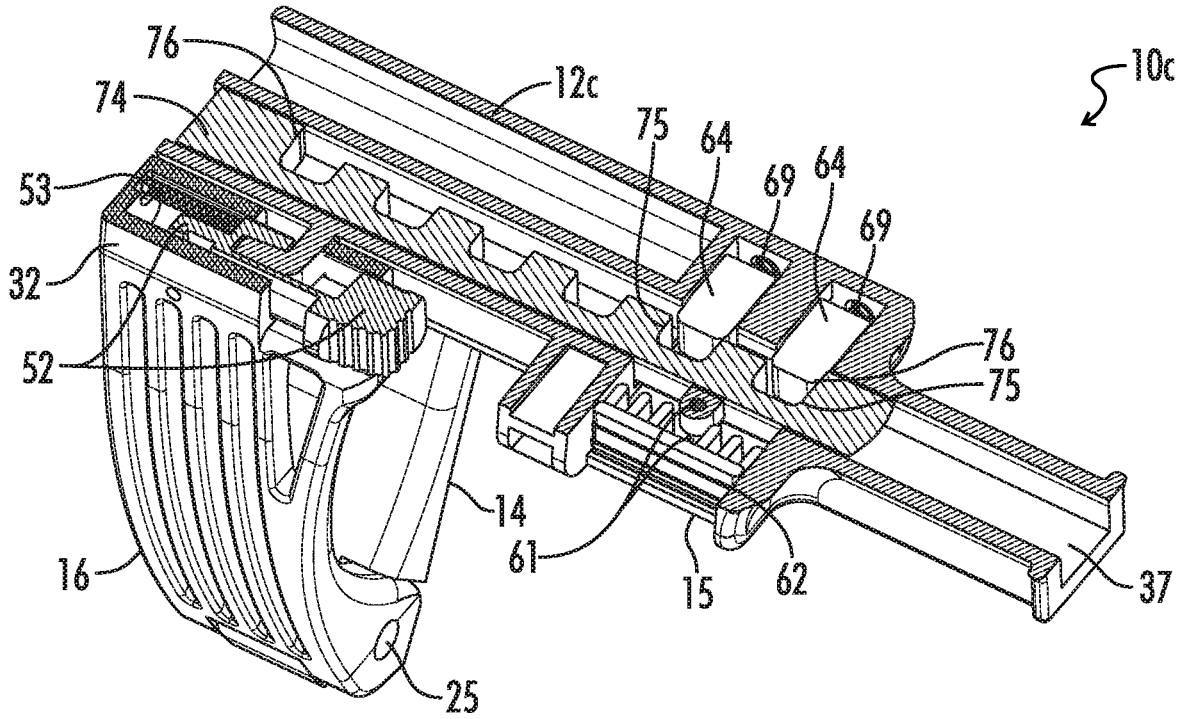
FIG. 28 is a sectional view of the brace of FIG. 14 showing the push button arm release in a locked position and the latch in an adjustment position.

Additionally, the prongs 33 included on the distal end 32 of second arm 16 of brace 10 are omitted from the second arm 16 of brace 10*c*. Instead, the distal end 32 of second arm 16 of brace 10*c* includes an aperture 41 in which protrusion 50 of body 12*c* is receivable, as best shown in FIGS. 27 and 28. The distal end 32 of second arm 16 of brace 10*c* also includes a spring-loaded push button release 52 operable to releasably lock second arm 16 in a stowed position against the side 13 of body 12*c* and thus prevent second arm 16 from being moved into a deployed position when protrusion 50 is received in aperture 41 and spring 53 biases the push button release 52 forward to engage the protrusion 50 as shown in FIG. 28. The second arm 16 can be unlocked and moved into a deployed position upon the application of rearward pressure to the push button release 52 sufficient to compress spring 53 and cause the push button release 52 to disengage the protrusion 50 as shown in FIG. 27.

Figure 25:
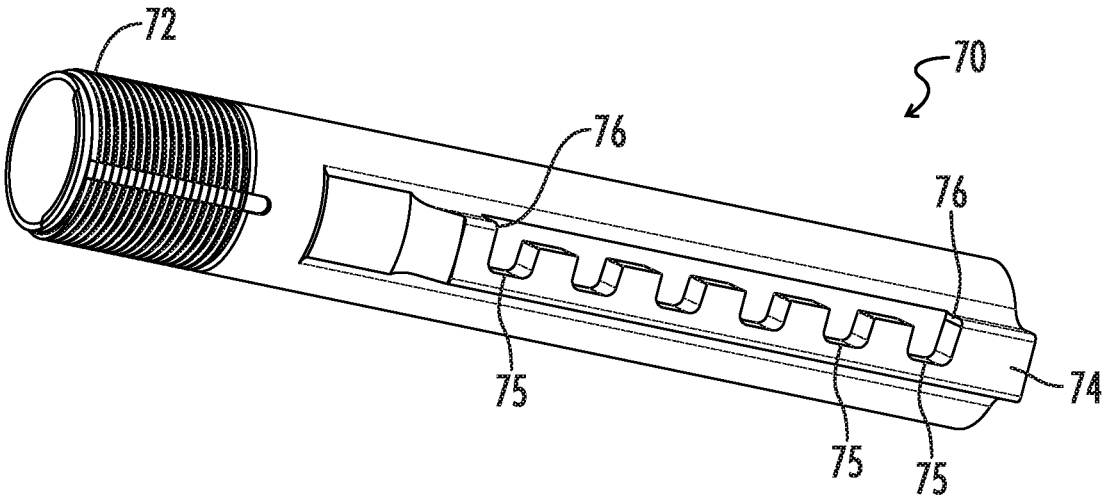
FIG. 25 is a bottom perspective view of an embodiment of a support structure for the brace of FIG. 14.
Figure 26:
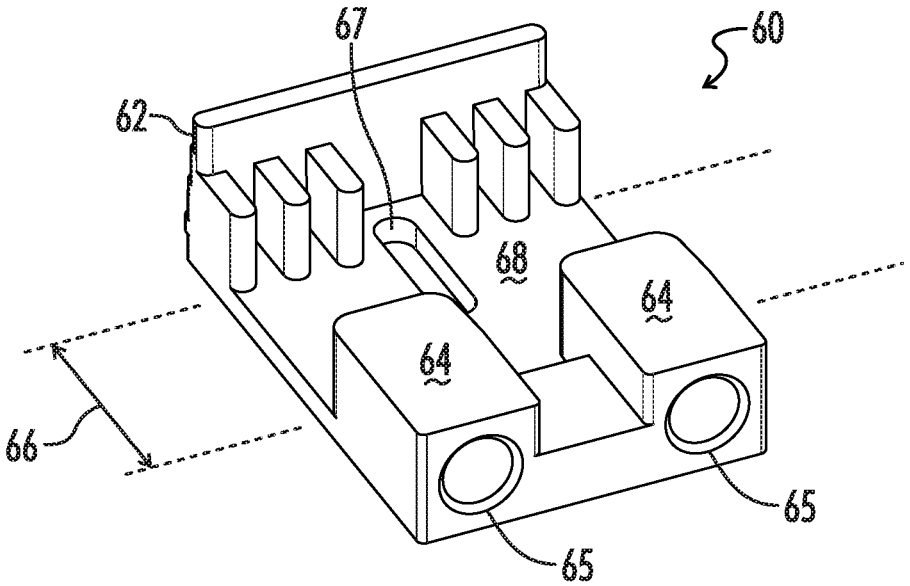
FIG. 26 is a perspective view of an embodiment of a latch for the brace of FIG. 14.

Handgun brace 10*c* also comprises a novel support structure 70 designed to permit a user to telescopically mount body 12*c* of brace 10*c* to a handgun 90. As shown in FIG. 25, support structure 70 includes a generally cylindrical body having a rear end 71 opposite a threaded forward end 72 opposite, and a downwardly projecting rib 74 extending along a portion of the length of the body between the rear end and the forward end 72. Support structure 70 can be attached to any handgun 90 including a native receiver extension 94 in the same way that receiver extension 94 is mountable to handgun 90, namely, by screwing the threaded forward end 72 of support structure 70 into a threaded aperture located in the rear end of the handgun. Body 12*c* is mountable on support structure 70 in the same way that body 10 is mountable on receiver extension 94, namely, by inserting support structure 70 through passage 19*c* from the front end 20 of body 12*c*.

Rib 74 of support structure 70 includes a row of blind cross notches 75 formed in a side of the rib 74. The intervening portions of the rib 74 between each adjacent cross notch 75 are laterally inset from the exterior surface of the side of the rib 74 to form a lip or lug stop 76 at the forward and rearward end of the row of cross notches 75. Cross notches 75 are shaped and dimensioned to preclude insertion of the round locking pin included on currently available telescoping buttstocks for AR-style rifles which attach to such rifles via a receiver extension 94. In this way, the brace 10*c* prevents a user from using support structure 70 to improperly mount a rifle buttstock to the handgun 90, which is prohibited.

Figure 29:
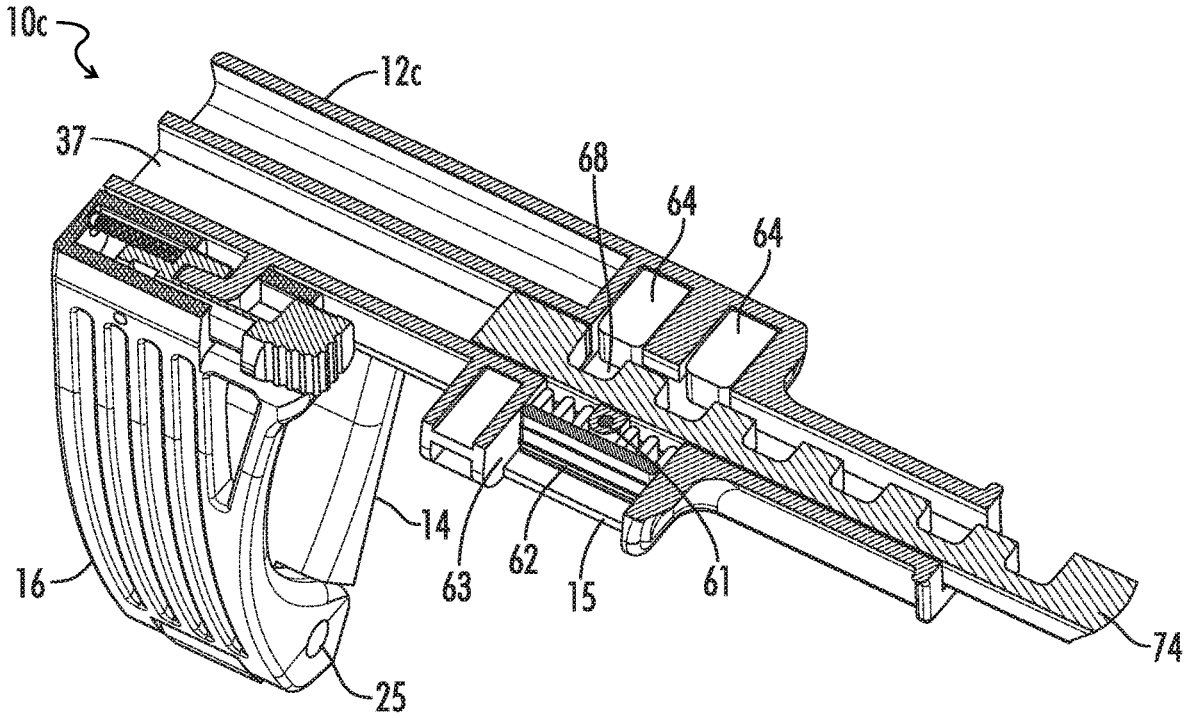
FIG. 29 is a sectional view of the brace of FIG. 14 showing the push button arm release in a locked position and the latch in a removal position.
Figure 30:
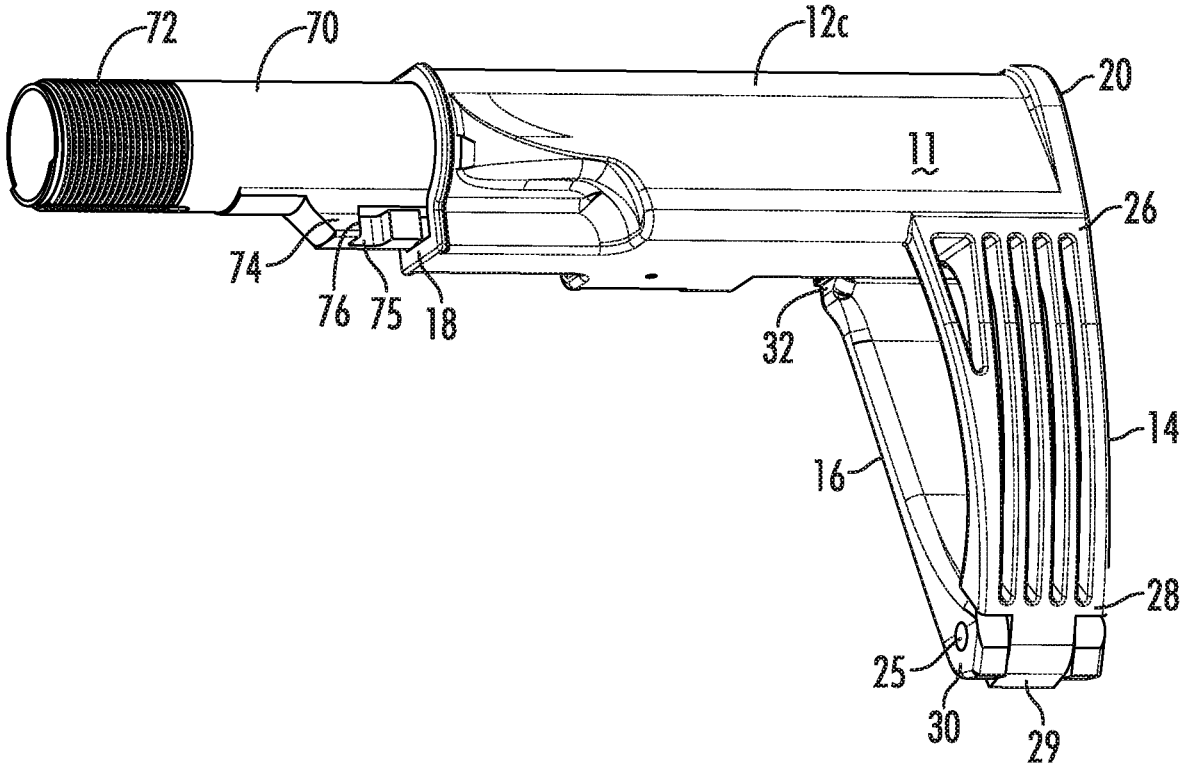
FIG. 30 is another left side perspective view of the brace of FIG. 14.
Figure 31:
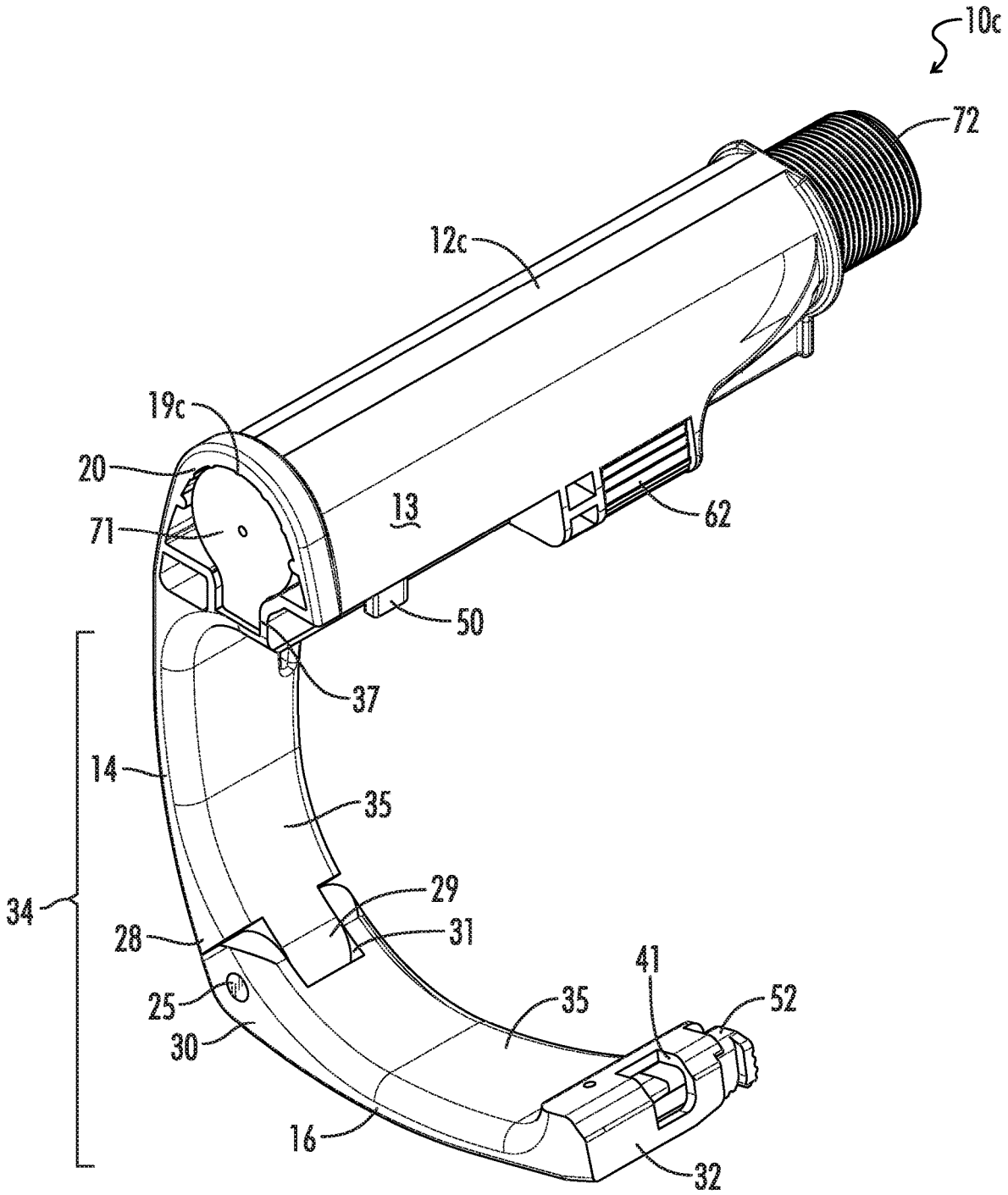
FIG. 31 is a rear right side perspective view of the brace of FIG. 15.
Figure 32:
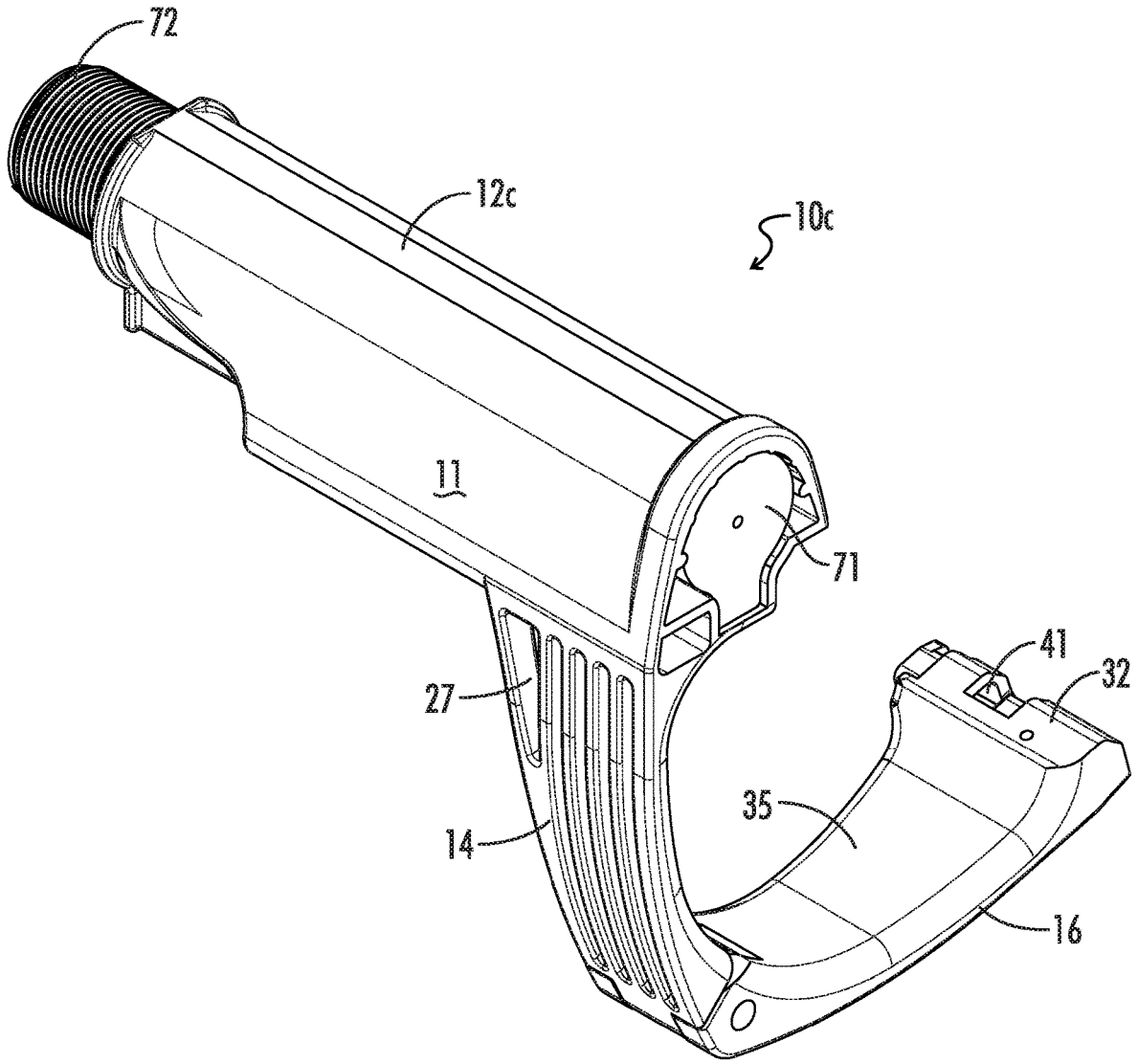
FIG. 32 is a rear left side perspective view of the brace of FIG. 15.
Figure 33:
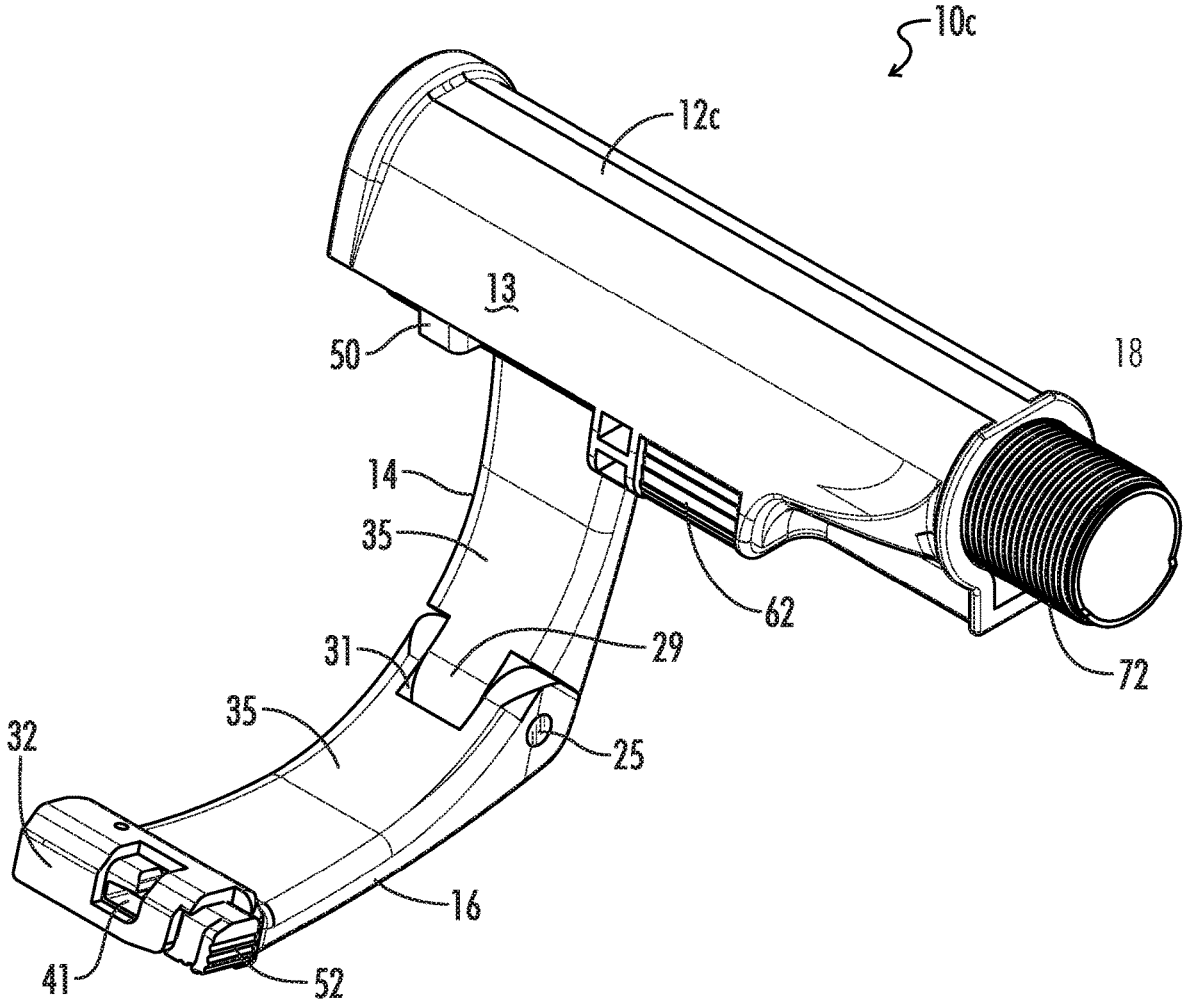
FIG. 33 is a front right side perspective view of the brace of FIG. 15.
Figure 34:
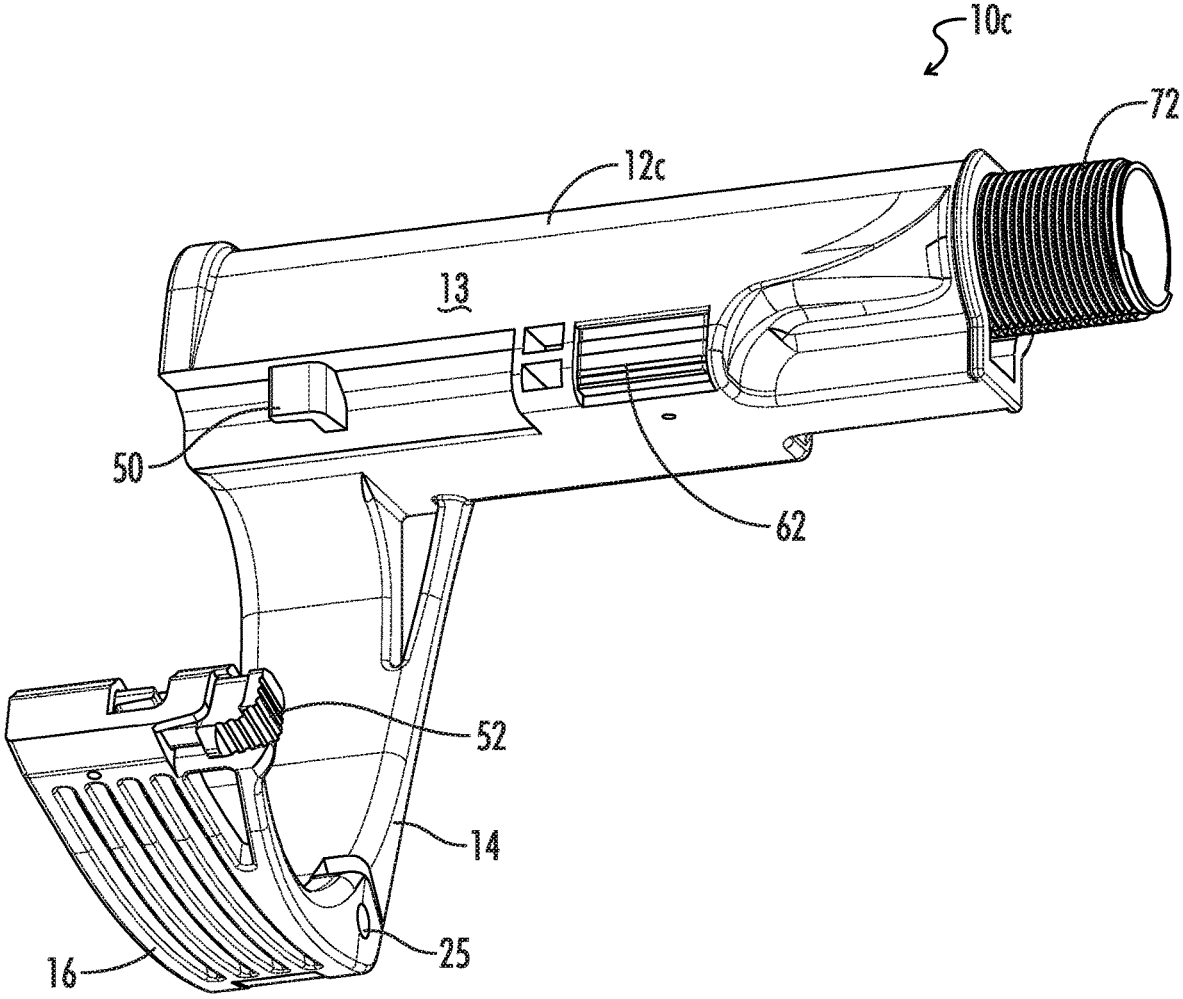
FIG. 34 is a bottom right side perspective view of the brace of FIG. 15.
Figure 35:
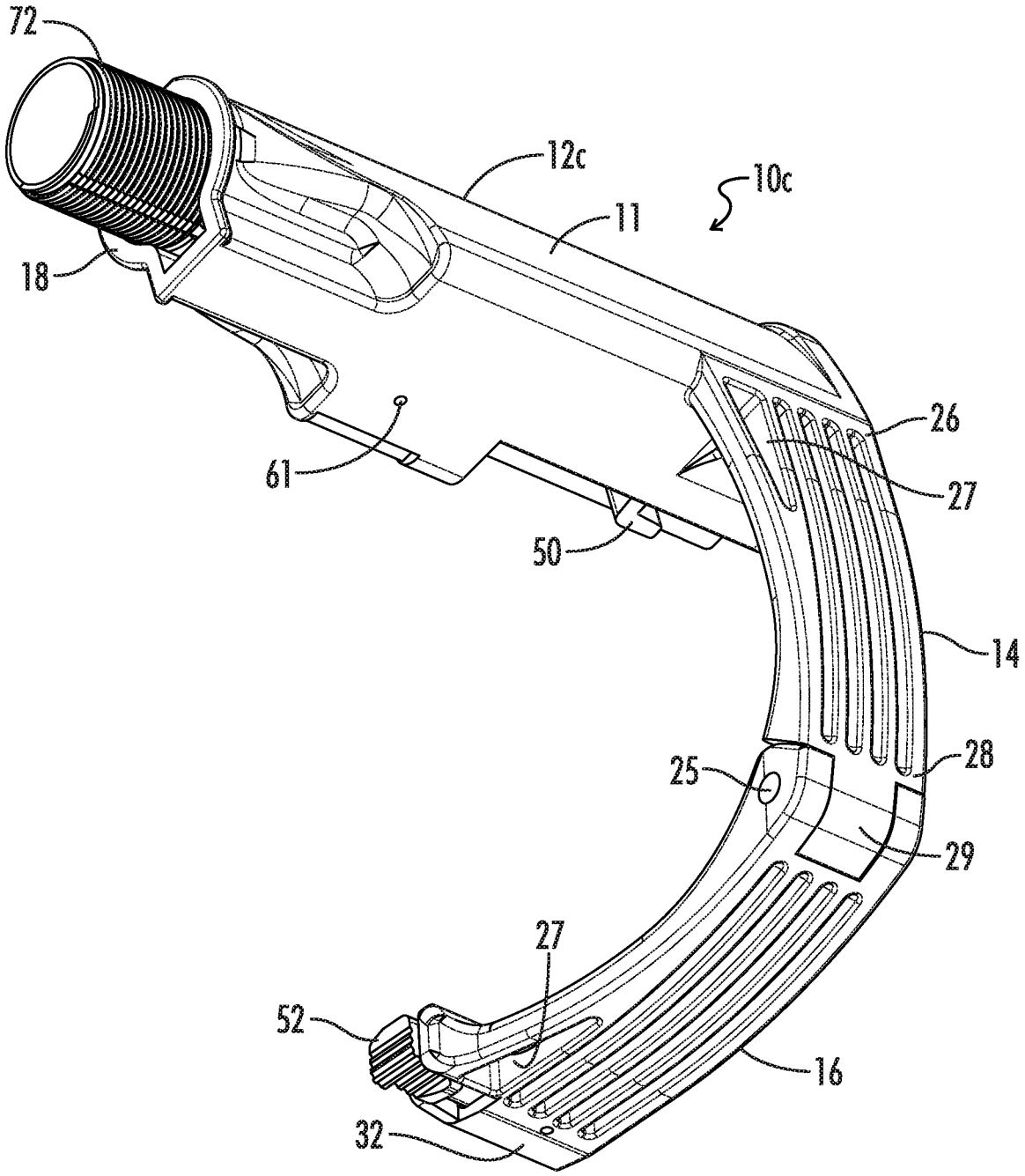
FIG. 35 is a bottom left side perspective view of the brace of FIG. 15.
Figure 36:
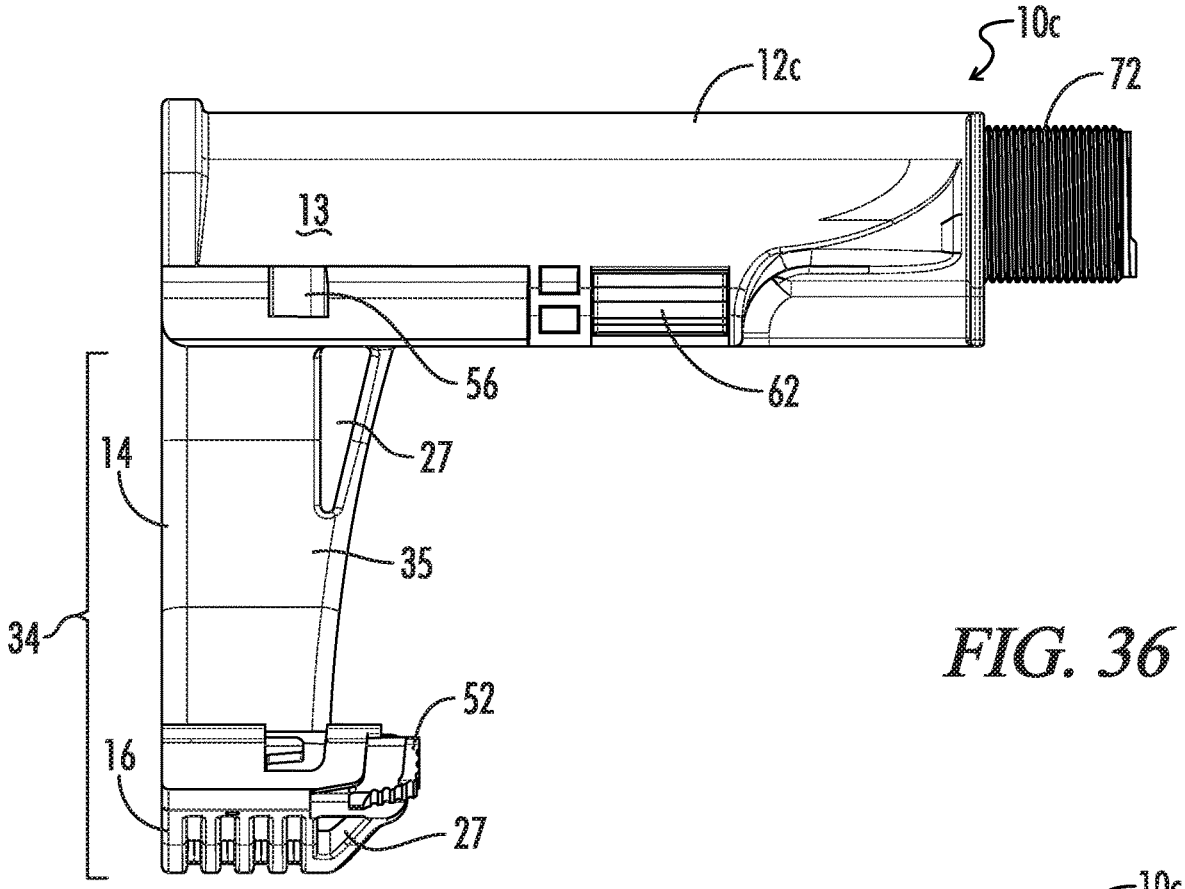
FIG. 36 is a right side elevational view of the brace of FIG. 15.
Figure 37:
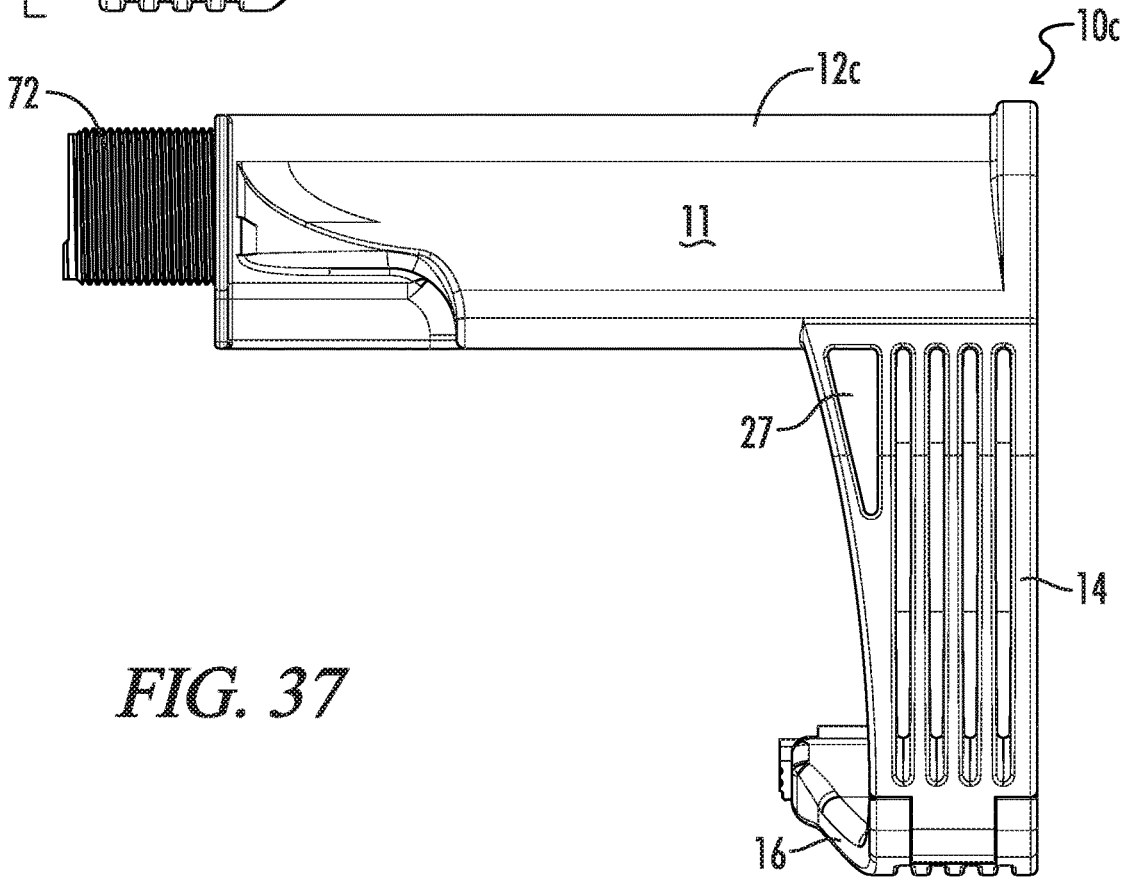
FIG. 37 is a left side elevational view of the brace of FIG. 15.
Figure 38:
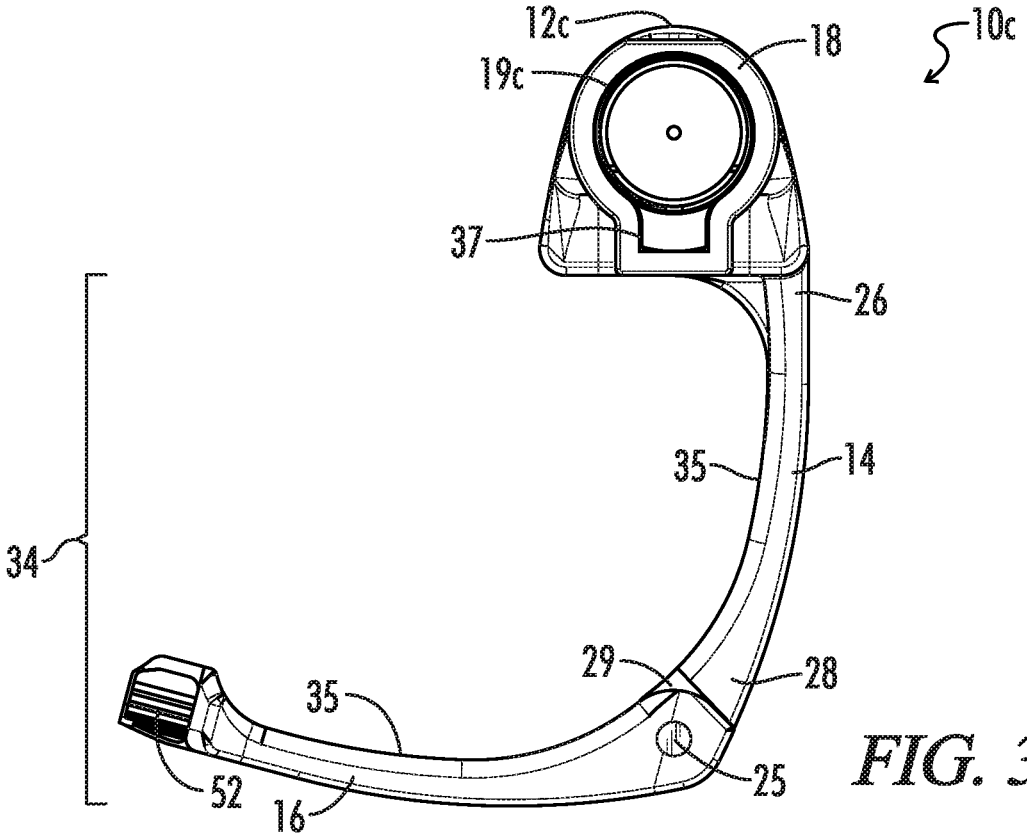
FIG. 38 is a front elevational view of the brace of FIG. 15.
Figure 39:
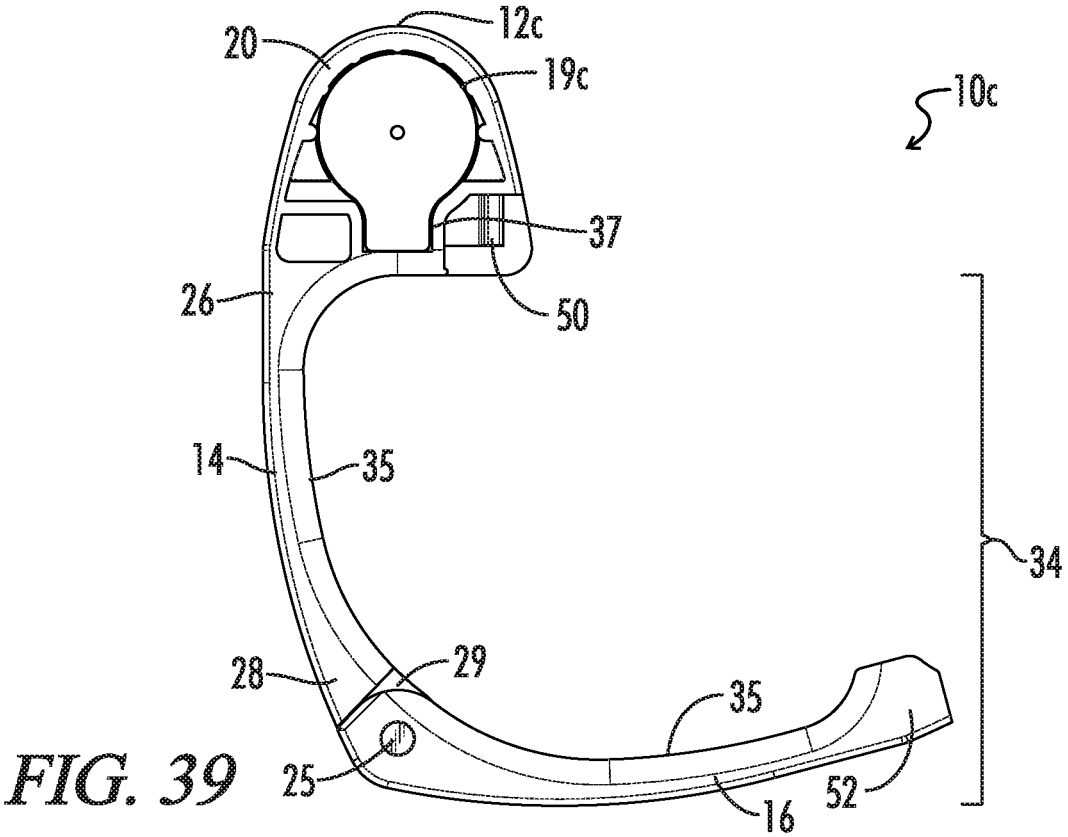
FIG. 39 is a rear elevational view of the brace of FIG. 15.
Figure 40:
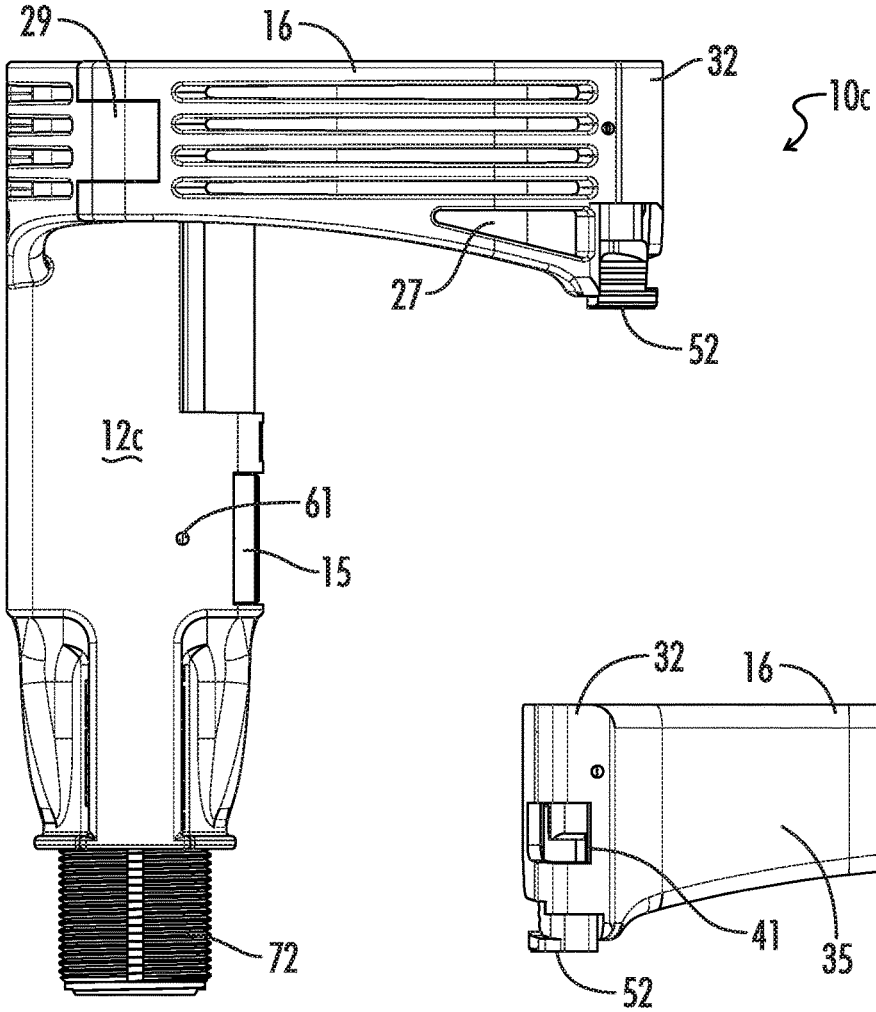
FIG. 40 is a bottom plan view of the brace of FIG. 15.
Figure 41:
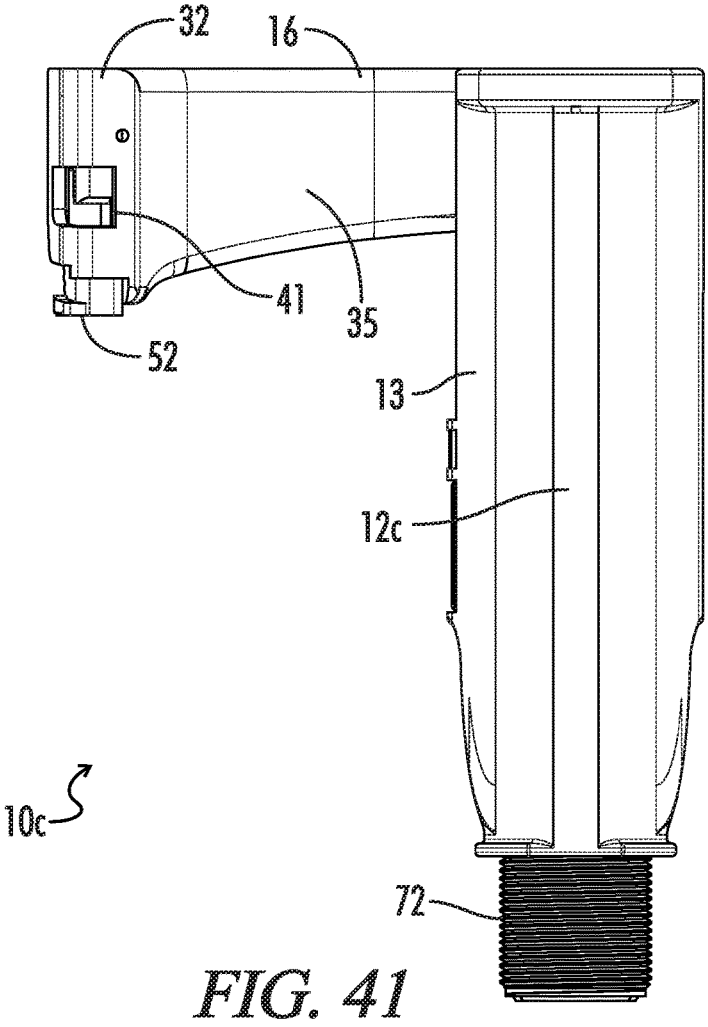
FIG. 41 is a top plan view of the brace of FIG. 15.

Brace 10*c* also comprises a three-stage latch assembly selectively moveable between a locked position, an adjustment position, and a removal position. The latch assembly includes a latch 60 which is received in compartment 63 extending laterally through side 13 of body 12*c* at a location forward of first and second arms 14, 16, a retaining pin 61, and a two detent springs 69. Latch 60 has a thin rectangular base 68, a button face 62 extending upwardly from one end of the base 68, two lugs 64 extending upwardly from the other end of the base 68 opposite the button face 62, and a space 66 between button face 62 and lugs 64. Each lug 64 includes a bore 65 sized to receive a detent spring 69 therein such that when the latch assembly is assembled into body 12*c* as shown in FIGS. 27 through 29, detent springs 69 received in bore 65 contact an interior wall of body 12*c* and bias latch 60 laterally toward side 13. To prevent detent springs 69 from ejecting latch 60 out of body 12*c*, base 68 of the latch 60 includes a retaining pin slot 67 in which retaining pin 61 is received to retain latch 60 inside body 12*c*. Lugs 64 are shaped and sized to be received in and engage the cross notches 75 on rib 74 so as to selectively lock body 12*c* in one of a plurality of preselected positions along the length of rib 74 when support structure 70 is received in passage 19*c*. Space 66 has a width equal to or greater than the width of rib 74 so as to permit rib 74 to slide forward and rearward through the space when the lugs 64 are not engaged with cross notches 75.

As shown in FIG. 27, the latch 60 is in a locked or rest position when the support structure 70 is received in passage 19*c* of body 12*c* and lugs 64 are received in a pair of cross notches 75 in the rib 74. The latch 60 is maintained in a locked position by detent springs 69, which bias lugs 64 laterally to engage cross notches 75 of rib 74 and thus releasably lock body 12*c* in a one of a plurality of preselected positions on support structure 70 so that body 12*c* cannot be removed from support structure 70. When the latch 60 is in the locked position, the button face 62 is flush with the exterior surface of the side 13 of body 12*c* and is ergonomically accessible by a user's thumb.

A user can move the latch 60 into the adjustment position to change the overall length of brace 10*c* by laterally depressing button 62 until the button is flush with recessed ledge or stop 15 defined in the lower portion of side 13 of body 12*c*, as shown in FIG. 28. This disengages lugs 64 from cross notches 75 and frees rib 74 to slide axially through space 66 between button face 62 and lugs 64, enabling the user to move the body 12*c* longitudinally forward or rearward along the support structure 70 to selectively position the body 12*c* at one of a plurality of locations corresponding to a pair of cross notches 75 that suits the user's preference. However, lugs 64 still extend laterally into channel 37 of passage 12*c* far enough that lug stops 76 located at either end of the row of cross notches 75 on rib 74 prevent the body 12*c* from being accidentally removed from support structure 70 while the latch 60 is an adjustment position.

A user can move the latch 60 into the removal position to completely remove the body 12*c* from support structure 70 and disassemble brace 10*c* for storage by laterally depressing button face 62 beyond recessed stop 15, as shown in FIG. 29. When latch 60 is in the removal position, lugs 64 are completely withdrawn from channel 37 and received in internal compartments 79 such that the lugs 64 do not engage cross notches 75 or contact lug stops 76 when the body 12*c* is moved forward or rearward on support structure 70. A user can remove body 12*c* from support structure 70 by sliding body 12*c* rearward off support structure 70 until support structure 70 is withdrawn from passage 19*c*. Body 12*c* can only be removed from support structure 70 while latch 60 in the removal position. The shape, size and lateral movement of button 62 make latch 60 readily accessible and easily operable with a deliberate press with a user's thumb, finger, or prosthesis, while simultaneously reducing the risk of accidental button 62 activation caused by casual interactions with a user's body or the environment. By requiring a deliberation activation, recessed stop 15 prevents unintentional release of body 12*c* from the support structure 70.

Figure 42:
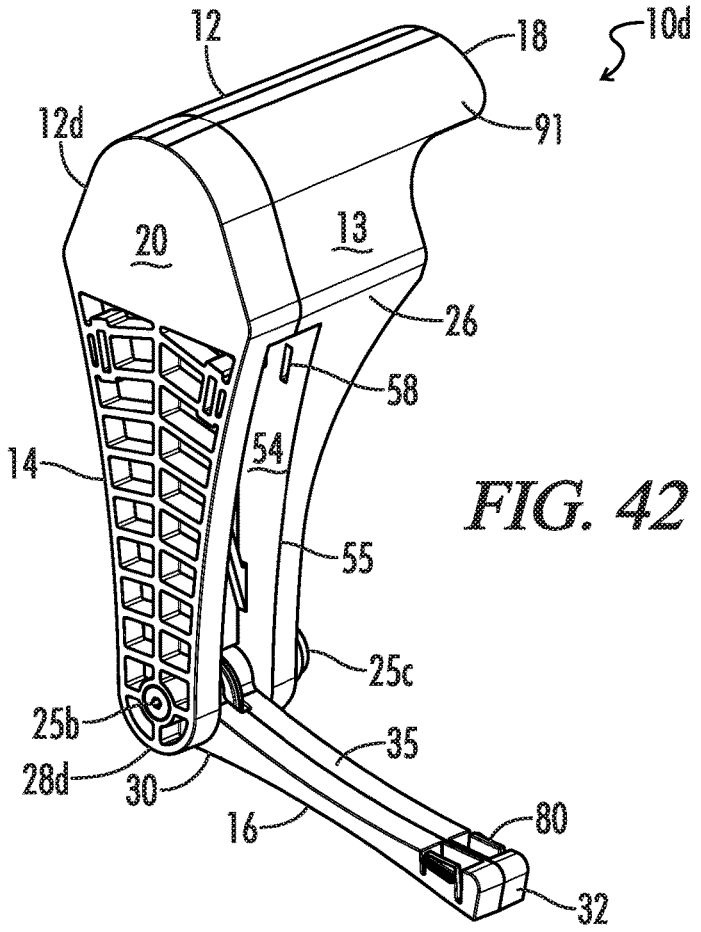
FIG. 42 is an elevated rear right side perspective view of a brace for stabilizing a handheld device constructed in accordance with another alternate embodiment of the present invention showing the brace in a deployed configuration for a right-handed user.
Figure 53:
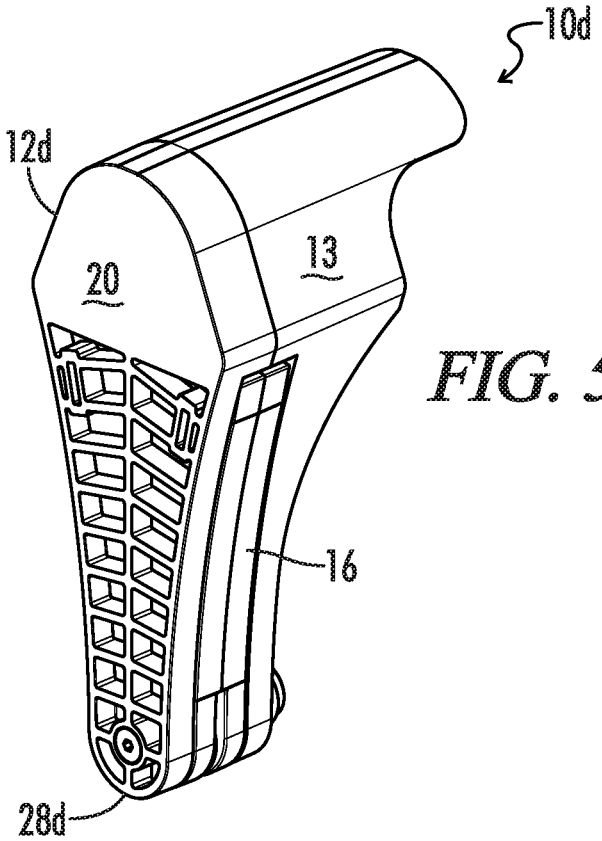
FIG. 53 is an elevated rear right side perspective view of the brace of FIG. 42 showing the brace in a stowed configuration.
Figure 54:
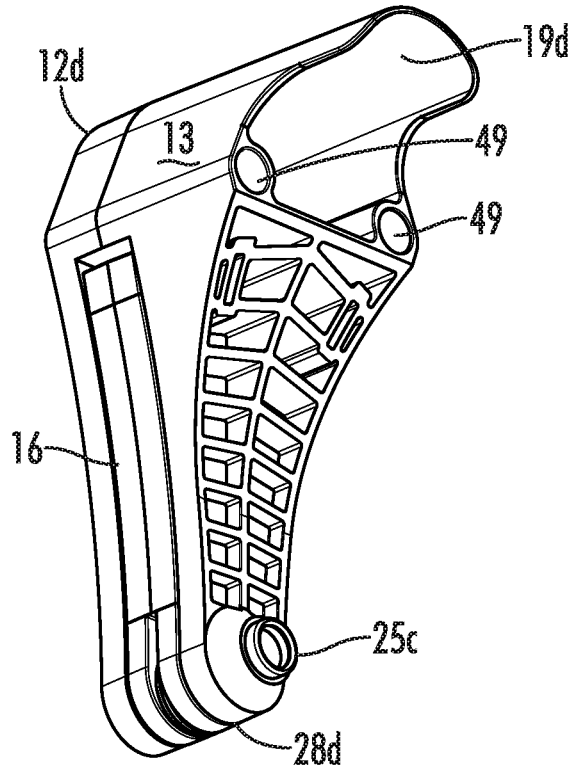
FIG. 54 is a depressed front right side perspective view of the brace of FIG. 53.
Figure 55:
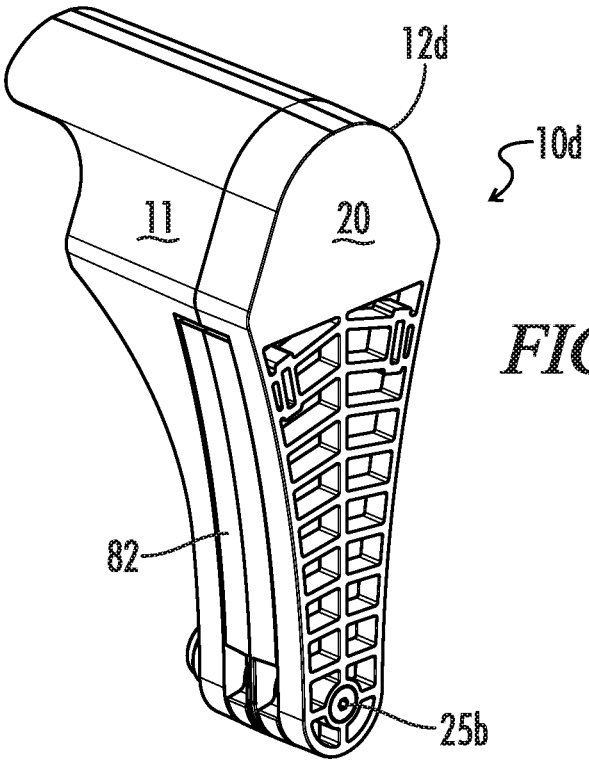
FIG. 55 is an elevated rear left side perspective view of the brace of FIG. 53.
Figure 56:
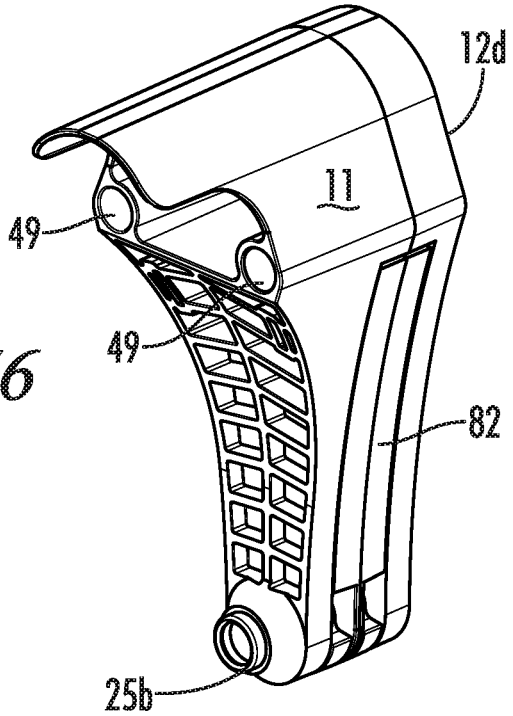
FIG. 56 is an elevated front left side perspective view of the brace of FIG. 53.
Figure 57:
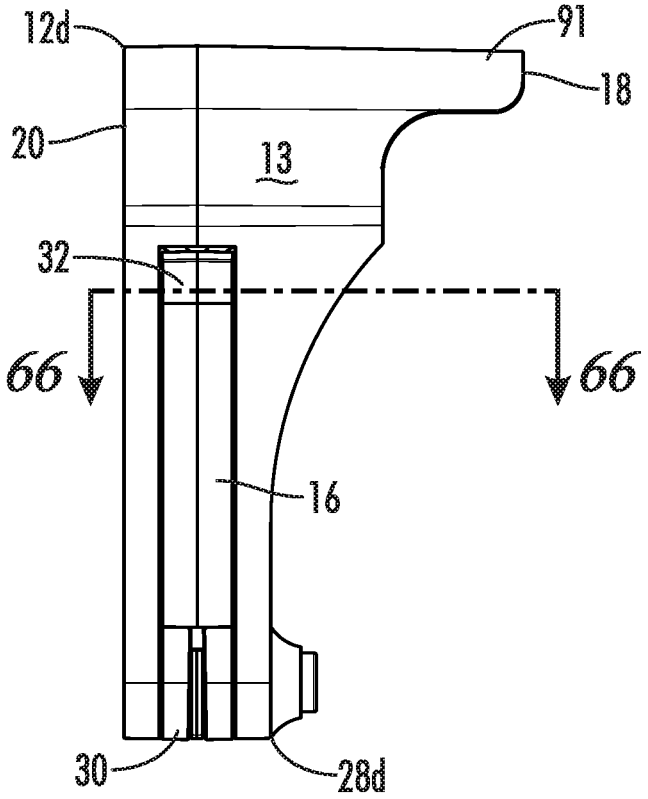
FIG. 57 is a right side elevational view of the brace of FIG. 53.
Figure 58:
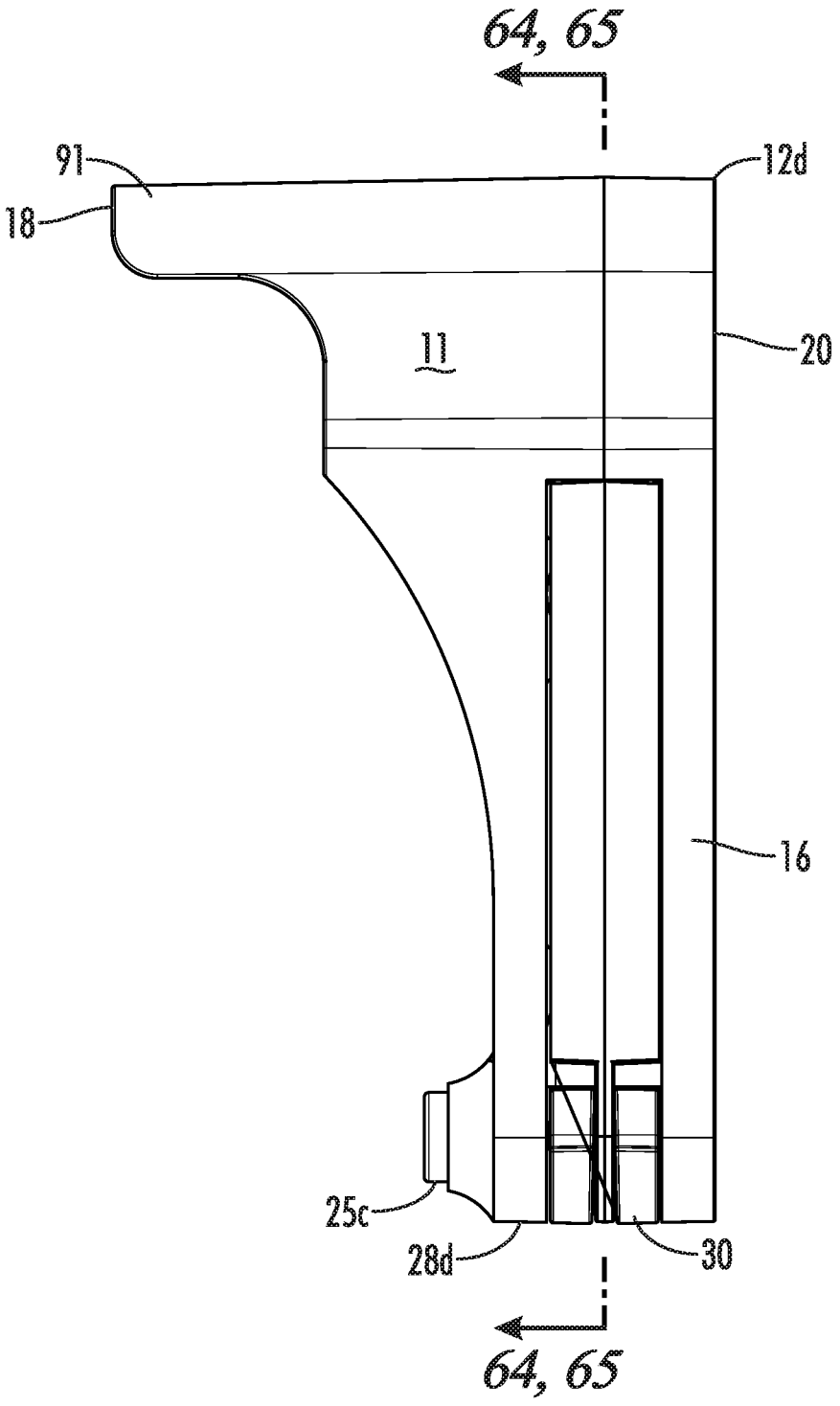
FIG. 58 is a left side elevational view of the brace of FIG. 53.
Figure 59:
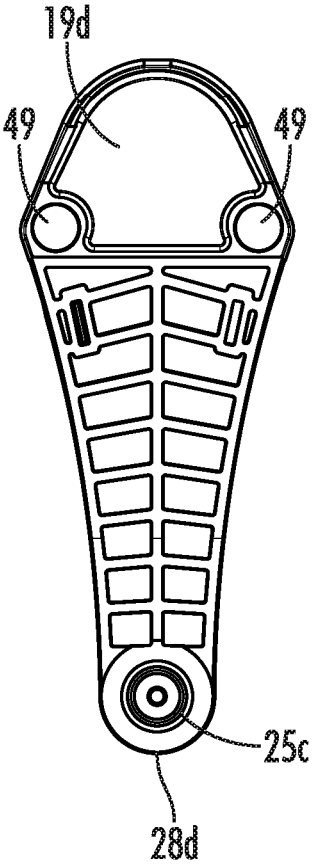
FIG. 59 is a front elevational view of the brace of FIG. 53.
Figure 60:
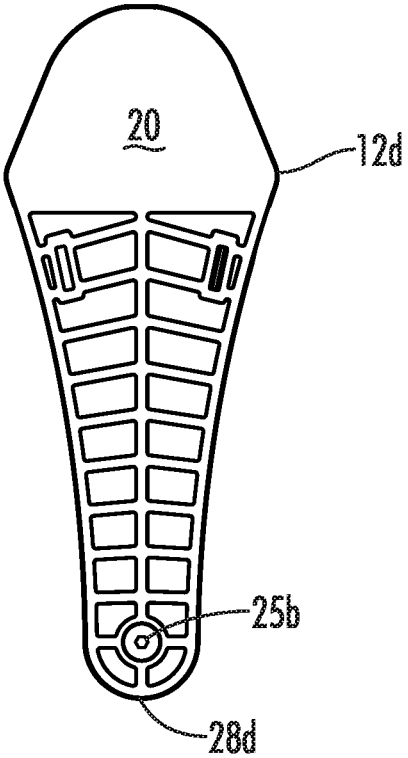
FIG. 60 is a rear elevational view of the brace of FIG. 53.
Figure 61:
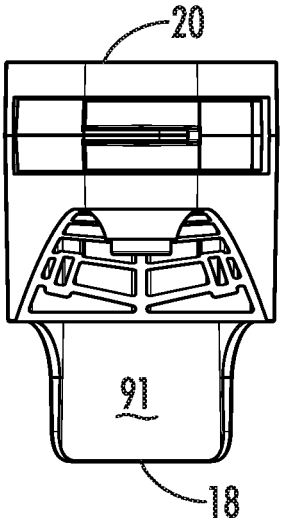
FIG. 61 is a bottom plan view of the brace of FIG. 53.
Figure 62:
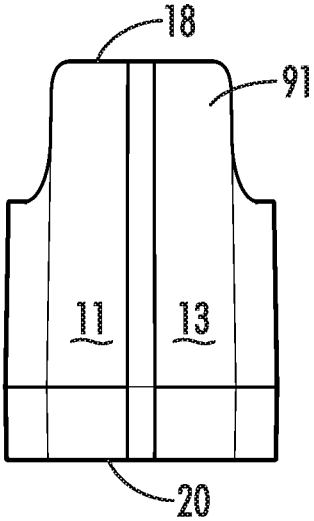
FIG. 62 is a top plan view of the brace of FIG. 53.
Figure 63:
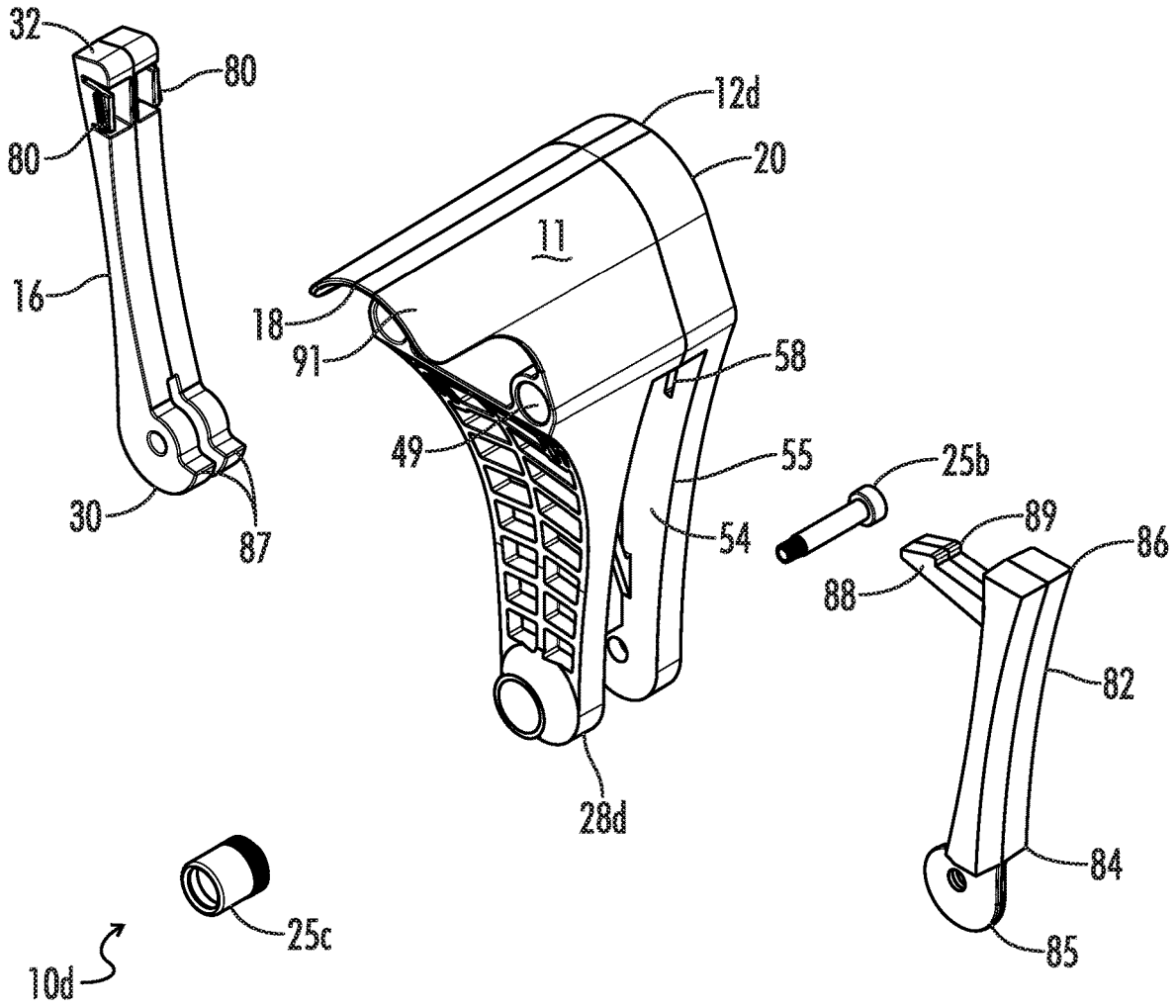
FIG. 63 is an exploded perspective view of the brace of FIG. 56.

Turning now to FIGS. 42 through 67, wherein like reference numerals refer to like elements of previously disclosed embodiments, there is depicted another embodiment of a brace 10*d* constructed in accordance with the present invention. Brace 10*d* comprises vertically elongated body 12*d* and an arm 16 pivotally connected to a lower portion of the elongated body 12*d*. The arm 16 is selectably movable between a stowed position wherein the arm 16 is aligned with and received inside the body 12*d* as shown in FIG. 53, and a deployed position as shown in FIG. 42 wherein the arm 16 provides a surface 35 against which a user's forearm 92 is removably receivable to stabilize a handheld device such as a firearm 90 when the elongated body 12*d* is engaged with the device.

Elongated body 12*d* includes an upper body portion 12, a lower fixed arm portion 14, a front end 18 having a shroud 91 extending therefrom, a rear end 20, a left side 11, a right side 13, and a distal end 28*d*. A blind passage 19*d* and a pair of recesses 49 are formed in the front end 18 of elongated body 12*d*. As in previously discussed embodiments, a receiver extension 94 or similar support structure is removably receivable in the passage 19*d* to releasably attached the elongated body 12*d* to a handgun 90 or other handheld device. Support rods 48 are likewise removably receivable in one or more of the recesses 49 to releasably attach the elongated body 12*d* to a handgun or other handheld device. The presence of both the passage 19*d* and recesses 49 in the front 18 of elongated body 12*d* advantageously increases the connectivity and versatility of the brace 10*d*.

Figure 43:
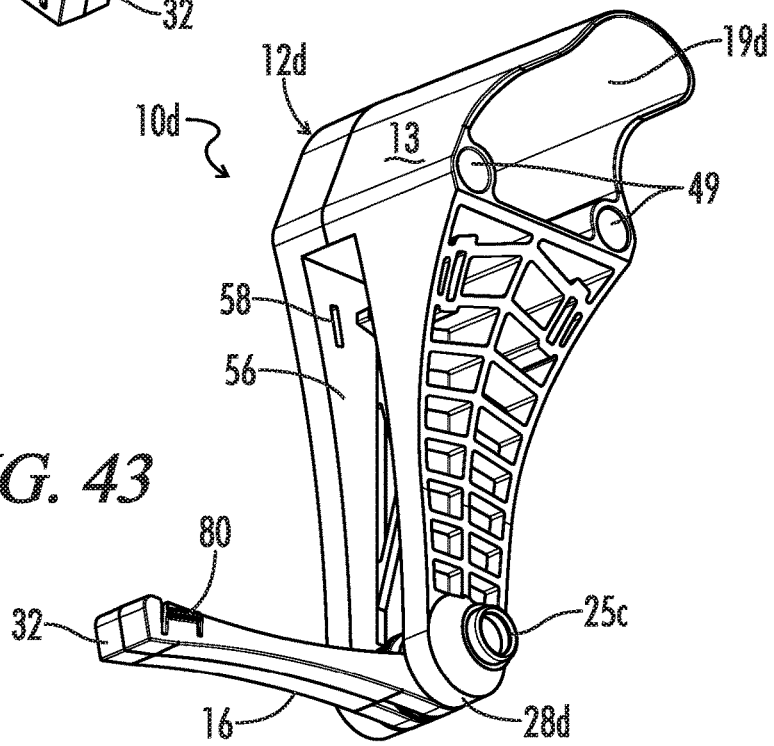
FIG. 43 is a depressed front right side perspective view of the brace of FIG. 42.
Figure 44:
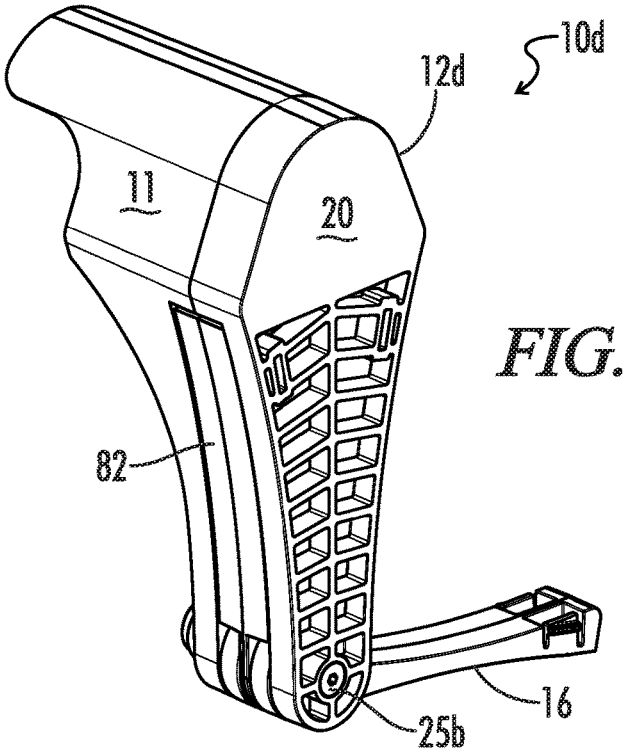
FIG. 44 is an elevated rear left side perspective view of the brace of FIG. 42.
Figure 45:
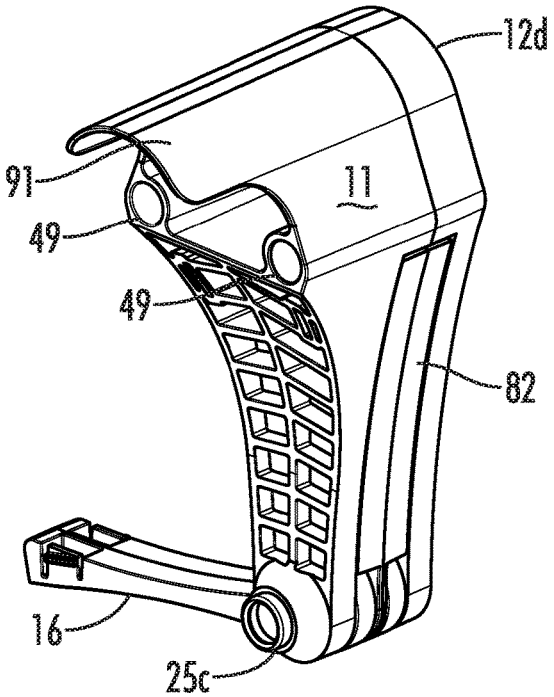
FIG. 45 is an elevated front left side perspective view of the brace of FIG. 42.
Figure 46:
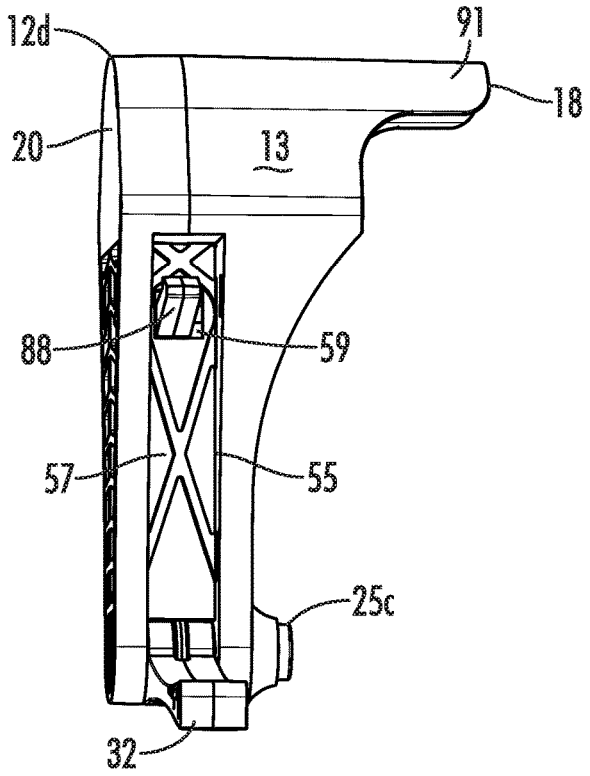
FIG. 46 is another right side perspective view of the brace of FIG. 42.
Figure 47:
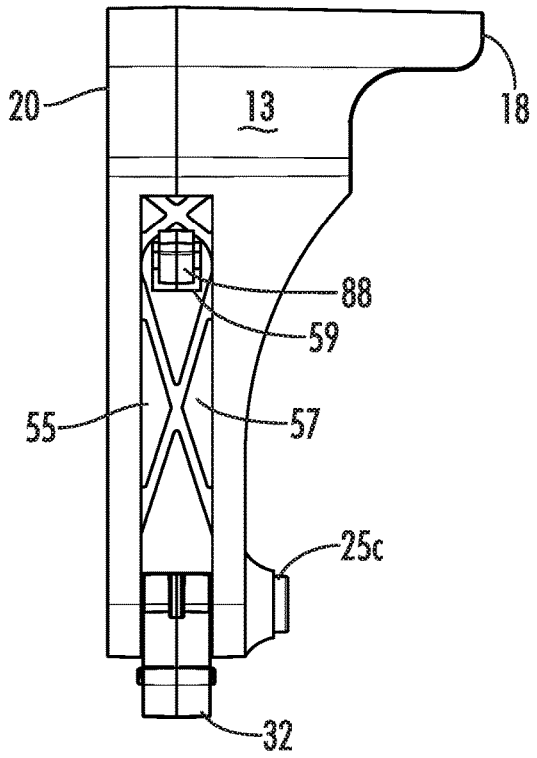
FIG. 47 is a right side elevational view of the brace of FIG. 42.
Figure 48:
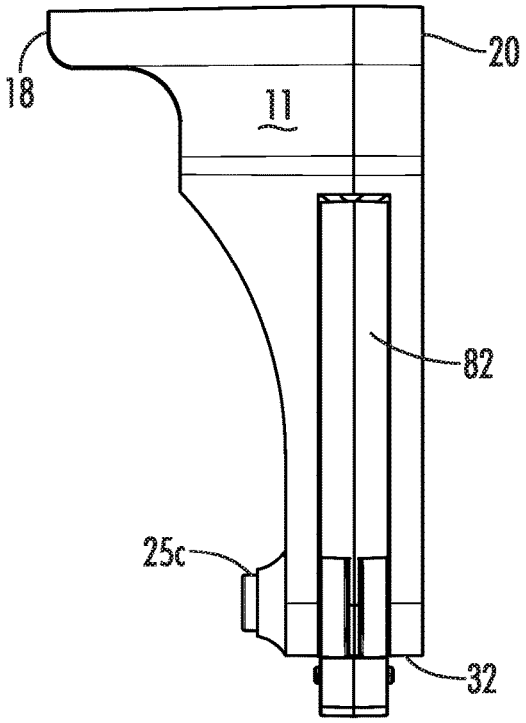
FIG. 48 is a left side elevational view of the brace of FIG. 42.
Figure 49:
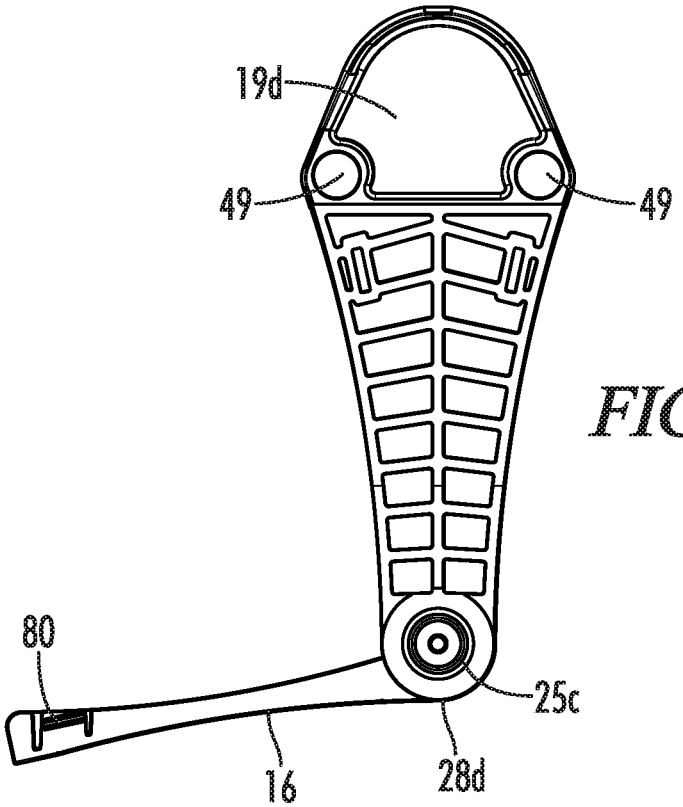
FIG. 49 is a front elevation view of the brace of FIG. 42.
Figure 50:
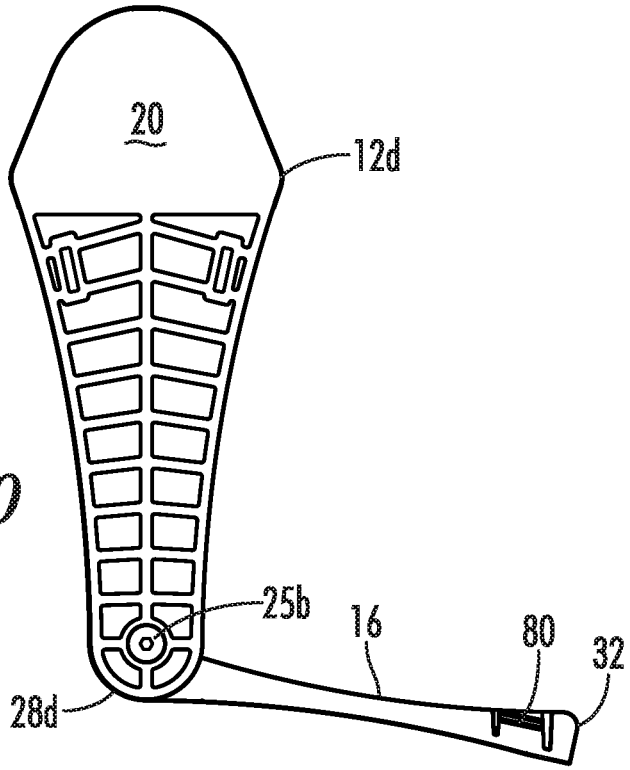
FIG. 50 is a rear elevational view of the brace of FIG. 42.
Figure 51:
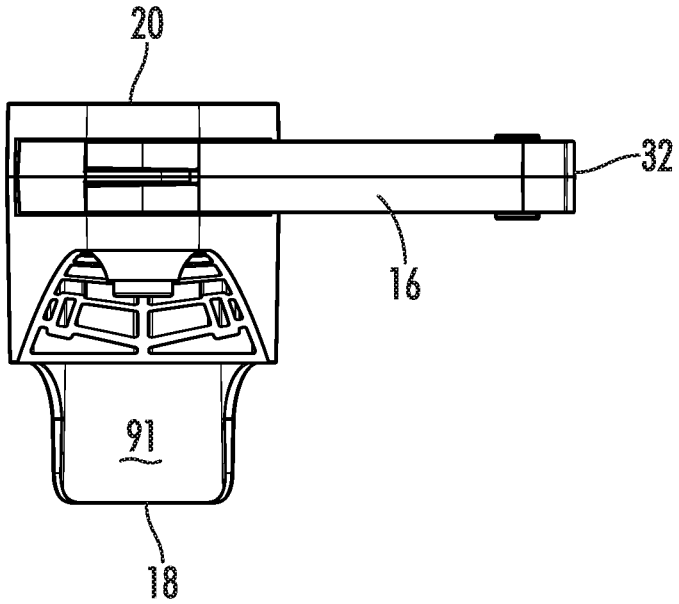
FIG. 51 is a bottom plan view of the brace of FIG. 42.
Figure 52:
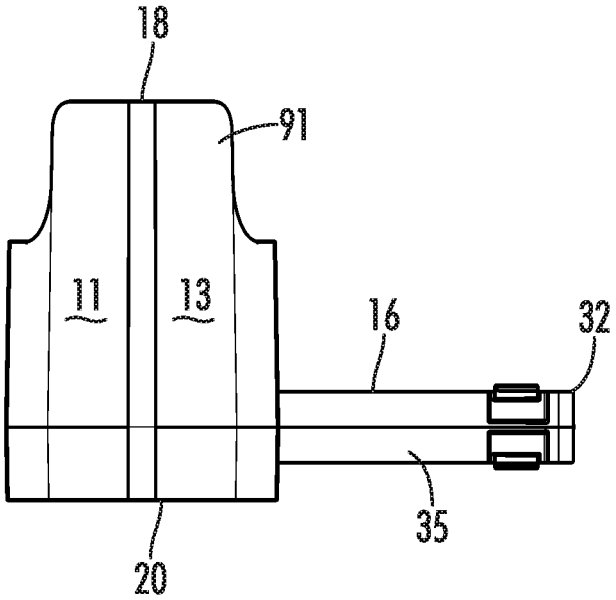
FIG. 52 is a top plan view of the brace of FIG. 42.
Figure 67:
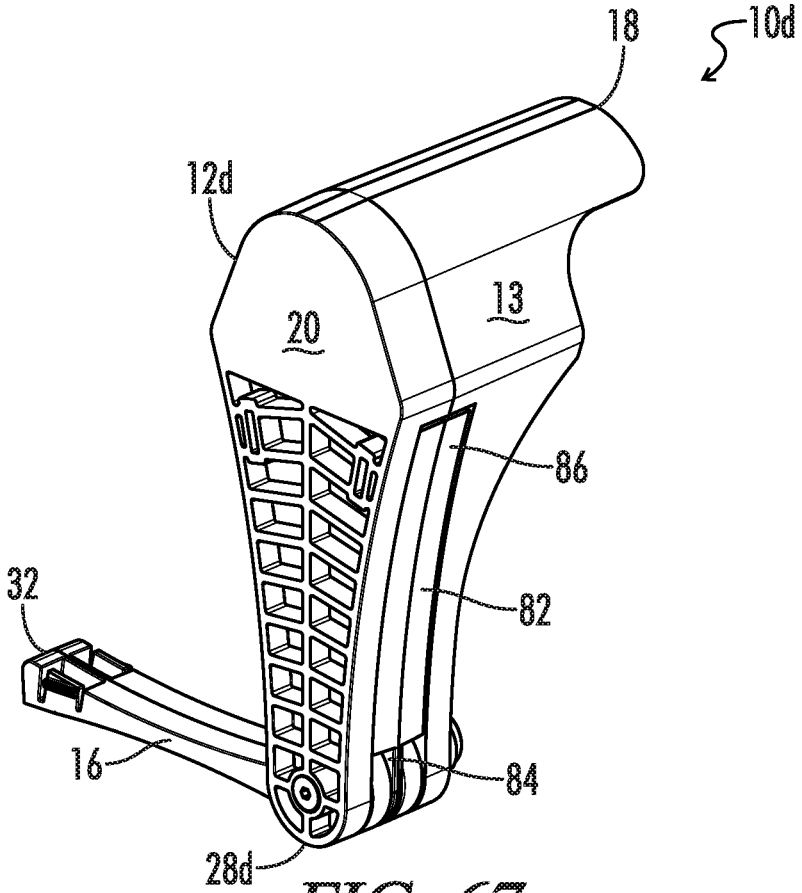
FIG. 67 is another elevated rear right side perspective view of the brace of FIG. 42 showing the brace in a deployed configuration for a left-handed user.
Figure 68:
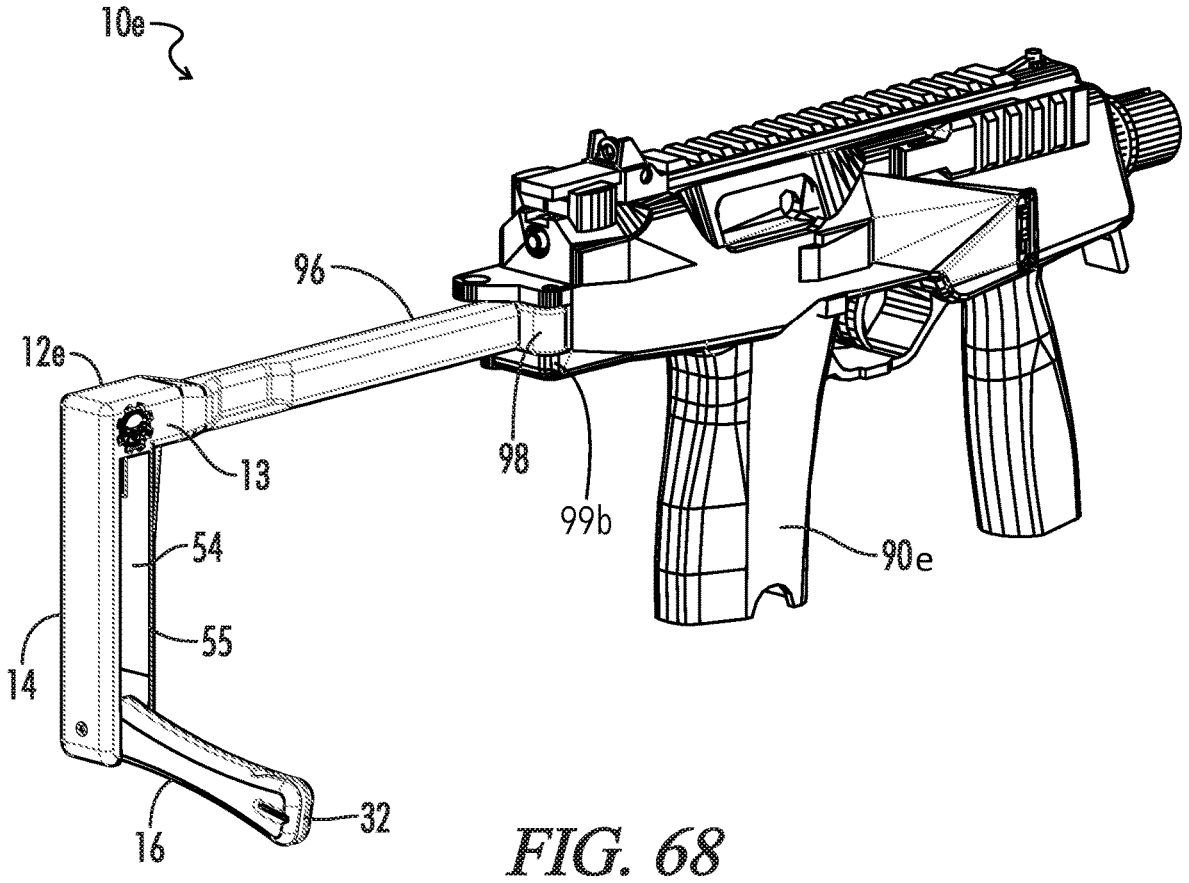
FIG. 68 is an elevated perspective view of a brace for stabilizing a handheld device constructed in accordance with another alternate embodiment of the present invention showing the brace in a deployed configuration for a right-handed user and attached to a handgun.

Elongated body 12 also includes a slot 55 formed in each side 11, 13 thereof. The arm 16 is removably receivable in either slot 55 (depending on whether the brace 10*d* is in a right-handed configuration as shown in FIGS. 42-66, or a left-handed configuration as shown in FIG. 67) when the arm 16 is in the stowed position. The slots 55 are separated by a thin wall or partition 57 through which an aperture 59 is defined. However, in some embodiments, the slots 55 can be joined to form one slots extending completely through the elongated body 12*d* from the left side 11 to the right side 13. Each vertical slot 55 includes a forward surface 54 and an opposing rearward surface 56. The forward and rearward surfaces 54, 56 can include recesses 58 formed near the upper ends of the slots 55, as best shown in FIGS. 42 and 43.

Pivotable arm 16 includes a distal end 32 and a proximal end 30. The proximal end of the arm 16 can be pivotally connected to the distal end 28 of elongated body 12*d* with a shoulder bolt 25*b* or other fastener about which arm 16 can pivot. In some embodiments, the shoulder bolt 25*b* can also be used to couple a sling swivel socket 25*c* to elongated body 12*d*. The proximal end 30 of arm 16 can includes a recess 31 and a pair of stops 87 configured to prevent arm 16 from pivoting beyond a predetermined angle away from elongated body 12*d* by engaging partition 57.

The distal end 32 of arm 16 includes a pair of flexible protrusions 80 which interface with and releasably engage recesses 58 defined in the forward and rearward surfaces 54, 56 of slot 55 in elongated body 12*d* to retain the arm 16 in the stowed position when the arm 16 is received in slot 55. In this way, the distal end 32 of arm 16 functions as a snap lock that allows a user to quickly and easily lock the arm 16 inside the body 12*d* in the stowed position when the arm 16 is not in use. While in the stowed position, the exterior surface of the arm 16 is flush with the exterior surface of the side 11, 13 of elongated body 12*d* in which the arm 16 is received. This reduces both the silhouette of the brace 10*d* and the chance that the brace 10*d* will become snagged on a user's clothing or the environment.

In order to unlock the snap lock and release arm 16 from the slot 55, brace 10*d* further comprises elongated snap lock release member 82. Release member 82 includes a proximal end 84 and a distal end 86. The proximal end 84 of release member 82 includes a hinge plate 85 that is pivotably connected to the distal end 28*d* of elongated body 12*d* by shoulder bolt 25*b*. Hinge plate 85 is received in a corresponding recess 31 formed in the proximal end 30 of arm 16 when the hinge plate 85 and arm 16 are pivotably connected to the distal end 28*d* of elongated body 12*d* by shoulder bolt 25*b*.

Figure 64:
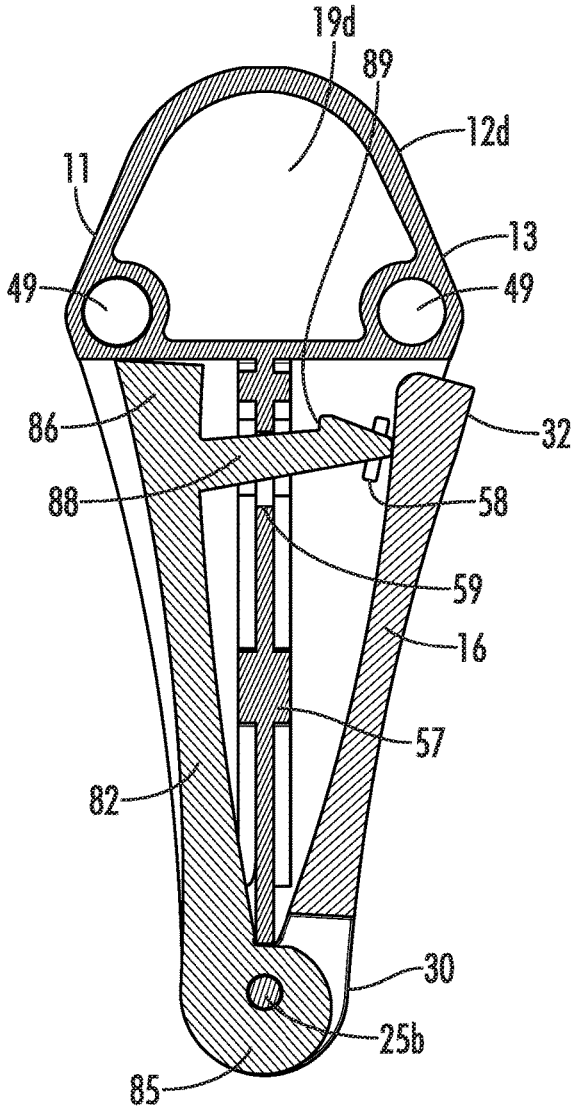
FIG. 64 is a cutaway view of the brace of FIG. 58 taken long line 64-64 showing the brace in an unlocked position.
Figure 65:
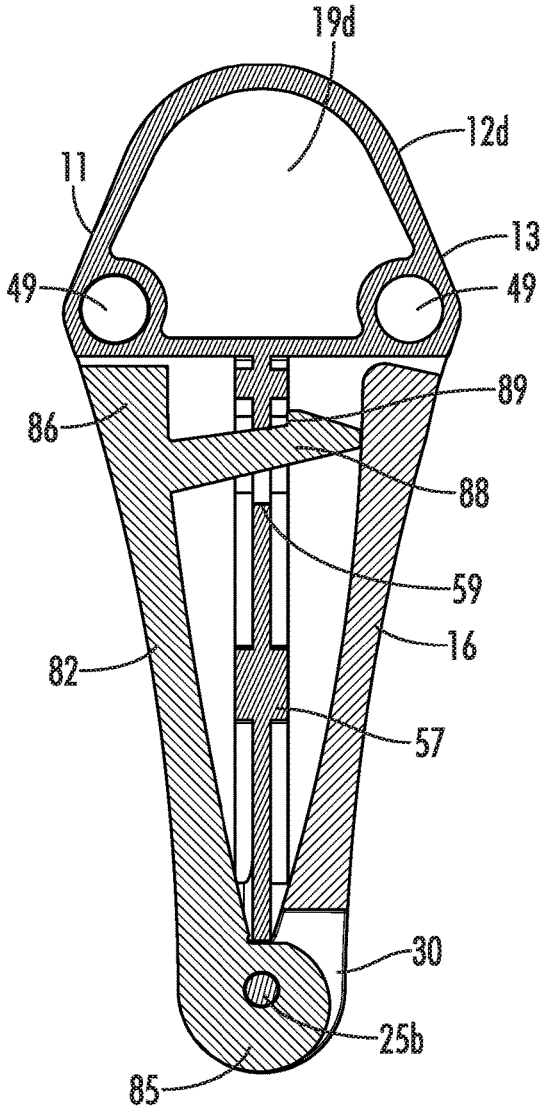
FIG. 65 is a cutaway view of the brace of FIG. 58 taken long line 65-65 showing the brace in a locked position.
Figure 66:
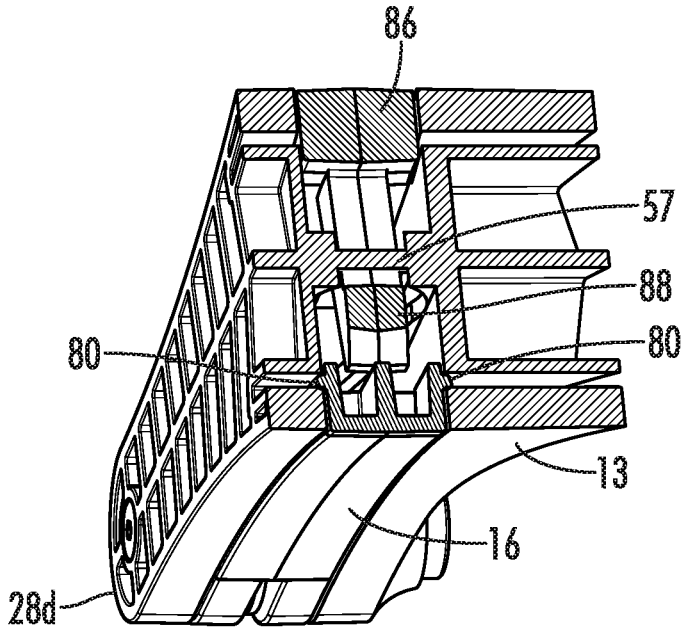
FIG. 66 is a cutaway view of the brace of FIG. 57 taken long line 66-66 showing the brace in a locked position.

The distal end 86 of release member 82 includes a protrusion 88 shaped to extend through aperture 59 in partition 57. As best shown in FIGS. 64-65, depressing release member 82 while the arm 16 is locked in slot 55 causes protrusion 88 to move through aperture 59 to disengage flexible protrusions 80 from recesses 58 and thus release arm 16 from retention in slot 55 for subsequent rotation into the deployed position. As shown in FIG. 65, a ledge 89 formed on protrusion 88 acts as a backstop that contacts partition 57 and prevents the protrusion 88 from being inadvertently backed out of the aperture 59. This prevents the release member 82 from being inadvertently removed from the slot 55 when the arm 16 is in the deployed position. Protrusion 88 and ledge 89 are configured so that the exterior surface of release member 82 remains flush with the exterior surface of the corresponding side 11, 13 of elongated body 12*d* in which release member 82 is received when the release member 82 is not in use.

A user can remove the distal end 86 of release member 82 from slot 55 by depressing protrusion 88 with a finger or tool while the arm 16 is in the deployed position so that ledge 89 is lowered below the upper edge of aperture 59 in partition 57. This allows a user to withdraw protrusion 82 through aperture 59 and pivot release member 82 out of slot 55. A user can completely remove both the release member 82 and arm 16 from slot 55 by removing should bolt 25*b* from the lower end 28*d* of elongated body 12*d*. The release member 82 and arm 16 can then be replaced in slot 55 in either a right-handed or left-handed configuration at the preference of the user.

Figure 69:
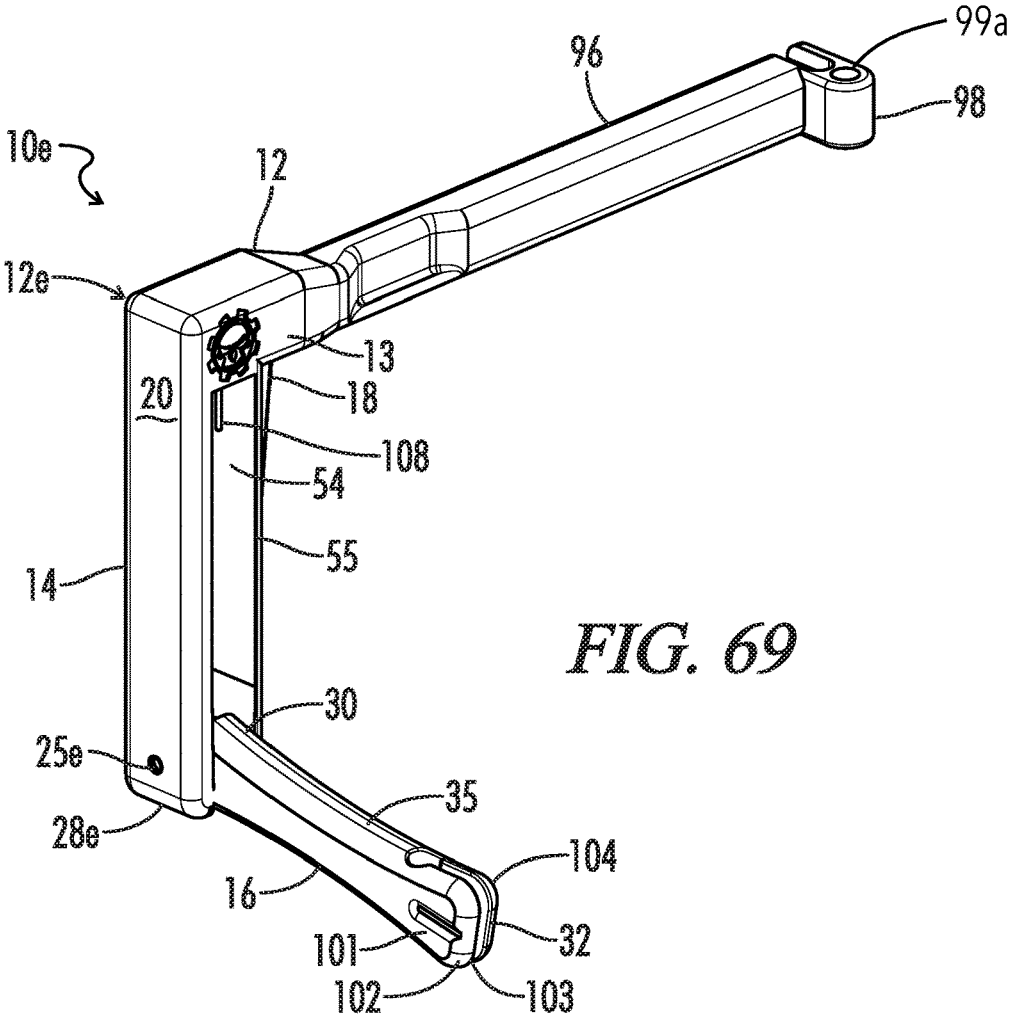
FIG. 69 is an elevated rear right side perspective view of the brace of FIG. 68.
Figure 70:
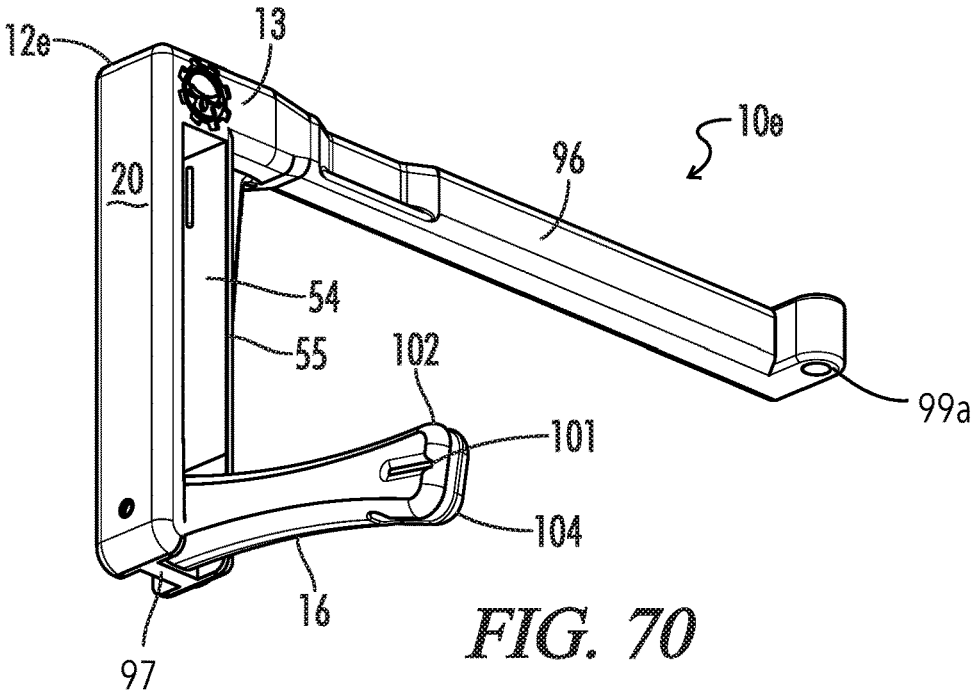
FIG. 70 is a depressed rear right side perspective view of the brace of FIG. 68.
Figure 71:
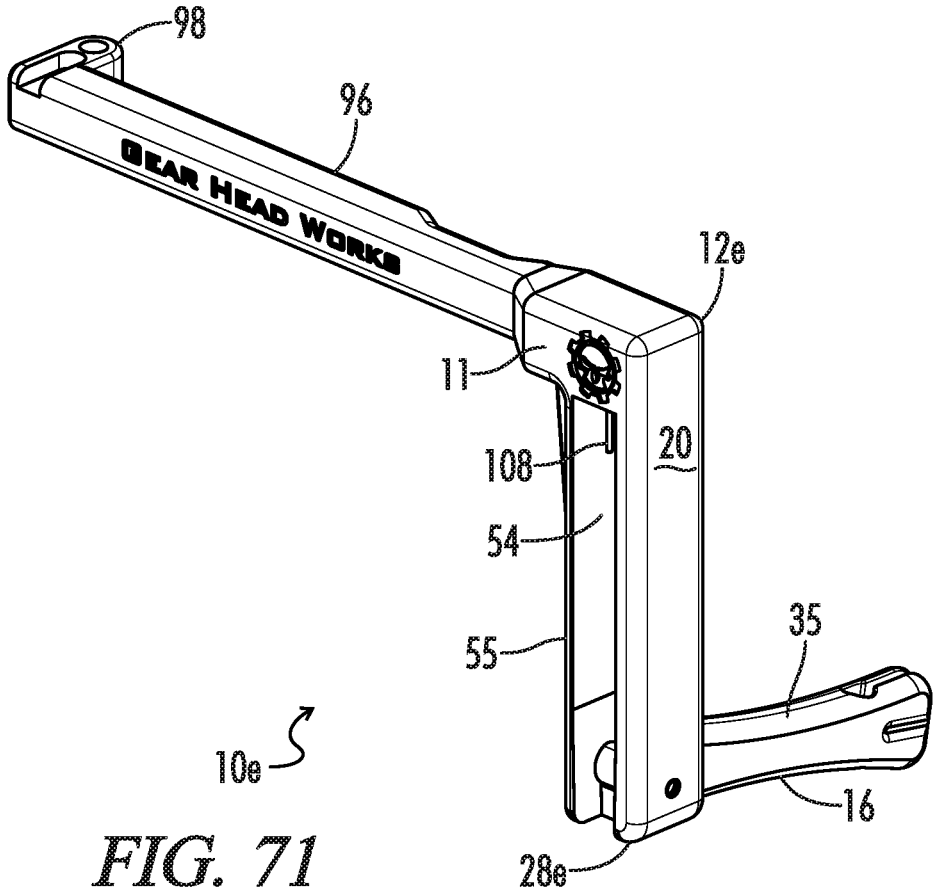
FIG. 71 is an elevated rear left side perspective view of the brace of FIG. 68.
Figure 72:
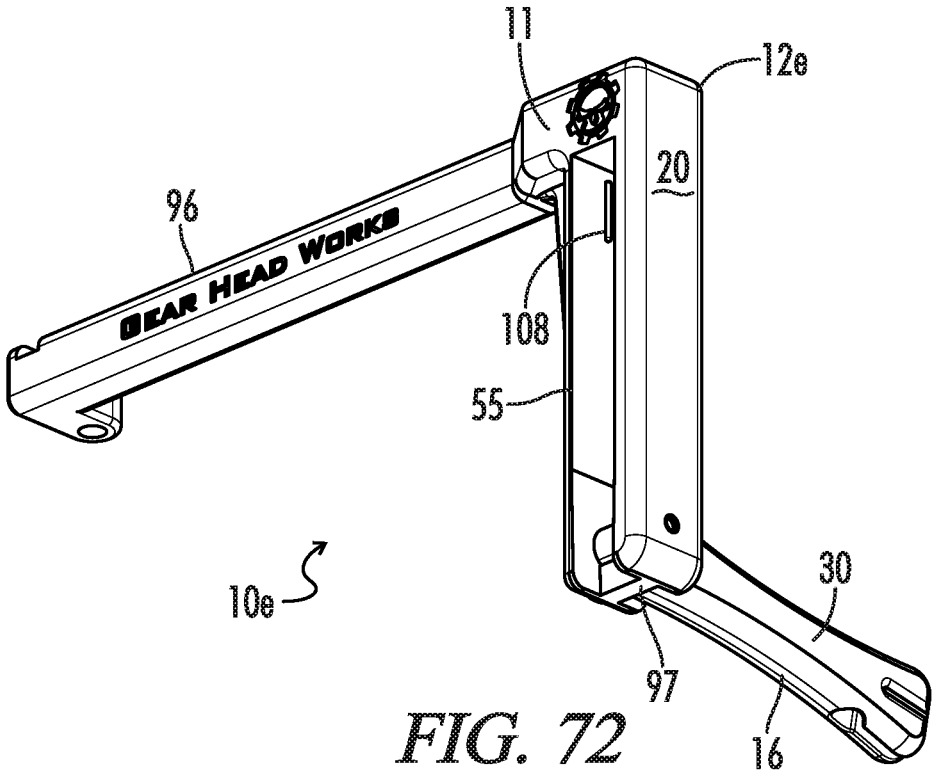
FIG. 72 is a depressed rear left side perspective view of the brace of FIG. 68.
Figure 73:
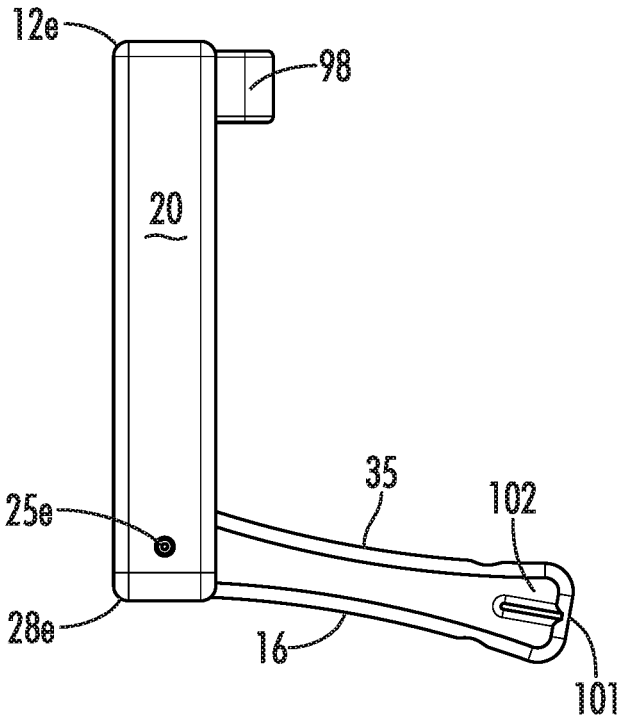
FIG. 73 is a rear elevational view of the brace of FIG. 68.
Figure 74:
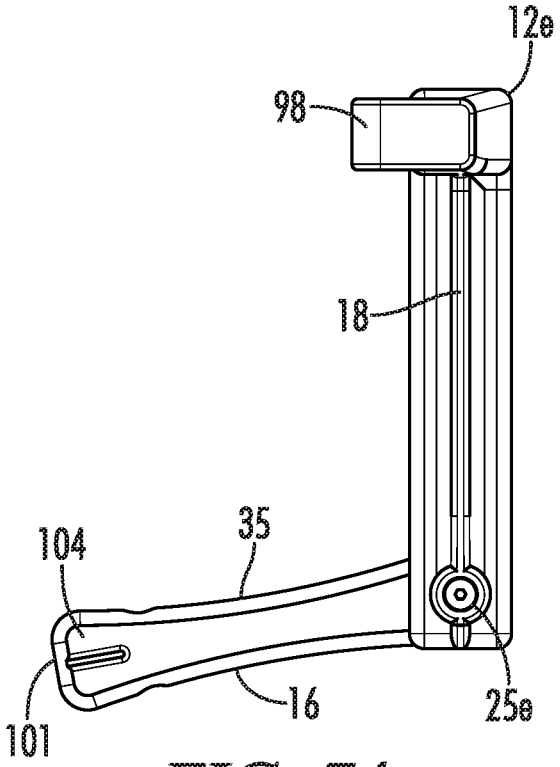
FIG. 74 is a front elevational view of the brace of FIG. 68.
Figure 75:
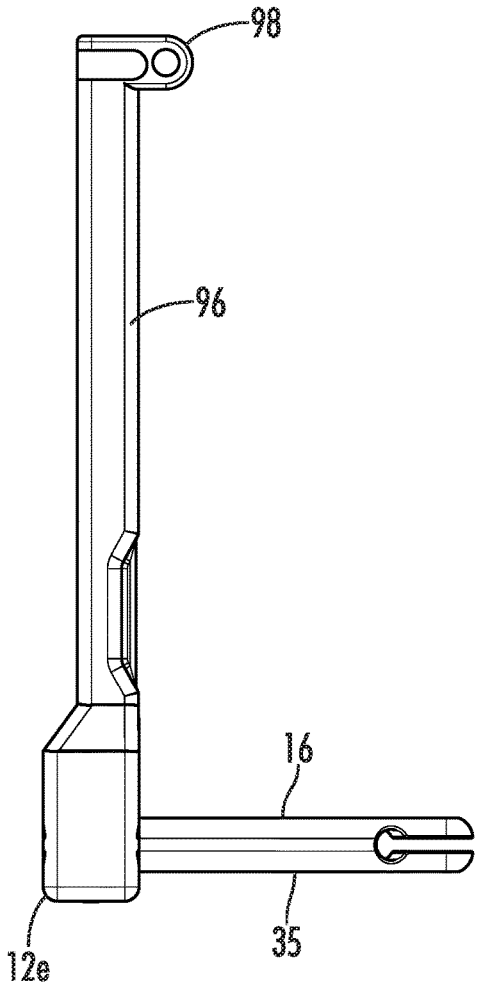
FIG. 75 is a top plan view of the brace of FIG. 68.
Figure 76:
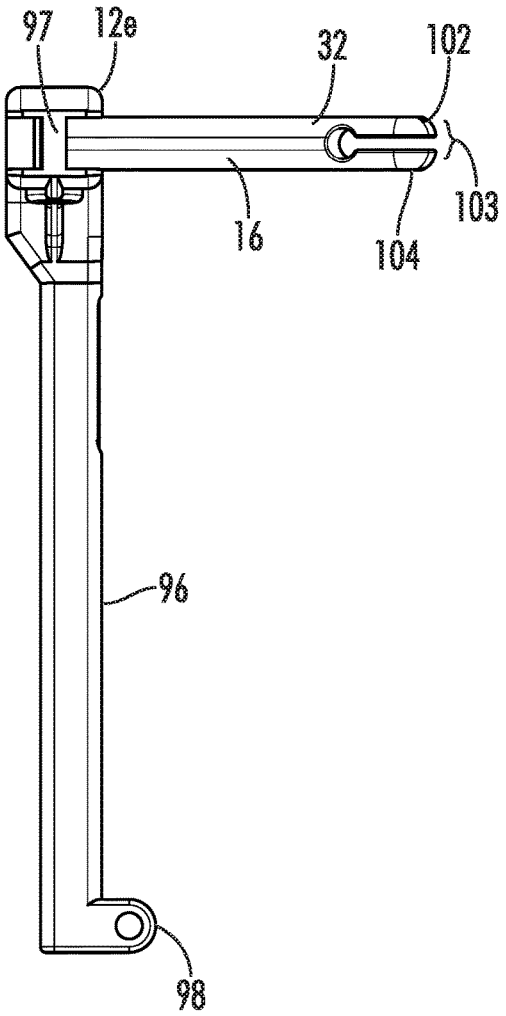
FIG. 76 is a bottom plan view of the brace of FIG. 68.
Figure 77:
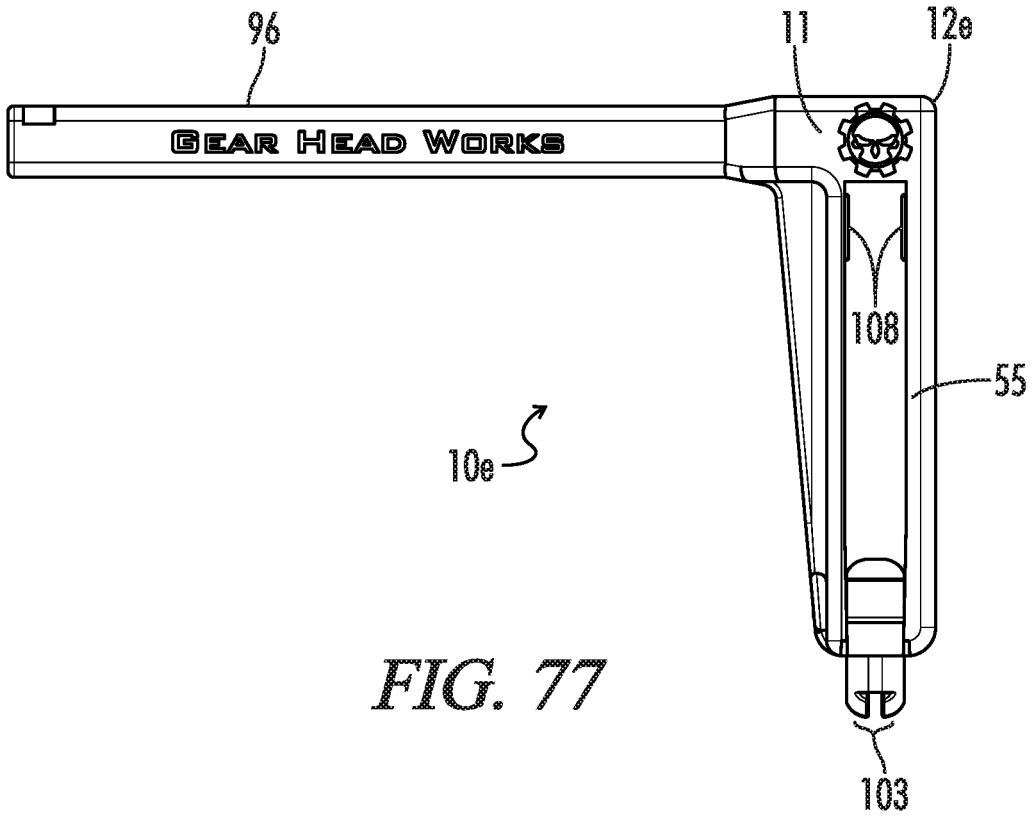
FIG. 77 is a left side elevational view of the brace of FIG. 68.
Figure 78:
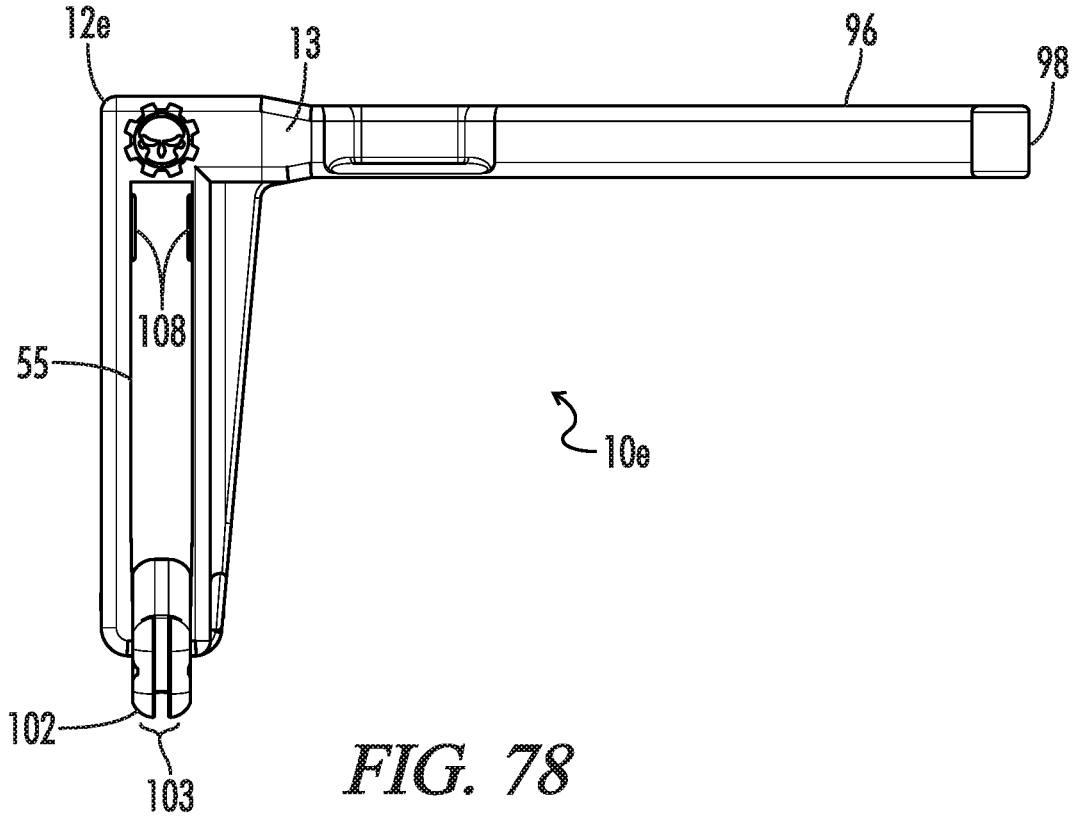
FIG. 78 is a right side elevational view of the brace of FIG. 68.
Figure 79:
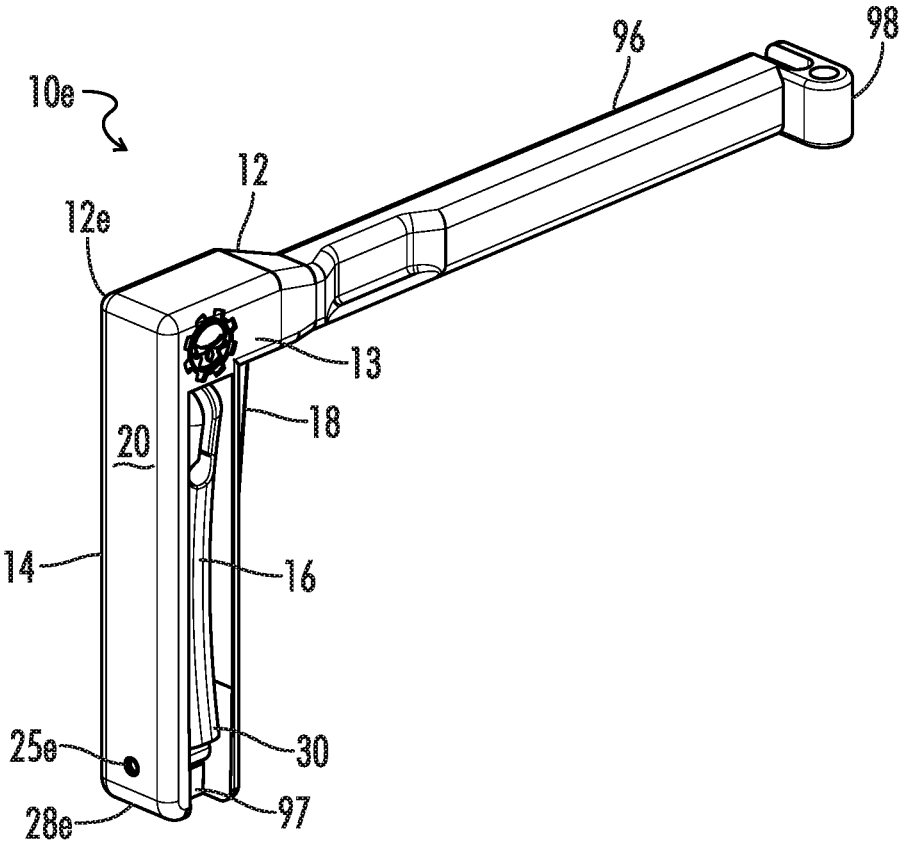
FIG. 79 is an elevated right side perspective view of the brace of FIG. 68 in a stowed position.
Figure 80:
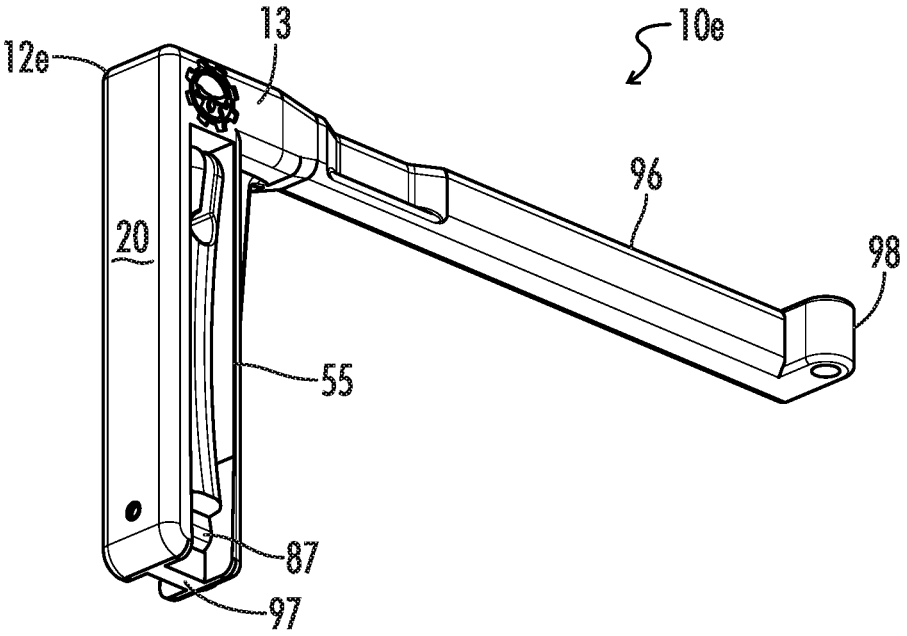
FIG. 80 is a depressed rear right side perspective view of the brace of FIG. 79.
Figure 81:
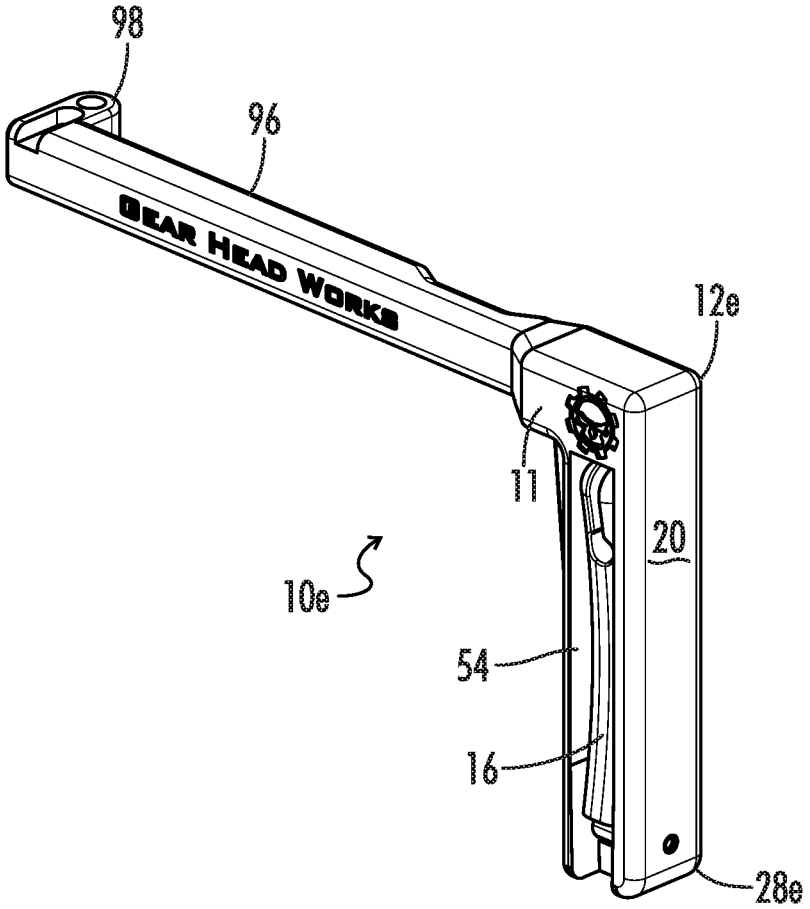
FIG. 81 is an elevated rear left side perspective view of the brace of FIG. 79.
Figure 82:
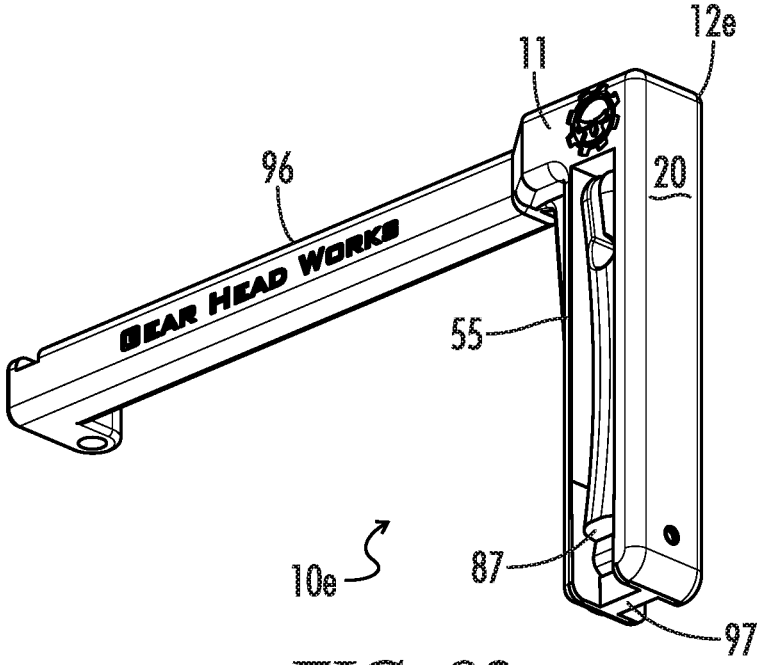
FIG. 82 is a depressed rear left side perspective view of the brace of FIG. 79.
Figure 83:
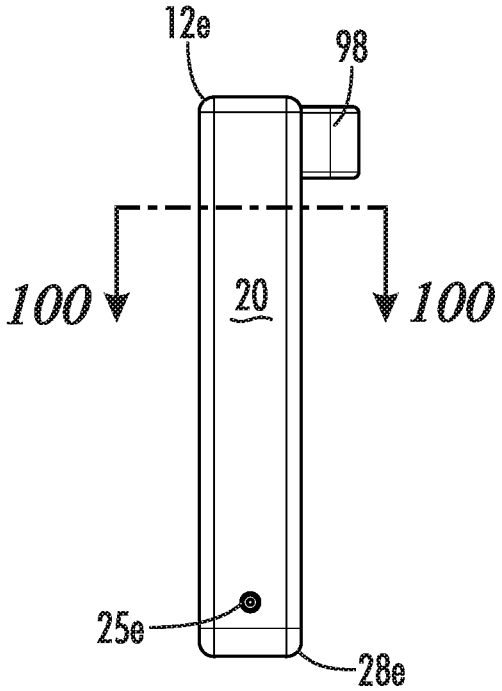
FIG. 83 is a rear elevational view of the brace of FIG. 79.
Figure 84:
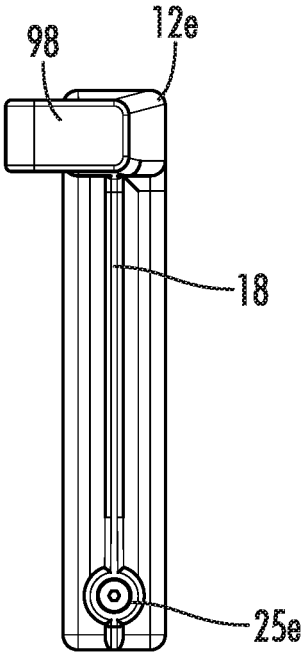
FIG. 84 is a front elevational view of the brace of FIG. 79.
Figure 85:
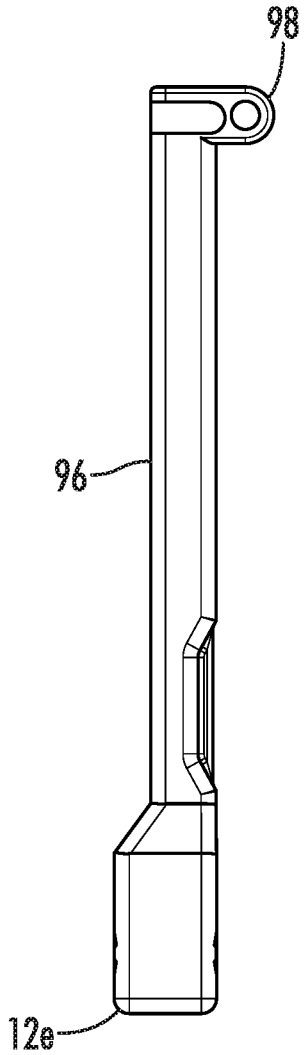
FIG. 85 is a top plan view of the brace of FIG. 79.
Figure 86:
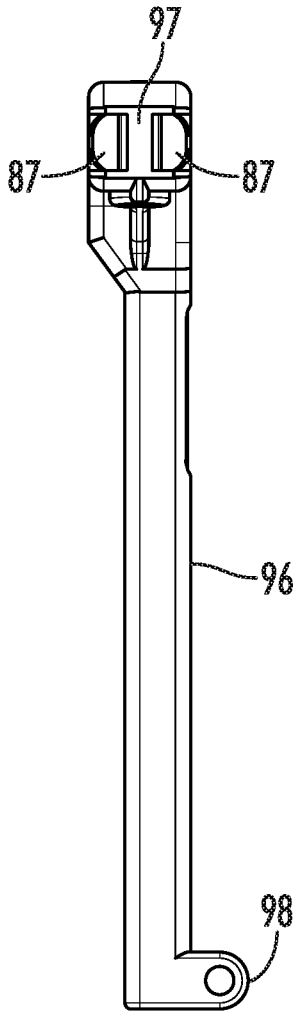
FIG. 86 is a bottom plan view of the brace of FIG. 79.
Figure 87:
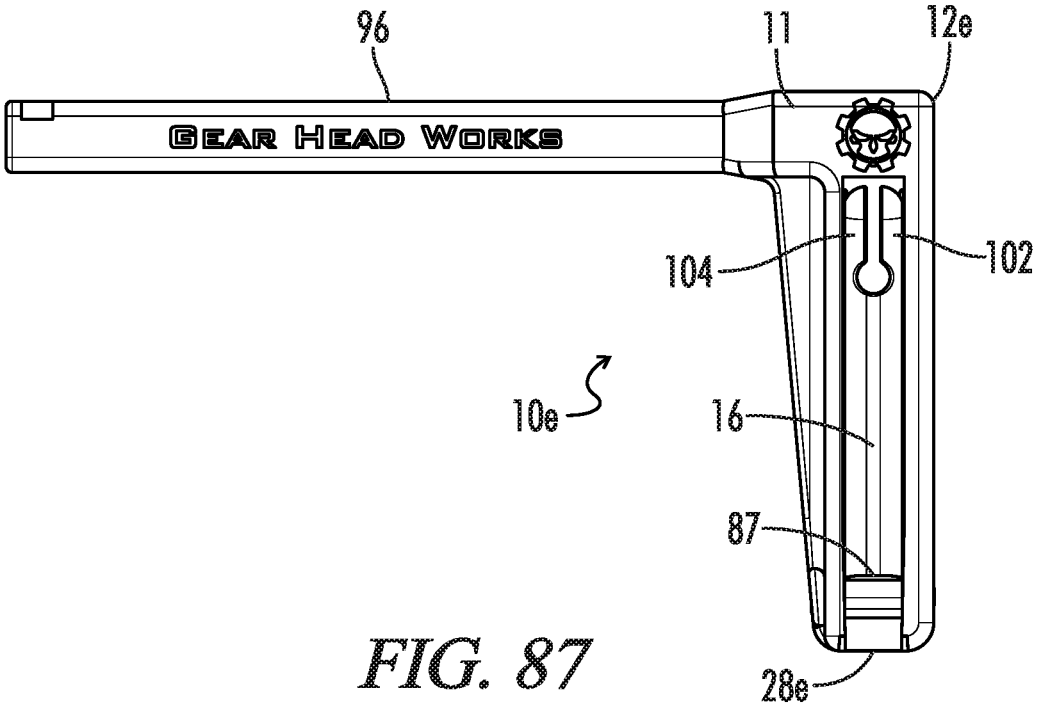
FIG. 87 is a left side elevational view of the brace of FIG. 79.
Figure 88:
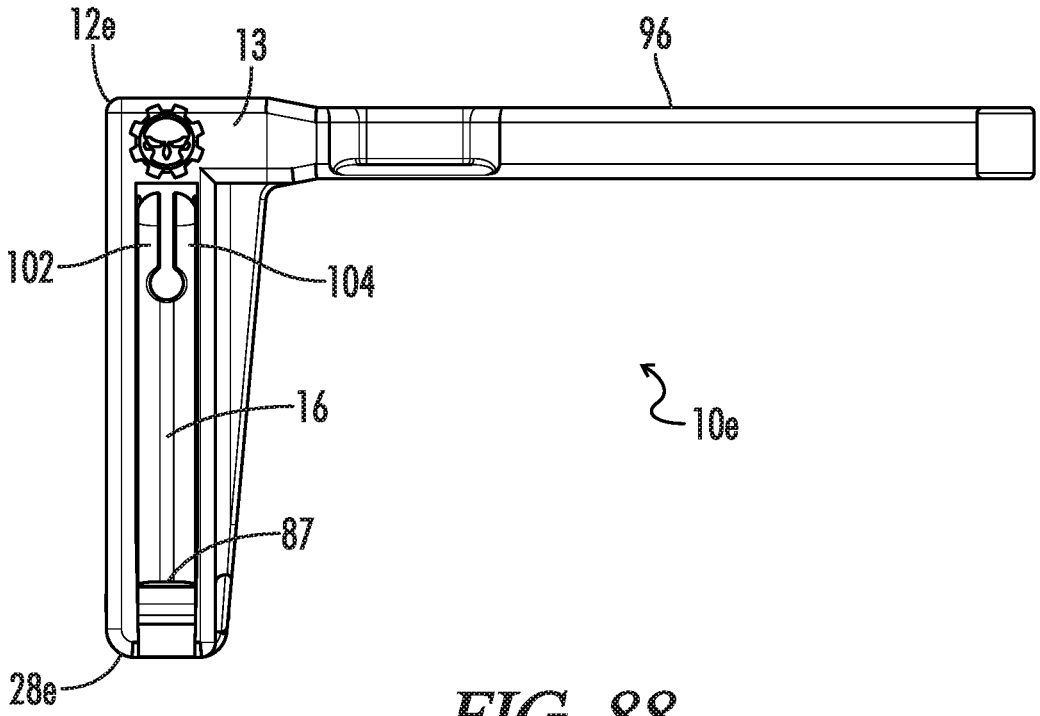
FIG. 88 is a right side elevational view of the brace of FIG. 79.
Figure 89:
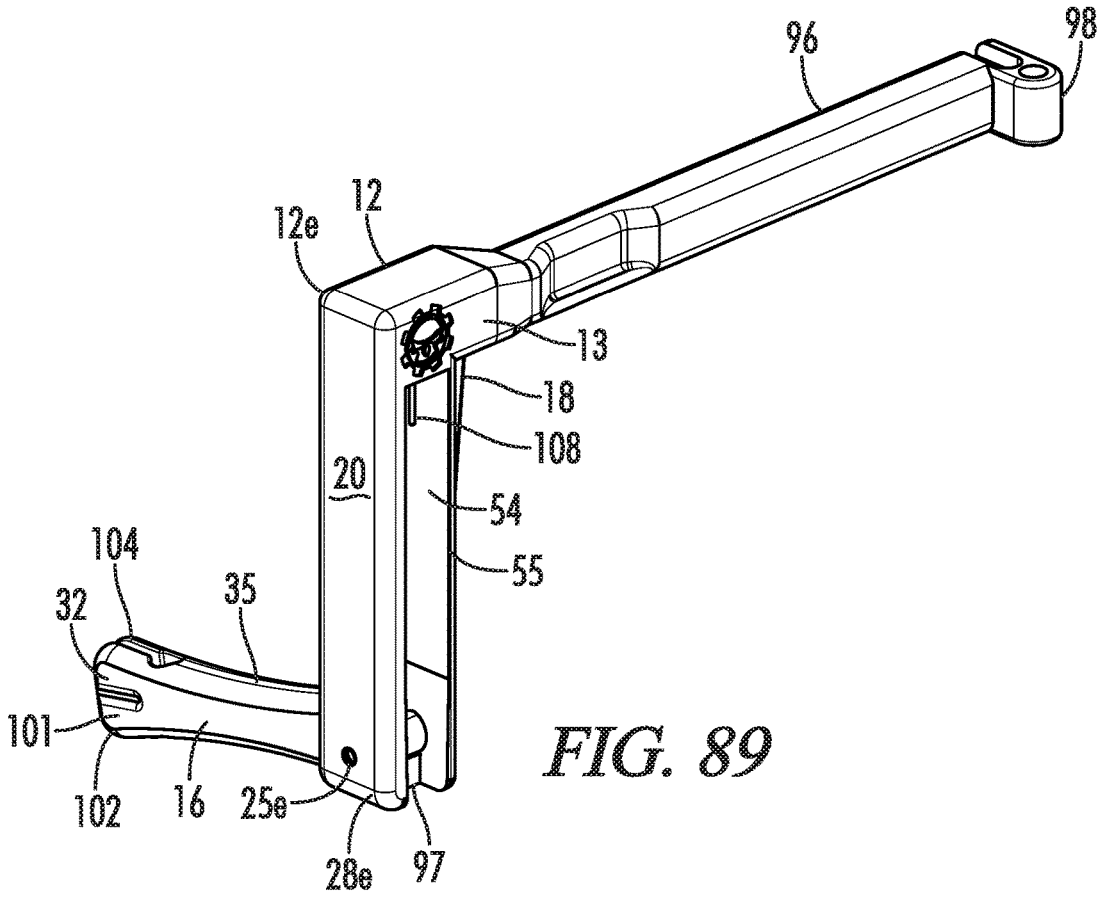
FIG. 89 is an elevated rear right side perspective view of the brace of FIG. 68 in a deployed configuration for a left-handed user.
Figure 90:
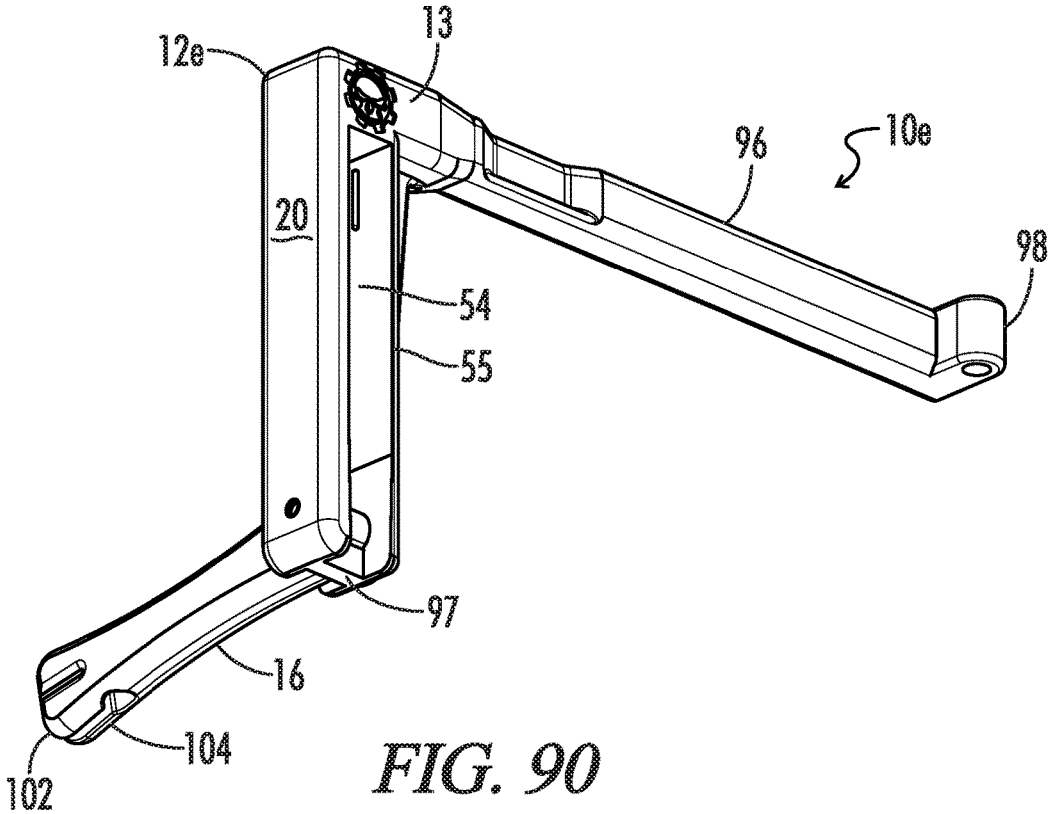
FIG. 90 is a depressed rear right side perspective view of the brace of FIG. 89.
Figure 91:
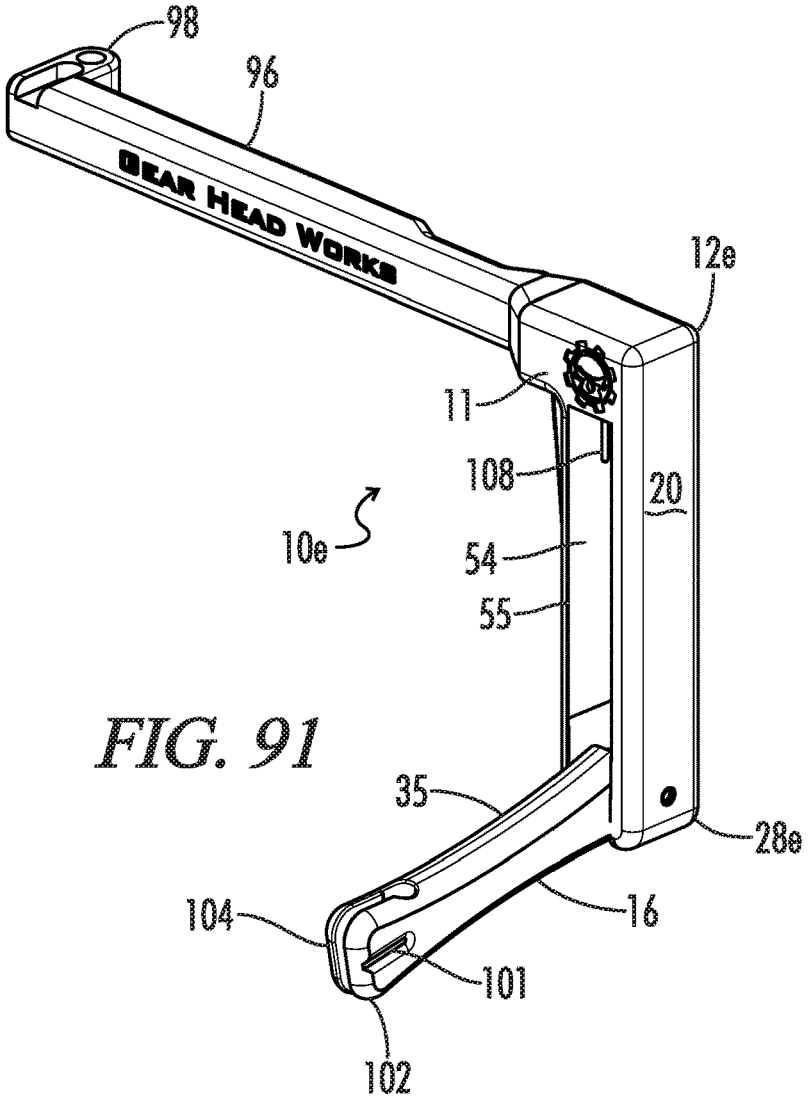
FIG. 91 is an elevated rear left side perspective view of the brace of FIG. 89.
Figure 92:
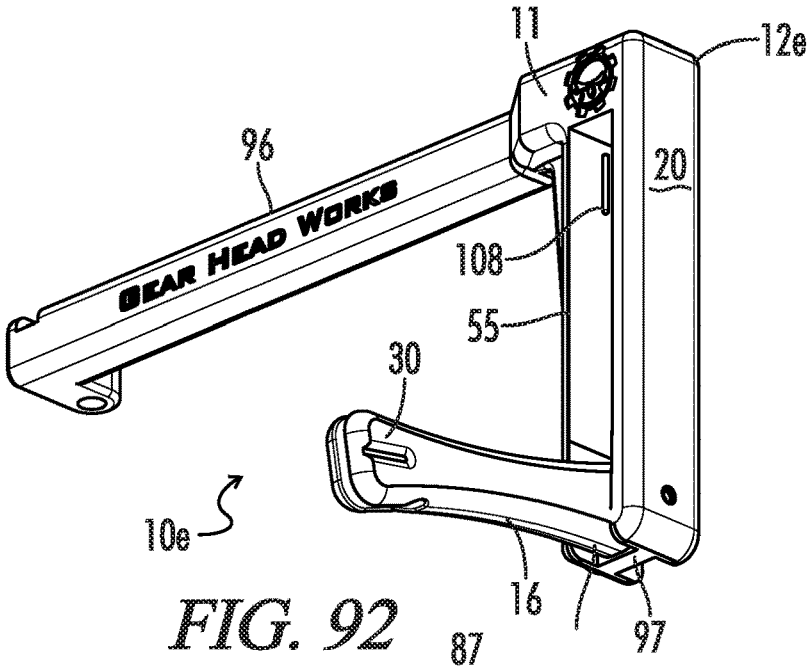
FIG. 92 is a depressed rear left side perspective view of the brace of FIG. 89.
Figure 93:
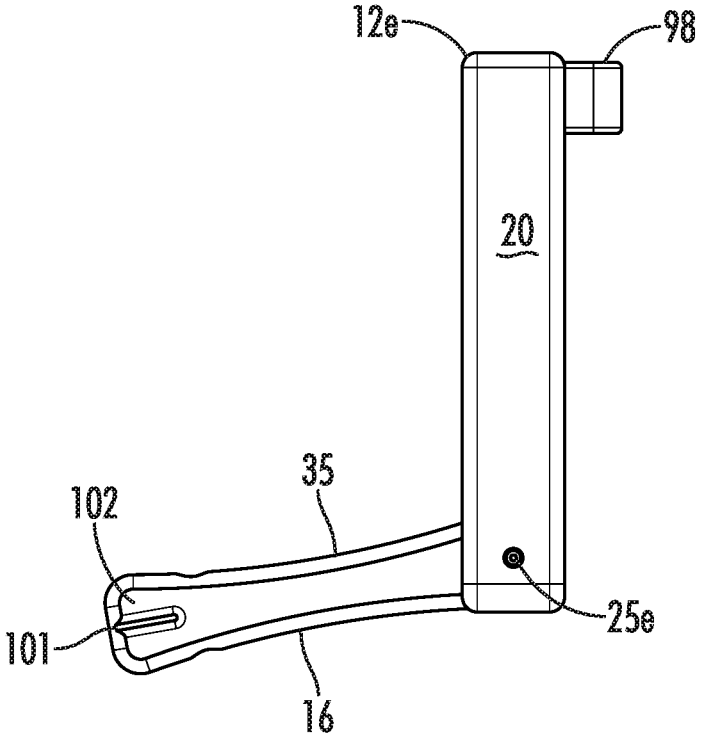
FIG. 93 is a rear elevational view of the brace of FIG. 89.
Figure 94:
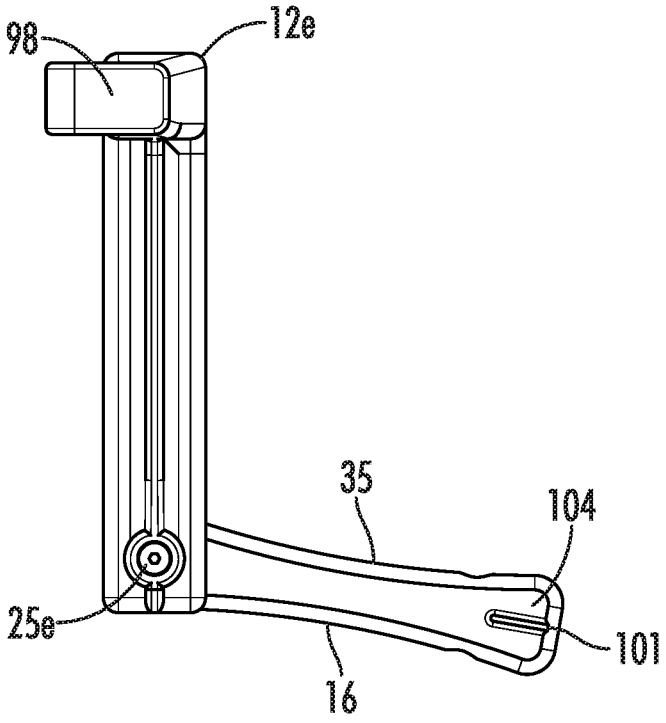
FIG. 94 is a front elevational view of the brace of FIG. 89.
Figure 95:
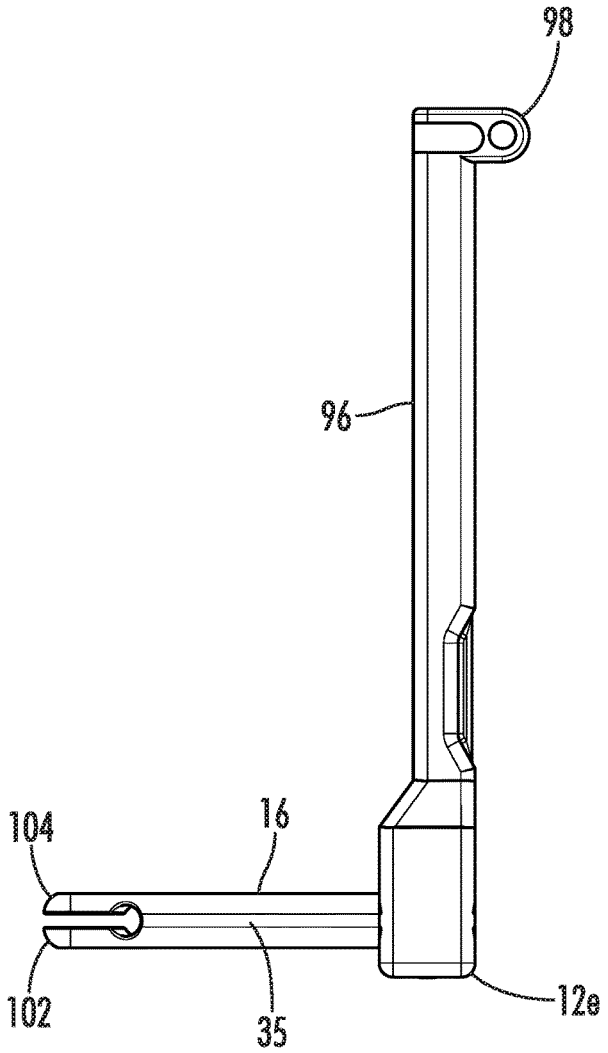
FIG. 95 is a top plan view of the brace of FIG. 89.
Figure 96:
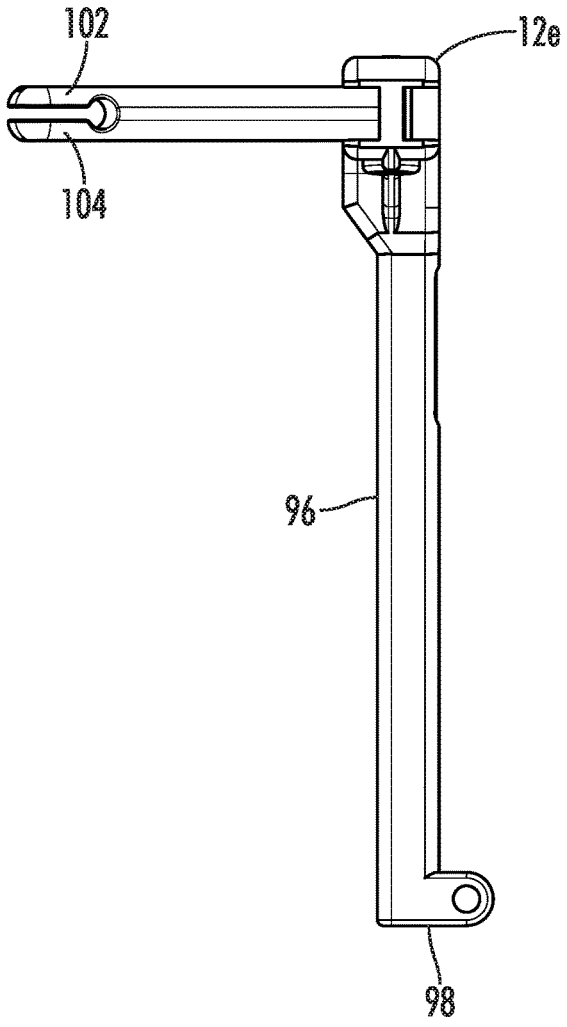
FIG. 96 is a bottom plan view of the brace of FIG. 89.
Figure 97:
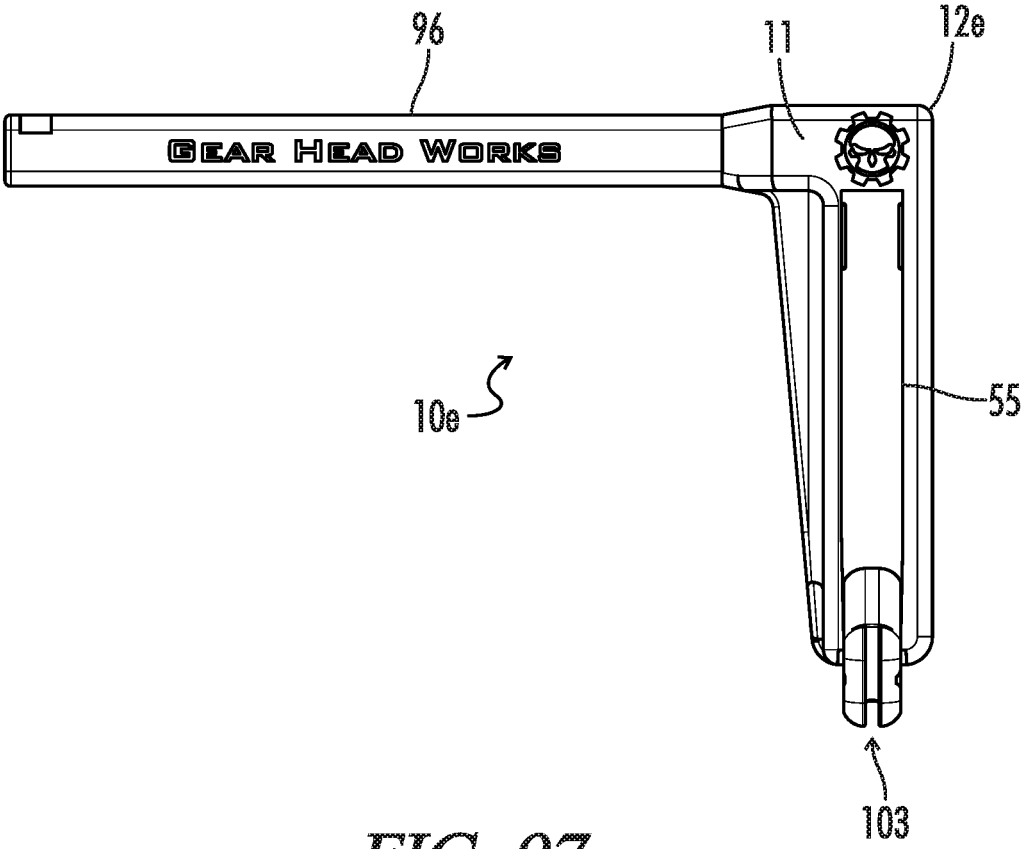
FIG. 97 is a left side elevational view of the brace of FIG. 89.
Figure 98:
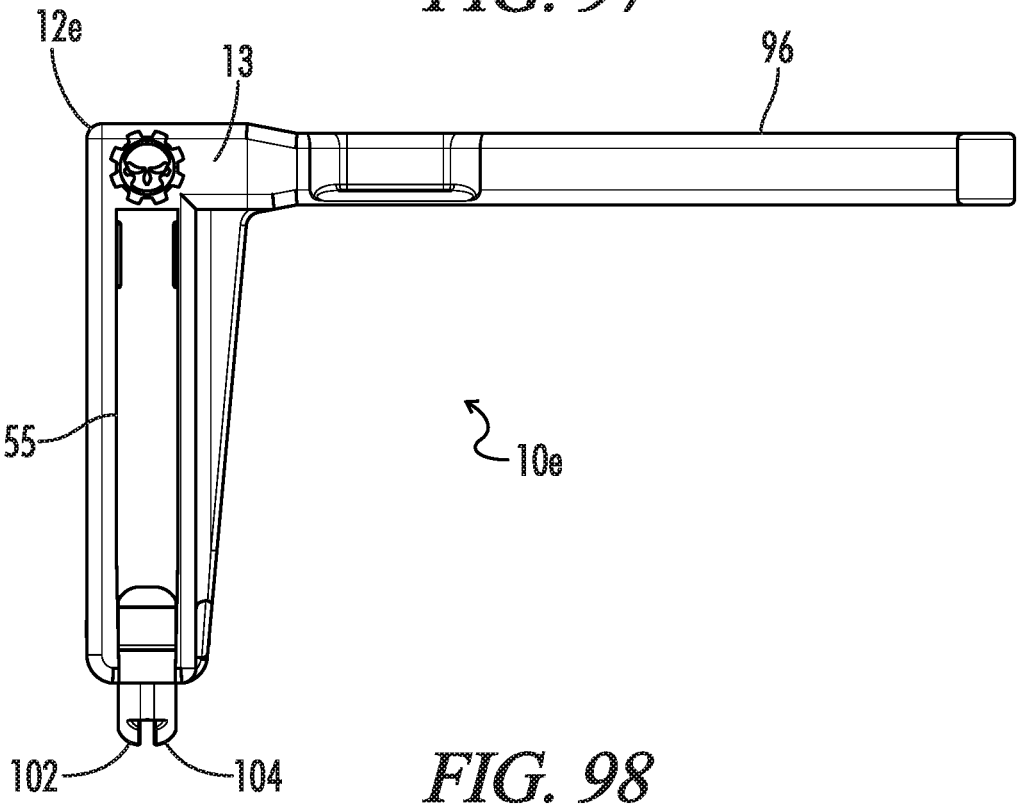
FIG. 98 is a right side elevational view of the brace of FIG. 89.
Figure 99:
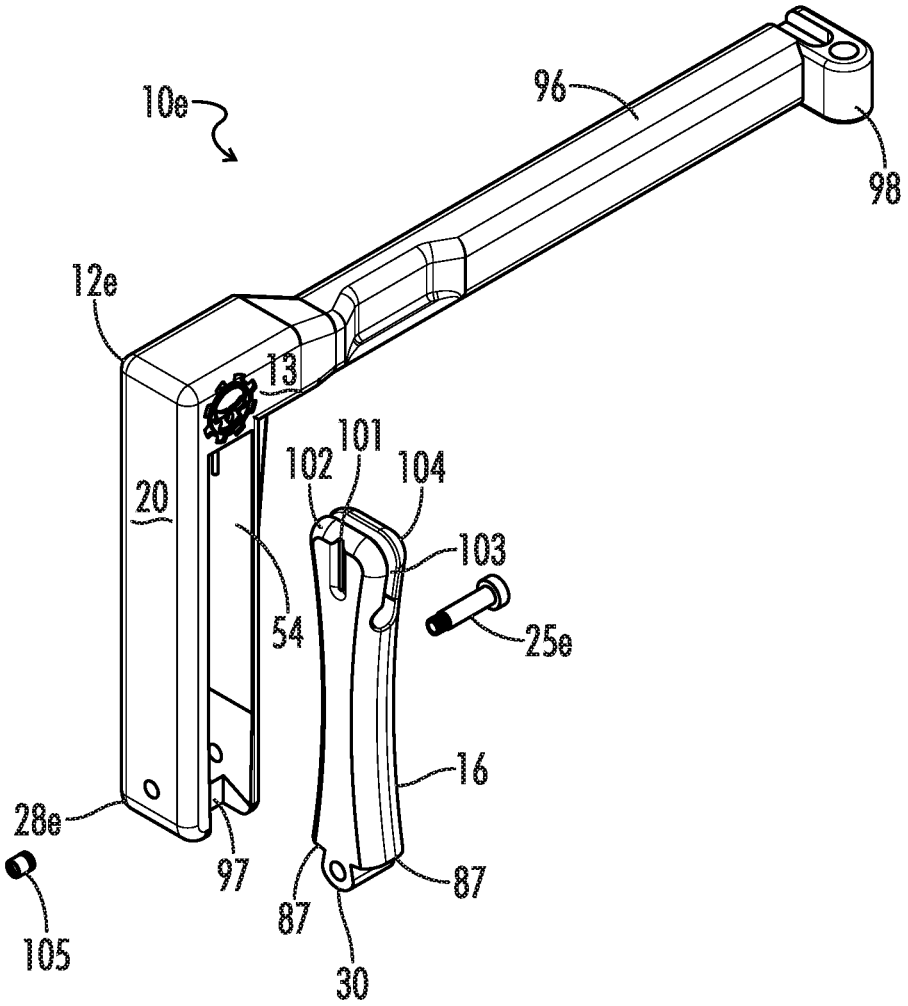
FIG. 99 is an exploded view of the brace of FIG. 79.
Figure 100:
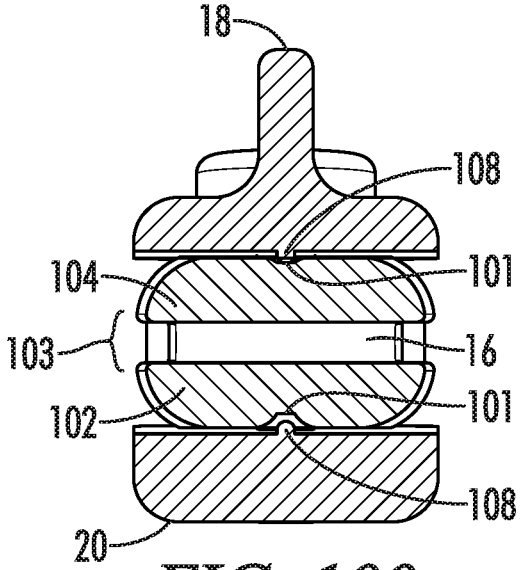
FIG. 100 is a cutaway view of the brace of FIG. 83 taken along line 100-100 showing engagement of shallow recesses in the distal end of the pivotable arm by protuberances on corresponding opposing surfaces of the slot in the elongated body.

Turning now to FIGS. 68 through 100, wherein like reference numerals refer to like elements of previously disclosed embodiments, there is depicted another alternate embodiment of a brace 10*e* constructed in accordance with the present invention. Like brace 10*d*, brace 10*e* comprises a vertically elongated body 12*e* and an arm 16 pivotally connected to a lower portion of the elongated body 12*e* by a pivot or other pivotable fastener such as a bolt 25*e* and a externally threaded barrel nut 105. The arm 16 is selectably movable between a stowed position wherein the arm 16 is vertically aligned with and received inside the body 12*e* as shown in FIG. 79, and a deployed position as shown in FIG. 69 wherein the arm 16 provides a surface 35 against which a user's forearm 92 is removably receivable to stabilize a handheld device such as a firearm 90 when the elongated body 12*e* is engaged with the device.

Unlike brace 10*d*, the front end 18 of elongated body 12*e* omits any passage or recesses in which a support structure is removably receivable. Instead, the front or forward end 18 of elongated body 12*e* includes a forward extension portion in the form of a beam 96 having a distal end 98 configured to be releasably attached to a handheld device 90*e* such as a handgun. In one embodiment, the distal end 98 of the beam 96 can be shaped like a portion of a barrel hinge 98 with a hole 99*a* in which a releasable fastener such as a bolt 99*b* is removably receivable extending therethrough. The barrel hinge 98 can be received in and pivotably connected to complimentary geometry located on a handheld device such as a handgun 90*e*, as exemplified in FIG. 68. Other configurations will be apparent to ordinarily skilled artisans and are within the scope of the invention.

Brace 10*e* is designed to be fully ambidextrous and allow a user to quickly and easily place the arm 16 in a deployed position for either a left- or right-handed user without first disassembling the brace 10*e*. To achieve this, brace 10*e* omits partition 57 from brace 10*d* and includes a single slot 55 that extends completely through the body 12*e* from side to side 11, 13. This permits arm 16 to pivot through elongated body 12*e* from a deployed position for a right-handed user (see, e.g., FIG. 69) to a deployed position for a left handed user (see, e.g., FIG. 89). Stops 87 formed on either side of the proximal end 30 of pivotable arm 16 can abut against a cross bar 97 extending between opposing surfaces 54, 56 of slot 55 near the distal end 28*e* of elongated body 12*e* to prevent the arm 16 from pivoting beyond a predetermined angle from either side 11, 13 of elongated body 12*e*.

To facilitate retention of the arm 16 in the stowed position inside the slot 55 of body 12*e* when the brace 10*e* is not in use (see, e.g., FIG. 79), the distal end 32 of arm 16 includes a narrow gap 103 between two opposing tabs 102, 104. On the forward surface of foremost tab 102 and rearward surface of rearmost tab 104 is formed a shallow recess 101 sized and shaped to receive a complimentary protuberance 108 formed on the corresponding forward and rearward surfaces 54, 56 of slot 55. The protuberances 108 engage the shallow recess 101 of each tab 102, 104 and releasably retain the arm 16 in slot 55 in vertical alignment with the elongated body 12*e* when the arm 16 is in the stowed position. Like brace 10*d*, the left and right exterior surfaces or edges of the arm 16 do not extend beyond the exterior surfaces of the left and right sides 11, 13 of elongated body 12*e* when the arm is in the stowed position.

A user can quickly and easily deploy the arm 16 to the right or left (see, e.g., FIGS. 69 and 89, respectively) by applying pressure to either side of the arm 16 while the arm is received in the slot 55 and shallow recesses 101 are engaged by the protuberances 108. The narrow gap 103 in the distal end 32 of the arm 16 allows the tabs 102, 104 to flex toward each other like a living hinge so that the arm 16 can be easily deployed to either the left 11 or right 13 side of the elongated body 12*e*, or moved back into the stowed position using only finger pressure.

In all embodiments disclosed herein, the brace can be made out of a wide variety of strong, durable, rigid materials, including but not limited to, metal, metal alloys, carbon fibers, reinforced polymers, plastics, synthetic polymers, and wood. In some embodiments, the body and first and second arms 14, 16 are machined from a metal or a metal alloy such as aluminum or steel, respectively. In other embodiments, the body and first and second arms 14, 16 are injection molded out of a polymeric material such as reinforced polymer. In still yet other embodiments, the body can be made out of a different material or combination of materials than the first and second arms 14, 16. In the embodiment depicted in FIGS. 1 through 10, the brace is machined from billet aluminum. In the embodiments depicted in FIGS. 14 through 100, the brace is injection molded from reinforced polymer.

Although embodiments of the present invention have been described in detail, it will be understood by those skilled in the art that various modifications can be made therein without departing from the spirit and scope of the invention as set forth in the appended claims. For example, although aspects of the invention have been described in the context of use as a brace for stabilizing a handgun on or against a user's forearm, it is to be understood that the invention disclosed herein can also be used to stabilize other handheld devices, including without limitation, metal detectors, vacuums, drills and other tools, on or against a user's forearm.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful HANDGUN BRACE, it is not intended that such references be construed as limitations upon the scope of this invention.

What is claimed is:

1. A brace for stabilizing a handheld device against a user's forearm, comprising:

an elongated body adapted to detachably engage a portion of the handheld device, the elongated body including an arm receiving portion; and an arm pivotably connected to the elongated body, the arm selectably moveable between a stowed position wherein the arm is at least partially received within the arm receiving portion, and a deployed position wherein the arm provides a surface against which a user's forearm is removably receivable to stabilize the handheld device when the elongated body is engaged with the handheld device.

2. The brace of claim 1, wherein the elongated body includes a body and a fixed arm.

3. The brace of claim 1, wherein the arm is substantially adjacent the elongated body when the arm is in the stowed position.

4. The brace of claim 1, wherein the arm is vertically parallel with a portion of the elongated body when the arm is in the stowed position.

5. The brace of claim 1, wherein the arm is pivotably connected to a lower end portion of the elongated body.

6. The brace of claim 5, wherein an end portion of the arm distal to the lower end portion of the elongated body is at least partially received inside the elongated body when the arm is in the stowed position.

7. The brace of claim 1, wherein the arm extends outwardly from a side of the elongated body when the arm is in the deployed position.

8. The brace of claim 1, wherein the arm is selectably moveable at least partially in a side direction away from the elongated body.

9. The brace of claim 1, wherein the arm is selectably moveable through a plane substantially normal to an axis extending between a forward surface and a rearward surface of the elongated body.

10. The brace of claim 1, wherein the arm receiving portion of the elongated body is a slot in which the arm is removably receivable when the arm is in the stowed position.

11. The brace of claim 10, wherein the slot extends completely through the elongated body from a first side to a second side of the elongated body.

12. The brace of claim 1, wherein the elongated body is adapted to releasably retain the arm in the stowed position when the arm is received in the arm receiving portion.

13. The brace of claim 1, further comprising:

a protrusion extending from an interior surface of the slot; and a recess in which the protrusion is removably receivable defined in a portion of the arm to selectably secure the arm in the stowed position when the arm is received in the arm receiving portion.

14. The brace of claim 1, wherein:

the elongated body includes an elongated extension portion extending from a forward surface of the elongated body; and the extension portion is adapted to detachably engage a portion of the handheld device.

15. The brace of claim 1, wherein a portion of the elongated body is configured to receive a portion of the handheld device at least partially therethrough.

16. The brace of claim 1, wherein the elongated body includes a passage in which a portion of the handheld device is telescopically receivable to attach the brace to the handheld device, the passage extending through at least a portion of the elongated body from a forward end of the elongated body toward a rearward end of the elongated body.

17. The brace of claim 1, wherein the elongated body comprises a selectably releasable clamping member operable to releasably engage a portion of the handheld device to attach the brace to the handheld device.

18. The brace of claim 1, wherein the handheld device is a firearm.

19. A firearm, comprising:

a rear end portion; and a brace for stabilizing the firearm against a user's forearm, the brace comprising:

an elongated body adapted to detachably engage the rear end portion of the firearm, the elongated body including an arm receiving portion; and an arm pivotably connected to the elongated body, the arm selectively moveable between a stowed position wherein the arm is at least partially received within the arm receiving portion, and a deployed position wherein the arm provides a surface against which a user's forearm is removably receivable to stabilize the firearm when the elongated body is engaged with the rear end portion of the firearm.

20. A method of stabilizing a firearm, comprising:

providing a handgun and a brace for stabilizing the handgun against a user's forearm, the brace comprising:

an elongated body adapted to detachably engage a rear end portion of the handgun, the elongated body including an arm receiving portion; and an arm pivotably connected to the elongated body, the arm selectively moveable between a stowed position wherein the arm is at least partially received within the arm receiving portion, and a deployed position wherein the arm provides a surface against which a user's forearm is removably receivable to stabilize the handgun when the elongated body is engaged with the rear end portion of the firearm; and holding a grip portion of the handgun while the brace is engaged with the rear end portion of the handgun and the user's forearm is received against the arm.

* * * * *